US006760561B2

(12) United States Patent
Kurosu

(10) Patent No.: US 6,760,561 B2
(45) Date of Patent: Jul. 6, 2004

(54) DEVELOPING DEVICE USING A TWO-INGREDIENT TYPE DEVELOPER AND IMAGE FORMING APPARATUS USING THE SAME

(75) Inventor: Hisao Kurosu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 9 days.

(21) Appl. No.: 10/236,905

(22) Filed: Sep. 9, 2002

(65) Prior Publication Data

US 2003/0049053 A1 Mar. 13, 2003

(30) Foreign Application Priority Data

Sep. 10, 2001 (JP) ..... 2001-273442
Mar. 22, 2002 (JP) ..... 2002-080791

(51) Int. Cl.[7] ..... G03G 15/09
(52) U.S. Cl. ..... 399/267; 399/277; 430/111.41
(58) Field of Search ..... 399/267, 265, 399/266, 252, 270, 276, 277, 53, 55; 430/122, 120, 111.41

(56) References Cited

U.S. PATENT DOCUMENTS 5,311,263 A * 5/1994 Suzuki et al. ..... 399/276
5,860,049 A * 1/1999 Kumasaka et al. ..... 399/267
6,001,525 A * 12/1999 Ida et al. ..... 430/111.41 X
2001/0017999 A1 * 8/2001 Kai et al. ..... 399/277
2002/0009312 A1 * 1/2002 Sugimoto et al. ..... 399/270
2002/0028092 A1 * 3/2002 Ariizumi et al. ..... 399/267
2002/0028093 A1 * 3/2002 Miyoshi et al. ..... 399/267
2002/0141789 A1 * 10/2002 Terai ..... 399/267
2002/0146632 A1 * 10/2002 Kurosu et al. ..... 430/122

FOREIGN PATENT DOCUMENTS

| | | |
|---|---|---|
| JP | 05-303284 | 11/1993 |
| JP | 2000-305360 | 11/2000 |
| JP | 2001-051509 | 2/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A developing device of the present invention includes a developing roller provided with a plurality of magnetic poles. The magnetic poles include a main pole and two auxiliary poles positioned at both sides of the main pole for helping the main pole form a magnetic force. The auxiliary poles reduce the half width of the main pole. An AC-biased DC bias for development is applied to the developing roller and disturbs carrier grains close to the developing roller. Images free from various defects including granularity and local omission are achievable with the developing device.

51 Claims, 36 Drawing Sheets

FIG. 11

| | ROLLER | BIAS | OMISSION RANK | GRANULARITY RANK |
|---|---|---|---|---|
| REF. 1 | A | DC −500V | 4.5 | 2 |
| COM. EX. 1 | B | | 2.5 | 1.5 |
| EX. 1 | A | DC+AC f: 5kHz, duty: 25%, offset voltage: −700V, & Vp-p of 800V | 4.5 | 4.5 |
| COM. EX. 2 | B | | 3 | 2.5 |

A: DISTRIBUTIONS OF FIG. 5
B: DISTRIBUTIONS OF FIG. 12

FIG. 13

| | DUTY(%) | GRANULARITY RANK |
|---|---|---|
| EX. 2 | 10 | 4.75 |
| EX. 3 | 20 | 4.75 |
| EX. 4 | 30 | 4.75 |
| EX. 5 | 40 | 4.75 |
| EX. 6 | 45 | 4.75 |
| REF. 2 | 50 | 4 |
| REF. 3 | 60 | 3.5 |

DEVELOPING DEVICE USING A TWO-INGREDIENT TYPE DEVELOPER AND IMAGE FORMING APPARATUS USING THE SAME

BACKGROUND OF THE INVENTION

1. Field of the Invention

The present invention relates to a developing device using a two-ingredient type developer and a copier, printer facsimile apparatus or similar monochromatic or color image forming apparatus.

2. Description of the Background Art

It is a common practice with an image forming apparatus to form a latent image on an image carrier, develop the latent image with a developing device to thereby produce a corresponding toner image, transfer the toner image to a sheet or cording medium, and fix the toner image on the sheet. The developing device, in many cases, uses a two-ingredient type developer made up of nonmagnetic toner grains and magnetic carrier grains. The developer is scooped up onto a developer carrier and caused to form a magnet brush thereon. The magnet brush is brought into contact with the image carrier, so that the toner grains deposit on the latent image formed on the image carrier.

The developer carrier includes a rotatable sleeve and a plurality of magnets fixed in place inside the sleeve. One of the magnets forms a main pole for development in the developing zone of the surface of the sleeve that faces the image carrier. In the developing zone, the carrier grains included in the developer rise in the form of brush chains along the magnetic lines of force of the main pole, thereby forming the magnet brush. This kind of developing system is generally referred to as a contact, two-ingredient type developing system. Although this type of developing system needs sophisticated control over the toner content of the developer and is bulky, it is predominant over the other developing systems because of high image quality and maintainability achievable therewith.

To cause the toner grains to move from the developer carrier to the image carrier, the contact, two-ingredient type developing system forms an electric field for causing the toner grains to leave the magnet brush approached the image carrier and deposit on the latent image. More specifically, the toner grains leave the carrier grains in cloud- or smoke-like groups due to the behavior of the carrier grains. The groups of toner grains are caused to move toward the latent image by the electric field. To promote the efficient movement of the toner grains, the peak of the magnetic lines of force of the main pole is located at a position where the developer carrier and image carrier are closest to each other, so that the highest portion of the magnet brush coincides with the developing zone.

In practice, however, the ratio by which the toner grains released from the magnet brush are used (efficiency) achievable with the contact, two-ingredient type developer is presumably low. In light of this, Japanese Patent No. 3,015,116, for example, discloses a developing system in which toner grains are deposited on a developer carrier in the form of a thin layer and then applied with an AC bias via, e.g., a wire electrode in a developing zone to thereby form a toner cloud. Japanese Patent Nos. 3,023,999, 3,077,235, 3,084,465, 2,850,504 and 2,668,781, Japanese Patent Publication No. 8-44214 and Japanese Patent Laid-Open Publication No. 8-44214 also propose various schemes for promoting the efficient use of toner grains. The schemes proposed in these documents are identical with the above Patent No. 3,015,116 in that a new arrangement and a power supply are added to the basic construction of the contact, two-ingredient type developing system.

Further, to promote efficient development, a plurality of developer carriers may be arranged, as taught in Japanese Patent Laid-Open Publication Nos. 2-173684 and 8-278691 by way of example.

A problem with the AC bias scheme using, e.g., a wire electrode is that it needs an exclusive arrangement and an exclusive power supply for producing more toner clouds in addition to the basic construction of the developing system, resulting in a sophisticated configuration and an increase in power consumption. In addition, it is difficult to form a thin toner layer on the developer carrier. Another problem is that irregularity appears in an image due to the contamination of the wire electrode. This is true not only with a wire electrode but also with any other implementation for producing more toner clouds.

The system using a plurality of developer carriers is undesirable because it increases the overall size and cost of the image forming apparatus.

When a distance between the developer carrier and the image carrier, i.e., a development gap is increased, the force with which the magnet brush rubs the latent image decreases and reduces the omission of the trailing edge of an image while promoting faithful reproduction of horizontal lines. However, such a development gap causes the toner grains to deposit on the edges of the latent image in a large amount (so-called edge effect or edge enhancement). More specifically, the edge effect renders solitary dots larger than expected, thickens lines, enhances the contour of a solid portion or that of a halftone portion or omits the outside of such a portion. The edge effect therefore makes control over tonality reproduction sophisticated.

Although a small development gap reduces the edge effect and protects images from granularity, it intensifies the force with which the magnet brush rubs the image carrier. This, coupled with the influence of the charge of opposite polarity deposited on the carrier grains, brings about the omission of the trailing edge of an image and unfaithful reproduction of horizontal lines and dots, resulting in a direction-dependent image.

On the other hand, Japanese Patent Laid-Open Publication No. 5-303284 teaches a non-contact type developing system in which two magnetic poles sandwich a developing zone in the vicinity of an image carrier while a gap between a developer carrier and the image carrier is sized greater than the thickness of a developer layer. In this configuration, the developer is caused to jump up from the developer carrier. With such a developing system, it is possible to extremely faithfully reproduce a highlight portion and implement a high-definition halftone portion. However, the development efficiency available with this developing system is low and likely to bring about short density and blur of a black solid portion.

I proposed a new developing system, which is not known in the art, including a developer carrier facing an image carrier and accommodating magnets therein and causing a two-ingredient type developer to deposit on the developer carrier in the form of a layer. A difference in speed is provided between the developer carrier and the magnets in order to cause the developer layer to flow at least in a region where the developer carrier and image carrier face each other, while forming a magnet brush. During the flow, free toner grains released from magnetic carrier grains are caused to deposit on a latent image formed on the image carrier.

It was experimentally found that the developing system using the free toner grains was advantageous over the magnet brush type developing systems effecting development only in the region where the carrier grains contact the image carrier in the following aspect. The developing zone is extended because of the free toner grains available for development, so that the amount of development and therefore development efficiency is increased. This insures a solid image portion having high density.

Technologies relating to the present invention are also disclosed in, e.g., Japanese Patent Laid-Open Publication Nos. 5-303284, 2000-305360 and 2001-51509.

SUMMARY OF THE INVENTION

It is an object of the present invention to provide a developing device capable of efficiently using toner while solving the problems discussed above, and an image forming apparatus using the same.

It is another object of the present invention to provide a developing device capable of obviating granularity and the omission of the trailing edge of an image (including image noise, e.g., unfaithful reproduction of horizontal lines and omission of dots) that are dependent on a development gap in a tradeoff relation, and an image forming apparatus using the same.

It is a further object the present invention to provide a developing device capable of further enhancing efficient development to thereby provide even a black solid image with high density, and an image forming apparatus using the same.

A developing device of the present invention includes a developer carrier accommodating stationary magnetic field generating means there inside for scooping up a developer, which is made up of non-magnetic toner grains and magnetic carrier grains, onto the developer carrier to thereby form a magnet brush. The magnet brush is caused to contact the image carrier to thereby develop a latent image formed on the image carrier. The carrier grains forming the magnet brush are disturbed in a developing zone.

A least two brush chain forming portions where the magnet brush rises may be formed in a region where the developer carrier and image carrier face each other.

BRIEF DESCRIPTION OF THE DRAWINGS

The above and other objects, features and advantages of the present invention will become more apparent from the following detailed description taken with the accompanying drawings in which:

FIG. 11 is a table listing experimental results relating to the omission of the trailing edge of an image and granularity;

FIG. 13 is a table listing experimental results pertaining to a relation between duty and granularity;

DESCRIPTION OF THE PREFERRED EMBODIMENTS

In the contact, two-ingredient type developing system, it has heretofore been considered that toner grains deposited on carrier grains around an image carrier move toward the image carrier at a position where a magnet brush contacts the image carrier, as stated earlier. I observed the behavior of toner grains in a developing zone via a high-speed camera with a high magnification and found that a magnet brush constituted by carrier grains was so dense, toner grains deposited on the carrier grains close to the developer carrier hardly moved toward an image carrier.

Figure 1:
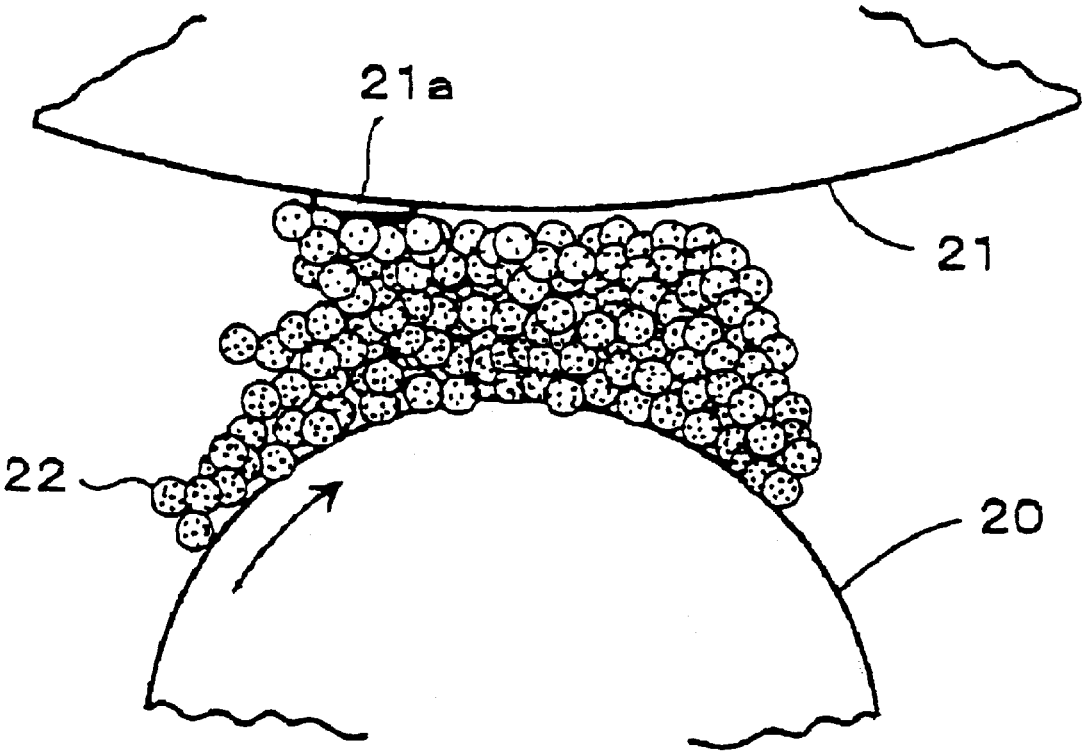
FIG. 1 PRIOR ART
FIG. 1 is a sketch demonstrating the behavior of a developer to occur in a developing zone, as observed by eye.

More specifically, as shown in FIG. 1, a magnet brush is formed on a developer carrier 20 in a developing zone where the developer carrier 20 faces an image carrier 21. Toner grains are fed from the magnet brush contacting the image carrier 21 to a latent image 21*a* formed on the image carrier, thereby developing the latent image. Stated another way, FIG. 1 shows how the toner grains are held in the magnet brush after development, i.e., how the toner grains are supported by carrier grains 22. In FIG. 1, the number of dots positioned in the individual carrier grain 22 is representative of the amount of toner grains deposited on the carrier grain 22; the toner grains have left the carrier grains 22 with small numbers of dots;

As shown in FIG. 1, the toner grains on the carrier grains close to the developer carrier 20 hardly move toward the latent image 21*a* although the toner grains on the carrier grains close to the image carrier 21 move toward the latent image 21*a*.

When the magnet brush is brought into contact with the image carrier 21, a force acts on the carrier grains 22 and causes them to move on the image carrier 21, promoting the release of the toner grains from the carrier grains 22, as observed via a high-speed camera. Such toner grains move toward the latent image 21*a* along an electric field. However, the carrier grains close to the developer carrier 20 presumably do not move as actively as the carrier grains close to the image carrier 21, but simply move at constant speed in the direction of rotation of a sleeve, causing the toner grains to move little. More specifically, a difference in toner content was observed in the direction of height of the magnet brush. This is presumably why the conventional methods cannot efficiently use toner. It follows that if the carrier grains close to the developer carrier 20 are disturbed, then the toner grains on such carriers can easily move and contribute to development to thereby enhance efficient development.

Reference will be made to FIGS. 2 through 10 for describing an image forming apparatus embodying the present invention and implemented as a color copier by way of example. As shown, the color copier includes a color scanner or color image reading device 1, a color printer or color image recording device 2, a sheet bank 3, and a control unit that will be described specifically later.

The color scanner 1 illuminates a document 4 laid on a glass platen 101 with a lamp 102. The resulting imagewise reflection from the document 4 is incident to a color sensor 105 via mirrors 103*a*, 103*b* and 103*c* and a lens 104. The color sensor converts the incident image light to electric image signals representative of color components, e.g., red (R), green (G) and blue (B) components. In the illustrative embodiment, the color sensor 105 is made up of R, G and B color separating means and a CCD (Charge Coupled Device) image sensor or similar photoelectric transducer. An image processing section, not shown, executes color conversion on the basis of the intensity levels of the R, G and B image signals, thereby outputting black (Bk) cyan (C), magenta (M) and yellow (Y) color image data.

Figure 2:
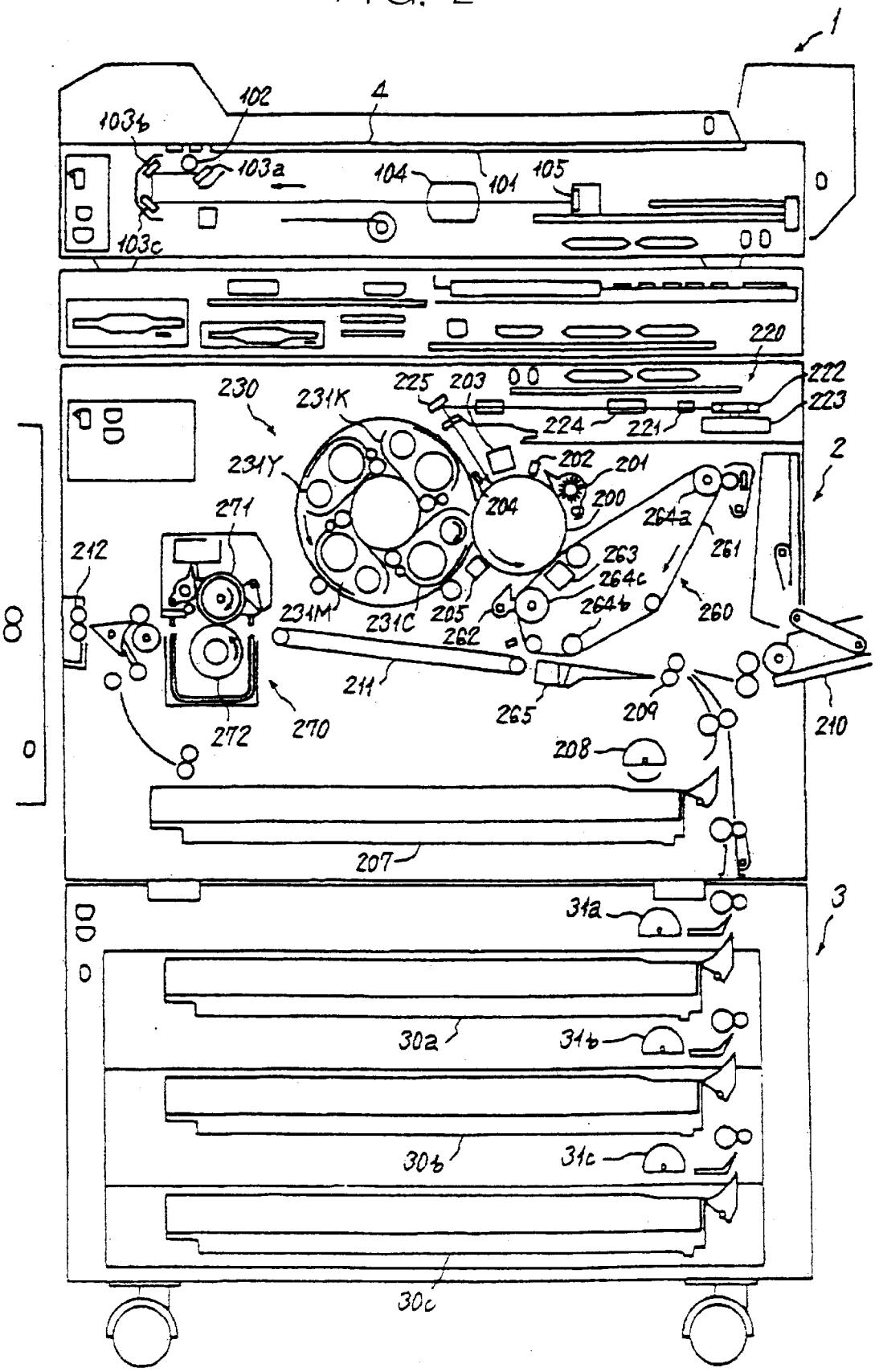
FIG. 2 is a front view showing an image forming apparatus embodying the present invention.

More specifically, in response to a scanner start signal synchronous to the operation of the printer 2, optics including the lamp 102 and mirrors 103*a* through 103*c* scans the document 4 in a direction indicated by an arrow in FIG. 2 (leftward). Every time the optics scans the document 4, color image data of one color is output. That is, the optics repeatedly scans the document 4 four times to sequentially output color image data of four colors. The color printer 2 forms an image of one color in accordance with the image data of each color while superposing them on each other, thereby forming a four-color or full-color image.

The color printer 2 includes a photoconductive drum or image carrier 200, an optical writing unit 220, a revolver type developing device 230, an intermediate image transferring device 260, and a fixing unit 270. The drum 200 is rotatable counterclockwise, as indicated by an arrow in FIG. 2. Arranged around the drum 200 are a drum cleaner 201, a quenching lamp 202, a charger 203, a potential sensor or potential sensing means 204, a density pattern sensor 205, and a belt 261 included in the intermediate image transferring device. Also, one of developing sections included in the developing device 230, which will be described later, faces the drum 200.

The optical writing unit 220 transforms the color image data output from the color scanner 1 to an optical signal and scans the drum 200 with the optical signal for thereby forming a latent image. The writing unit 220 includes a semiconductor laser or light source 221, a laser driver, not shown, a polygonal mirror 222, a motor 223 for driving the polygonal mirror 222, an fθ lens 224, and a mirror 225.

The developing device 230 includes a Bk developing section 231K, a C developing section 231C, an M developing section 231M, a Y developing section 231Y, and a drive mechanism for rotating the assembly of four sections 231K through 231Y counterclockwise, as indicated by an arrow in FIG. 2. The developing sections 231Bk through 231Y each include a sleeve and a rotatable paddle or agitator. A developer is caused to form a magnet brush on the sleeve and conveyed by the sleeve into contact with the surface of the drum 200 for thereby developing the latent image. The paddle agitates the developer while scooping it up.

In each developing section 231, toner is charged to negative polarity by being agitated together with ferrite carrier. A bias power supply or bias applying means applies a bias for development, which is a DC voltage $V_{DF}$ biased by a negative DC voltage $V_{GF}$, to the sleeve, so that the sleeve is biased to a preselected potential relative to the metallic core of the drum 200.

When the copier is in a stand-by state, the developing device 230 remains stationary with its Bk developing section 231K facing the drum 200 at a developing position. When the copier is caused to start operating, the color scanner 1 starts outputting Bk image data at a preselected timing. Optical writing using a laser beam and the formation of a latent image start on the basis of the Bk image data. Let the latent image derived from the Bk image data be referred to as a Bk latent image hereinafter. This is also true with C, M and Y. Before the leading edge of the Bk latent image arrives at the developing position, the sleeve of the Bk developing section 231K starts rotating in order to develop the Bk latent image from the leading edge with Bk toner. As soon as the trailing edge of the Bk latent image moves away from the developing position, the developing device 230 is rotated to bring the next developing section thereof to the developing position. This rotation completes at least before the leading edge of the next latent image arrives at the developing position. The developing device 230 will be described more specifically later.

The intermediate image transferring device 260 includes a belt cleaner 262 and a corona discharger or belt transfer unit 263 in addition to the belt 261 mentioned earlier. The belt 261 is passed over a drive roller 264*a,* a 264*b,* a 264*c* and a plurality of driven rollers, as illustrated and driven by a motor not shown. The belt 261 is formed of ETFE (ethylene tetrafluoroethylene) and provided with surface resistance of $10^8$ Ω/cm$^2$ to $10^{10}$ Ω/cm$^2$.

The belt cleaner 262 includes an inlet seal, a rubber blade, a discharge coil, an outlet seal, and a mechanism for selectively moving the inlet seal and rubber blade into or out of contact with the belt 261. While the transfer of the toner images of the second to fourth colors to the belt 261, which follows the transfer of the toner image of the first color, is under way, the inlet seal and blade are released from the belt 261 by the above mechanism. The corona discharger 263 applies an AC-biased DC voltage or a DC voltage by corona discharge for thereby transferring the full-color image from the belt 261 to a sheet or recording medium.

The sheet bank 3 and a sheet cassette 207 positioned in the color printer 2 store sheets of various sizes. Pickup rollers 31*a,* 31*b,* 31*c* and 208 each feed the sheets from a particular sheet cassette 30*a,* 30*b,* 30*c* associated therewith toward a registration roller pair 209 one by one. A manual feed tray 210 is mounted on the right side of the printer, as viewed in FIG. 2, and available for the manual feed of OHP sheets, thick sheets and other special sheets.

In operation, when an image forming cycle begins, the drum 200 is rotated counterclockwise while the belt 261 is rotated clockwise. While the belt 261 is in movement, Bk, C, M and Y toner images are sequentially formed on the drum 200 while being sequentially transferred to the belt 261 one above the other, forming a full-color image.

More specifically, to form the Bk toner image, the charger 203 uniformly charges the surface of the drum 200 to about −700 V by corona discharge. The semiconductor laser 221 scans the charged surface of the drum 200 by raster scanning in accordance with a Bk image signal. As a result, the exposed portions of the drum 200 are lowered in potential in proportion to the quantity of scanning light, forming a Bk latent image. Bk toner deposited on the sleeve of the Bk developing section 231K is brought into contact with the Bk latent image. The Bk toner deposits on the exposed portions of the drum 200 where the charge has disappeared, but does not deposit on the other portions, thereby forming a corresponding Bk toner image.

The belt transfer unit 263 transfers the Bk toner image from the drum 200 to the belt 261 moving at constant speed in contact with the drum 200. The image transfer from the drum 200 to the belt 261 will be referred to as belt transfer hereinafter.

After the belt transfer, the drum cleaner 201 removes some toner left on the drum 200 to thereby prepare the drum 200 for the formation of the next image. The toner collected by the drum cleaner 201 is delivered to a waste toner tank via a pipe although not shown specifically.

Subsequently, the color scanner 1 starts reading C image data at a preselected timing, so that a C latent image is formed in accordance with the resulting C image data. After the trailing edge of the Bk latent image has moved away from the developing position, but before the leading edge of the C latent image arrives at the developing position, the developing device 230 is rotated to locate the C developing section 231C at the developing position. In this condition, the C developing section 231C develops the C latent image with C toner. As soon as the trailing edge of the C latent image moves away from the developing position, the developing device 230 is again rotated to bring the M developing section 231M to the developing position. This rotation is also completed before the leading edge of the next or M latent image arrives at the developing position.

A procedure for forming each of the M and Y toner images is identical with the procedure described above and will not be described specifically in order to avoid redundancy.

When the image forming operation described above begins, the sheet is fed from designated one of the sheet cassettes or the manual feed tray and stopped at the registration roller pair 209 for a moment. The registration roller pair 209 is driven to convey the sheet such that the leading edge of the sheet meets the leading edge of the toner image, which is being conveyed by the belt 261, at a corona discharger or sheet transfer unit 265.

When the sheet moved over the sheet transfer unit 265 while being superposed on the toner image on the belt 261, the sheet transfer unit 265 applies a positive charge to the sheet by corona discharge for thereby transferring almost the entire toner image from the belt 261 to the sheet. Subsequently, a discharger located at the left-hand side of the sheet transfer unit 265, as viewed in FIG. 2, discharges the sheet by AC-biased DC corona to hereby peal off the sheet from the belt 261.

A belt conveyor 211 conveys the sheet carrying the toner image thereon and peeled off the belt 261 to the fixing unit 270. In the fixing unit 270, a heat roller 271 controlled to preselected temperature and a press roller 272 pressed against the heat roller 271 fix the toner image on the sheet with and pressure. The sheet with the fixed toner image, i.e., a full-color copy is driven out of the copier by an outlet roller pair 212 and then stacked on a copy tray, not shown, face up.

On the other hand, after the belt transfer, the drum cleaner 201 cleans the surface of the drum 200 with a brush roller and a rubber blade. Subsequently, the quenching lamp 202 uniformly discharges the cleaned surface of the drum 200. After the sheet transfer, the blade of the belt cleaner 262 is again brought into contact with the belt 261 in order to clean the surface of the belt 261.

In a repeat copy mode, just after the procedure for forming the fourth or Y toner image for the first full-color image, the operation of the color scanner 1 and the formation of an image on the drum 200 for forming the first or Bk toner image for the second full-color image begin. This Bk toner image is transferred to the region of the belt 261 that has been cleaned by the belt cleaner 262 after the transfer of the first full-color image to the sheet.

While the above-description has concentrated on a full-color or four-color image, the same procedure will be repeated, in a three-color or a two-color mode, a number of times corresponding to the number of colors designated and the desired number of copies. In a single-color mode, only one of the developing sections of the developing device 230 corresponding to the desired color is continuously held in the developing position until a desired number of copies have been output. Also, the blade of the belt cleaner 262 is continuously held in contact with the belt 261.

In a full-color mode using sheets of size A3, it is desirable to form a toner image of one color for one turn of the belt 261, i.e., to form toner images of four different colors for four rotations of the belt 261. However, it is more desirable to form a toner image of one color for two turns of the belt 261 in order to reduce the size of the copier, i.e., the circumferential length of the belt 261, for thereby guaranteeing copy speed for small sizes without lowering copy speed for large sizes.

More specifically, to form a toner image one color for two turns of the belt 261, the color printer 2 simply idles, i.e., does not perform development or image transfer during the first turn of the belt 261, perform development with the C toner during the second turn of the belt 261, and then transfers the C toner image to the belt 261. Such a procedure is repeated thereafter. In this case, the developing device 230 is caused to rotate when the color printer 2 is idling.

Figure 3:
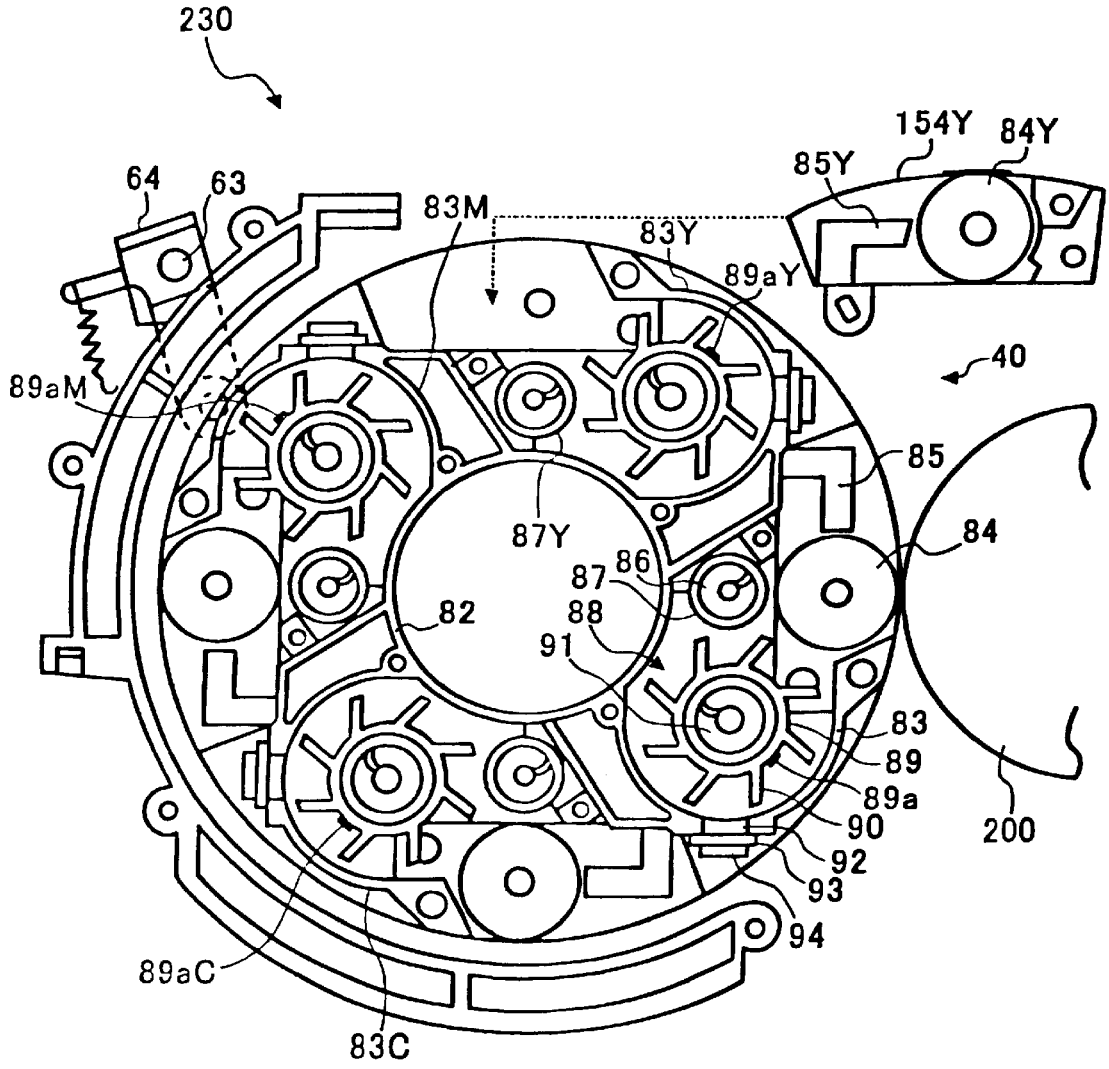
FIG. 3 is a section showing a revolver type developing device included in the illustrative embodiment.

Reference will be made to FIG. 3 for describing the revolver type developing device 230 more specifically. As shown, the developing device 230 includes a revolver or developing unit 40 including a front wall, a rear wall, and a partition positioned between the front and rear walls. The partition is made up of a hollow cylindrical portion 82 and four casing portions 83, 83C, 83M and 83Y. The hollow cylindrical portion 82 allows a toner bottle storing black toner to be inserted therein. The casing portions 83 and 83C through 83Y extend radially outward from the hollow cylindrical portion 82 to thereby divide the space around the portion 82 into four chambers, which are substantially identical in configuration.

The above chambers each store the developer consisting of carrier and toner of particular color. In the illustrative embodiment, the chamber located at the developing position forms the developing section 231K assigned to black. The other chambers constitute the other developing sections 231Y through 231C, as illustrated. The following description will concentrate on the chamber assigned to black by way of example while simply distinguishing the structures of the other chambers by suffixes Y,M and C.

In the black developing section (black chamber hereinafter) 231K located at the developing position, the casing portion 83 is formed with an opening facing the drum 200. A developing roller or developer carrier 84 is disposed in the black chamber 231K and partly exposed to the outside via the above opening. The developing roller 84 includes a sleeve accommodating a stationary magnet roller therein, as will be described specifically later.

In the black chamber 231K, a doctor blade 85 is configured to meter the amount of the developer to be deposited on and conveyed by the sleeve toward the developing position. An upper screw 86 and a guide 87 cooperate to convey part of the developer removed by the doctor blade 85 from the front to the rear in the axial direction of the screw 86. A paddle or agitator 88 agitates the developer existing in the black chamber 231K. The paddle 88 is made up of a hollow cylindrical portion 89 formed with a plurality of holes 89*a* in the widthwise direction of the developing roller 84 and a plurality of blades 90 extending radially outward from the hollow cylindrical portion 89.

A lower screw 91 is disposed in the hollow cylindrical portion 89 for conveying the developer in the opposite direction to the upper screw 86 in the axial direction. An opening 92 is formed in the casing portion 83 below the lower screw 91 in the axial direction of the screw 91. When the developer is to be replaced due to deterioration, the deteriorated developer is discharged via the opening 92. A fresh developer containing toner may be fed into the casing portion 83 via the same opening 92, as needed. A cap 93 is fastened to the casing portion 83 by, e.g., a screw 94 in order to close the opening 92.

Figure 4:
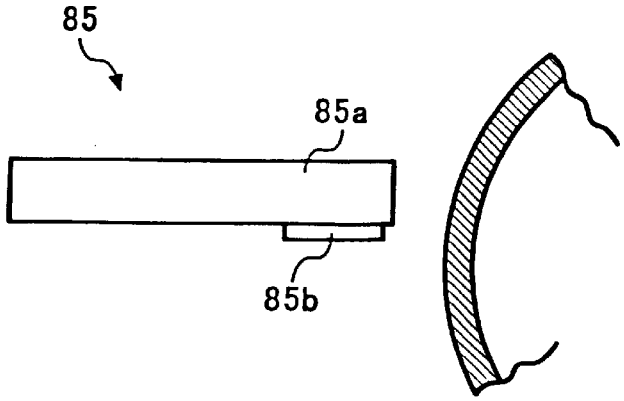
FIG. 4 shows a specific configuration of a doctor blade included in the developing device.

A doctor blade has customarily been implemented as a plate formed only of a nonmagnetic material. As shown in FIG. 4, in the illustrative embodiment, the doctor blade 85 is implemented as a plate 85*a* formed of a magnetic material and adhered to a conventional nonmagnetic plate 85*b*. The magnetic material allows a magnet brush with uniform height to be easily formed, as will be described in detail later.

The drum 200 has a diameter of 90 mm and moves at a linear velocity of 200 mm/sec while the sleeve has a diameter of 30 mm and moves at a linear velocity of 260 mm/sec. Therefore, the ratio of the sleeve linear velocity to the drum linear velocity is 1.3. When any one of the developing sections is located at the developing position, the distance between the drum 200 and the developing roller 84, i.e., a development gap is 0.4 mm.

A magnet roller is disposed in the developing roller 84 for forming a magnetic field that causes the developer to rise on the sleeve in the form of a magnet brush. More specifically, the magnetic field causes the carrier of the developer to rise on the sleeve in the form of brush chains. The charged toner grains also contained in the developer deposit on the brush chains to thereby complete a magnet brush.

Figure 5:
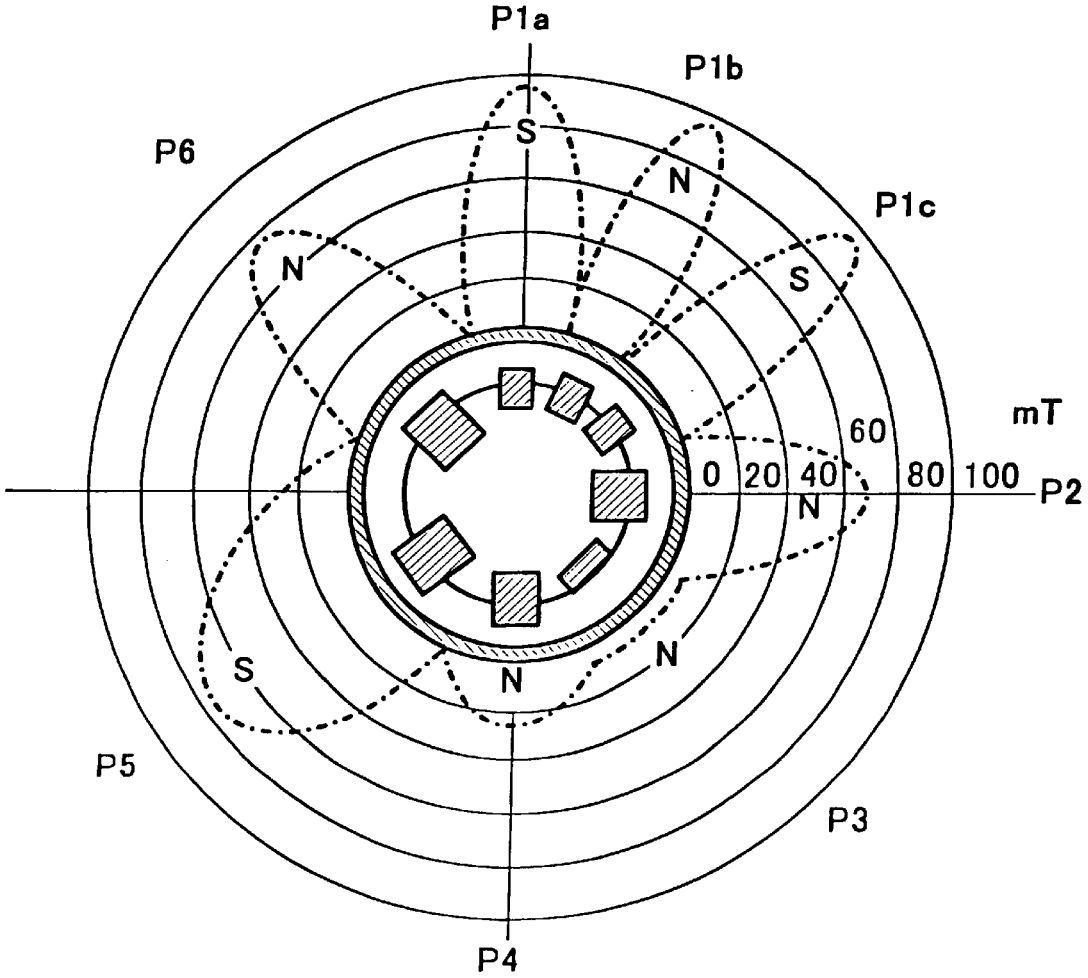
FIG. 5 shows magnetic field distributions formed by a developing roller included in the developing device.

As shown in FIG. 5, the magnet roller has a plurality of magnetic poles (magnets), i.e., a main pole P1*b*, auxiliary poles and P1*a* and P1*c*, positioned at both sides of the main pole P1*b*, and poles P2, P3, P4 and P5. The main pole P1*b* causes the developer to form a magnet brush in a developing zone while the auxiliary poles P1*a* and P1*c* help the main pole P1*b* exert a magnetic force. The pole P4 scoops up the developer to the sleeve. The poles P5 and P6 convey the developer deposited on the sleeve to the developing zone. The poles P2 and P3 convey the developer moved away from the developing zone.

The magnets P1*a* through P6 each are oriented in the radial direction of the sleeve. While the magnet roller of the illustrative embodiment has eight magnets or poles, two or four additional magnets may be positioned between the pole P3 and the doctor blade 85 in order to promote efficient scoop-up and enhance the ability to follow a black solid image.

The magnets P1*a*, P1*b* and P1*c* constituting a main magnetic pole group P1 are implemented by magnets arranged in this order from the upstream side and each having a small cross-sectional area. The magnets are formed of an alloy of rare earth metal although it may be formed of a samarium alloy, particularly samarium-cobalt alloy. A magnet formed of iron-neodymium-boron alloy, which is a typical rare earth metal alloy, has the maximum energy product of 358 kJ/m$^3$ while a magnet formed of iron-neodymium-boron alloy bond has the maximum energy product of 80 kJ/m$^3$. Such a magnet can provide the surface of the developing roller with a required magnetic force even if its size is noticeably reduced, compared to conventional magnets. When the sleeve diameter can be increased in a certain range, a small half width is achievable even with a conventional ferrite magnet or ferrite bond magnet if its end facing the sleeve is narrowed.

In the illustrative embodiment, the main magnet P1*b* and magnets P4, P6, P2 and P3 are an N pole each while the auxiliary magnets P1*a* and P1*c* and magnet P5 are an S pole each.

The main magnet P1*b*, for example, was implemented as a magnet exerting a magnetic force of 85 mT or above on the developing roller 84 in the normal direction. It was experimentally found that a magnet with a magnetic force of, e.g., 60 mT obviated carrier deposition or similar image defect. The magnets P1*a*, P1*b* and P1*c* were 2 mm wide each, providing the main pole P1*b* with a half width of 16°. When the width of the magnets was further reduced, the half width of the main pole P1*b* was further reduced. For example, when the width of the magnets were 1.6 mm, the half width of the main pole P1*b* was as small as 12°.

Figure 6:
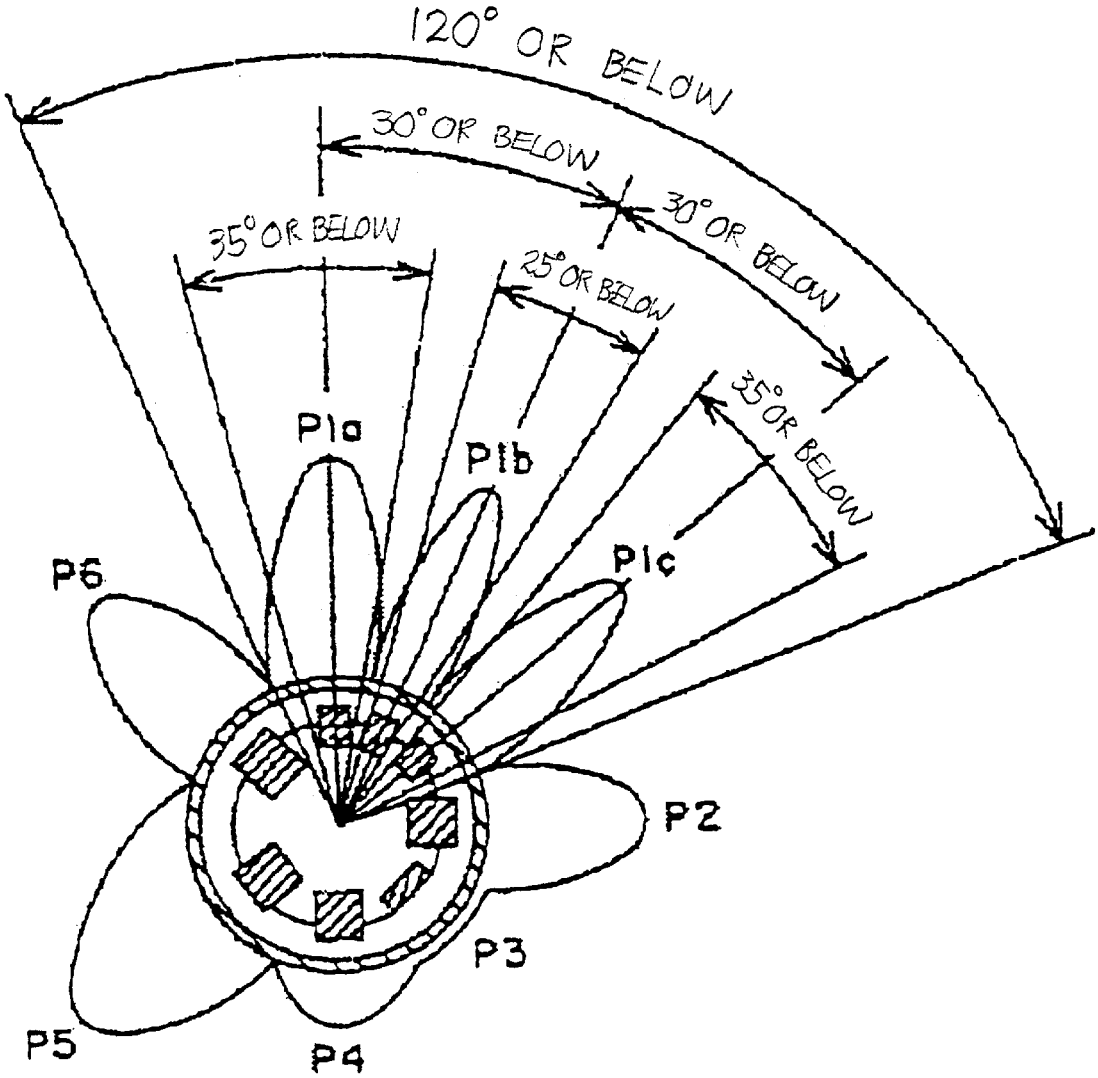
FIG. 6 shows a positional relation between a main magnetic pole and auxiliary magnetic poles included in the developing roller.

FIG. 6 shows a positional relation between the main pole P1*b* and the auxiliary poles P1*a* and P1*c*. As shown, the auxiliary magnets P1*a* and P1*c* each are provided with a half width of 35° or below. The half width of the auxiliary magnet P1*a* or P1*c* cannot be made as small as the half width of the main pole P1*b* because the magnet P2 or P6 positioned outside of the magnet P1*a* or P1*c* has a large half width. The angle between the main magnet P1*b* and the auxiliary magnet P1*a* or P1*c* is selected to be 30° or below although it is 22° in the above specific case that provides the main pole P1*b* with the half angle of 16°. Further, an angle between the polarity transition point between the auxiliary magnet P1*a* and the magnet P6 and the polarity transition point between the auxiliary magnet P1*c* and the magnet P2 is selected to be 120°. It is to be noted that a polarity transition point refers to a point where the N pole and S pole replace each other.

At the development nip between the developing roller 84 and the drum 200, the magnet brush formed on the roller 84 contacts the drum 200. While the toner moves between the drum 200 and the magnet brush to thereby effect development, the toner mainly moves at the development nip in the case of contact type development. The size of the electric field differs from a point where the drum 200 and roller 84 are closest to each other within the nip to a point where they are remotest from each other (nip boundary).

In the illustrative embodiment, the development gap is selected to be 0.4 mm. When such a development gap is varied, the distance between the drum 200 and the developing roller 84 varies at each of the nip center and nip boundary. As a result, for a uniform developer layer, the field strength varies in inverse proportion to the ratio between the drum 200 and the roller 84.

Experiments were conducted to determine a relation between the above variation and the omission of the trailing edge of an image and granularity, as will be describe specifically later.

The development nip refers to the zone where the magnet brush contacts the carrier while the nip boundary generally refers to the end of the zone downstream of the point where the image carrier and developer carrier are closest to each other. The auxiliary poles function to reduce the half width of the main pole to 25° or below, preferably 18° or below.

Further, the half width refers to an angular width between points where a magnetic force in the normal direction is one-half of the maximum magnetic force (peak) as to a magnetic force distribution curve. For example, when the maximum magnetic force of a magnet implemented as an N pole is 120 mT, the half width (50%) is 60 mT; if the half width is 80%, as sometimes used, then the half width is 96 mT. When the half width is reduced, the position where the magnet brush starts rising on the sleeve becomes closer to the main pole, and therefore the development nip itself is narrowed. The auxiliary pole is formed upstream and/or downstream of the main pole in the direction of developer conveyance.

To efficiently discharge the deteriorated developer from the opening 92, it is preferable for the operator to pull the developing unit 230 out of the copier body via a base, not shown, cause an input gear 95 (see FIG. 8A) and others to rotate by use of a jig for thereby rotating the upper screw 86, lower screw 91 and paddle 88. Also, when a fresh developer is to be introduced via the opening 92, it can be uniformly dispersed in the existing developer if the screws 86 and 92 and paddle 88 are rotated.

Figure 7:
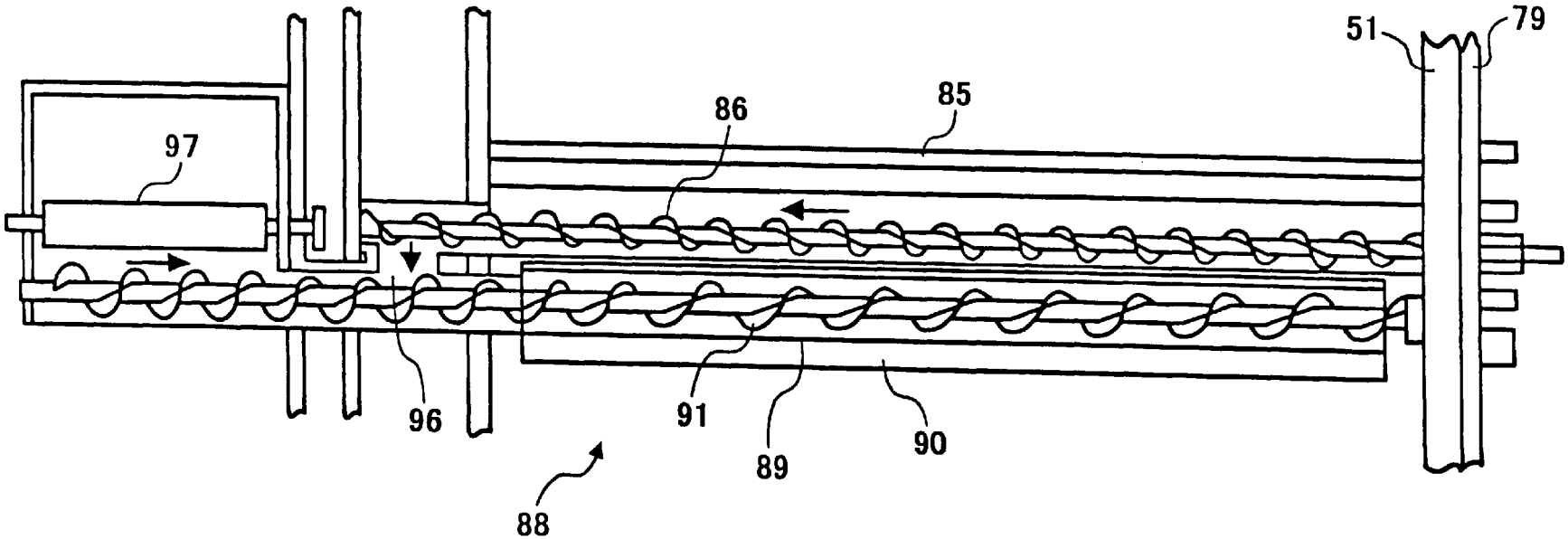
FIG. 7 is a section showing the connection of a developing chamber included in the developing device and a toner container.

FIG. 7 shows the upper screw 86 and lower screw 91 specifically. As shown, the front ends of the screws 86 and 91 extend to the outside of the effective widthwise range of the developing roller 84, i.e., to the outside of a front wall 50 included in the revolver 40. The developer conveyed by the upper screw 86 to such a position outside of the front wall 50 drops to the lower screw 91 via an opening 96 due to gravity.

The front end of the lower screw 91 extends over the above opening 96 into a chamber below a replenishing roller 97, which is positioned in corresponding one of toner chambers formed in a toner container unit not shown. In this configuration, part of the developer deposited on the developing roller 84, but removed by the doctor blade 85, and then conveyed to the front end by the guide 87 and upper screw 86 drops to the lower screw 91 via the opening 96. The lower screw 91 conveys the developer to the effective range of the developing roller 84. As a result, the developer is introduced in the developing chamber via the holes 89*a* of the paddle 88 and again deposited on the developing roller 84. In this manner, the developer is agitated in the developing chamber in the horizontal direction.

Further, the paddle 88 in rotation agitates the developer introduced in the developing chamber via the openings 89*a* in the vertical direction with its blades 90. On the other hand, fresh toner dropped to the lower screw 91 due to the rotation of the replenishing roller 97 is conveyed by the screw 91 to the opening 96 and mixed with the developer dropped from the upper screw 86. The resulting mixture is fed to the developing chamber via the holes 89*a,* increasing the toner content of the developer.

Figure 8A:
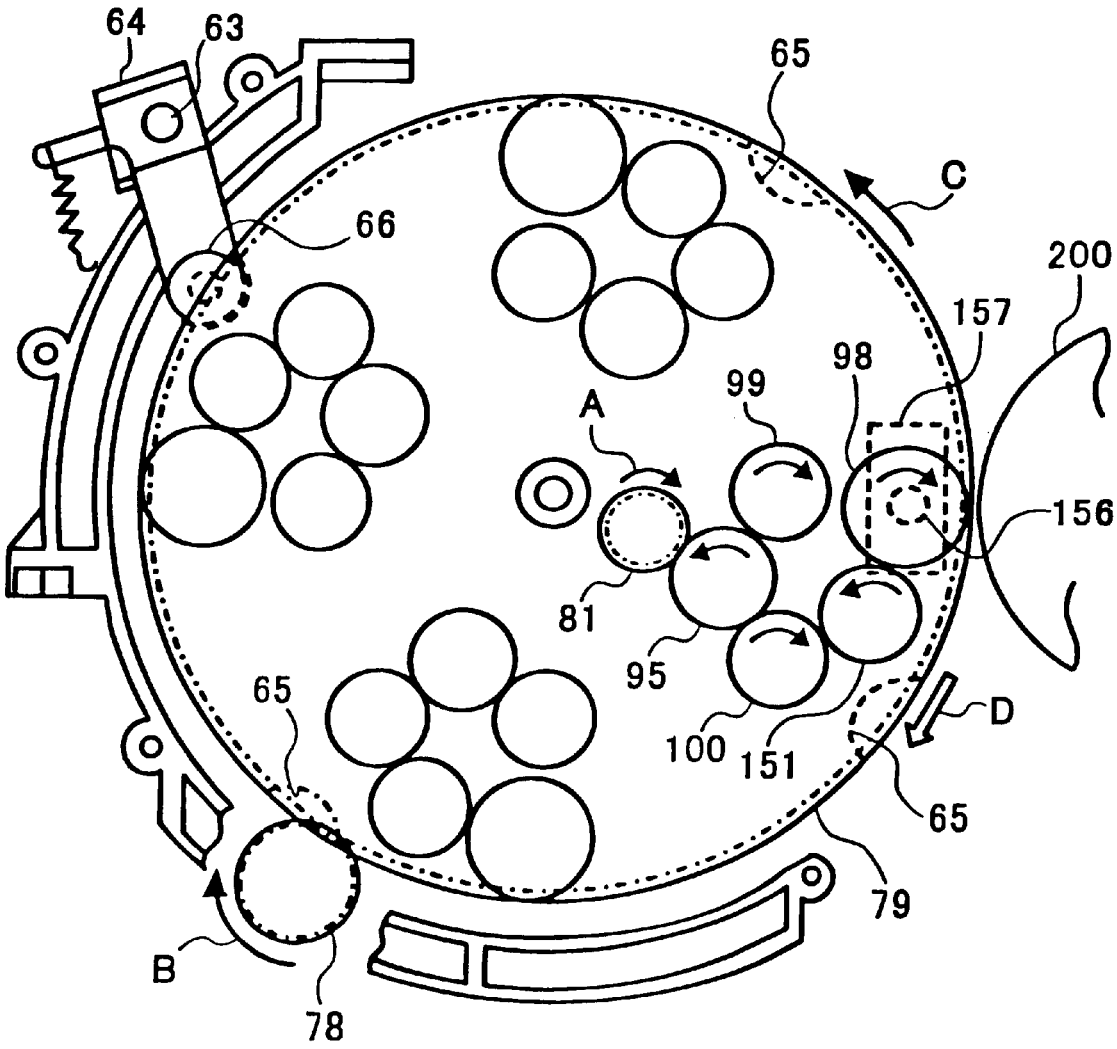
FIG. 8A is a perspective front view showing a driveline assigned to a revolver included in the developing device.

FIG. 8A is a perspective view showing the revolver 40 as seen from the front of the rear wall 51. As shown, a revolver input gear 79 is affixed to the rear end 51 while various gears are positioned at the rear of the revolver input gear 79, as illustrated. More specifically, a developing roller gear 98 is mounted on the end of the developing roller 84 that extends throughout the rear end 51 to the rear of the revolver input gear 79. Likewise, an upper and a lower screw gear 99 and 100 are respectively mounted on the ends of the upper and lower screws 86 and 91 that extend to the rear of the revolver input gear 79. An idle gear 151 is held in mesh with the developing roller gear 98 and lower screw gear 100. An output gear 81 is mounted on the rear wall 53 of the copier body and driven by a motor 80. The input gear 95 mentioned earlier is capable of meshing with the output gear 81. The idle gear 151 and input gear 95 are mounted on the back of the rear wall 51 of the revolver 40.

Figure 8B:
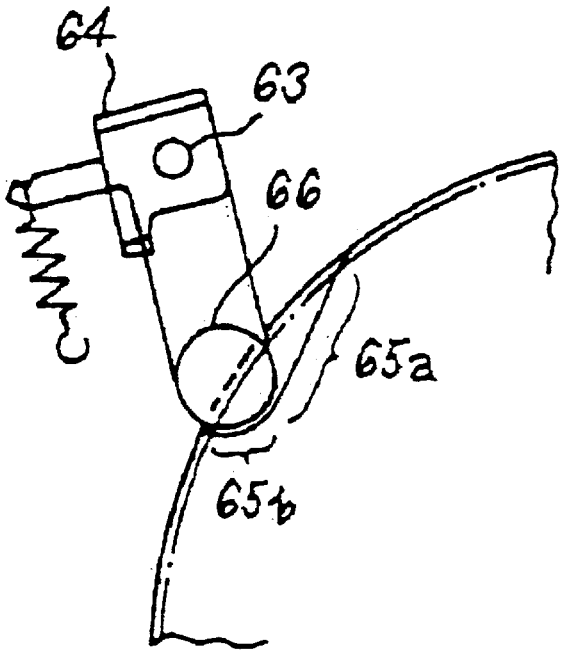
FIG. 8B shows a mechanism for positioning the revolver.

As shown in FIG. 8B, when the developing unit 230 having the above configuration is set on the base, not shown, and then inserted into the copier body, the input gear 95 is brought into mesh with the output gear 81. At the same time, the input gear 79 is brought into mesh with the output gear 78.

Figure 9A:
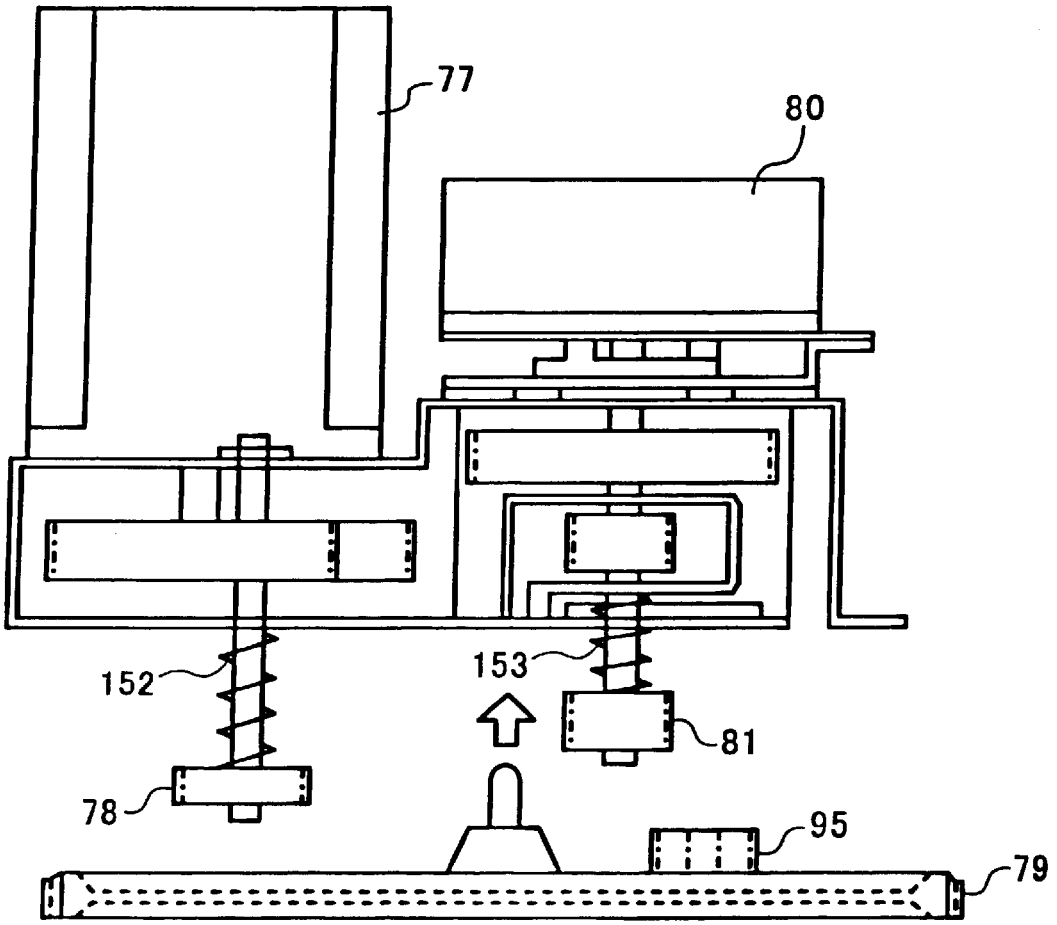
FIG. 9A is a plan view showing a drive motor portion assigned to the revolver.
Figure 9B:
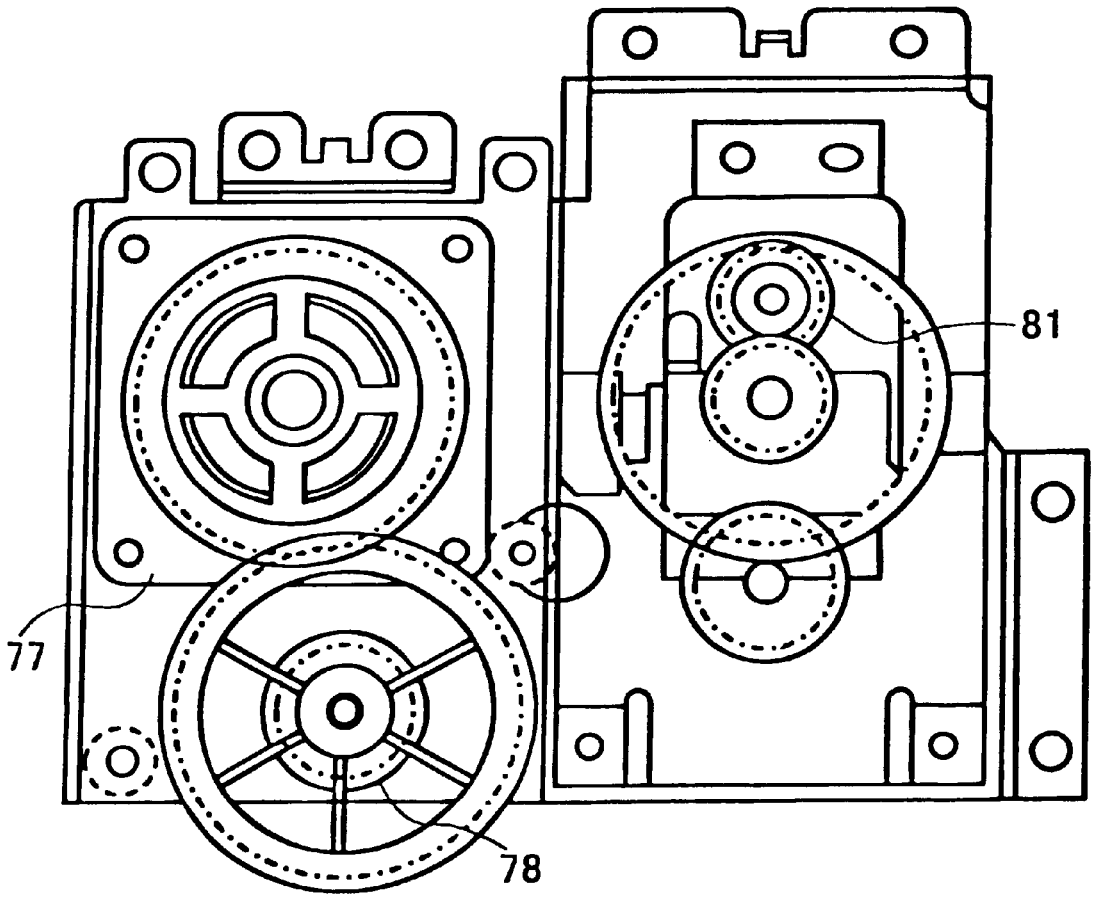
FIG. 9B is a front view of the drive motor portion.

FIGS. 9A and 9B are respectively a plan view and a front view showing the motor 77 together with arrangements around it. As shown, the gears 78 and 81 are mounted on the copier body to be retractable in the direction in which the base is slidable, so that the gears of the copier body and developing unit 230 can smoothly mesh with each other in accordance with the movement of the base. Further, springs 152 and 153 constantly bias the gears 78 and 81, respectively, toward the front side of the copier body. Therefore, even when the gears 78 and 81 of the copier body and the gears 79 and 95 of the developing unit 230 are in an interfering relation to each other, the gears 78 and 81 are retracted and allow the base to be fully inserted into the copier body. Subsequently, when the gears 78 and 81 are driven to rotate, the springs 152 and 153 force the gears 78 and 81 toward the developing unit 230 until the gears 78 and 81 respectively mesh with the gears 79 and 95 without interference.

As shown in FIG. 8A, when the gears are fully meshed, the output gear 81 is rotated in a direction indicated by an arrow A to, in turn, cause the input gear 95 meshing therewith to rotate. As a result, the upper and lower screw gears 99 and 100 start rotating. At the same time, the developing roller gear 98 is rotated via the input gear 95, lower screw gear 100 and idle gear 151, causing the developing roller 84 to rotate. It is to be noted that only the developing roller 84 and other constituents of the developing chamber located at the developing position are rotated by the above mechanism.

When the developing chamber is brought to the developing position, the output gear 81 and input gear 95 surely mesh with each other before the developer on the developing roller 84 contacts the drum 200. Also, when the developing chamber is moved away from the developing position, the gears 81 and 95 surely remain in mesh with each other until the developer on the developing roller 84 fully moves away from the drum 200. For this purpose, the gears 81 and 95 mesh with each other at a position close to the center of the developing unit 230.

As shown in FIG. 8A, in the illustrative embodiment, the revolver output gear 78 driven by the motor 77, which may be a stepping motor, is rotated in a direction B while the developing unit 230 is rotated in a direction C, thereby replacing the developing chamber located at the developing position. At this instant, a roller 66 is brought into one of recesses 65 formed in the circumference of the rear wall 51 at spaced locations, thereby positioning the developing unit 230.

It is likely that the rotation angle of the developing unit 230 is short of a preselected angle due to the irregularity of the motor 77 or that of a load acting on the developing unit 230. The preselected angle is, e.g., 90° when the developing chamber just upstream of the developing chamber located at the developing position should be brought to the developing position. In such a condition, the roller 66 fails to mate with expected one of the recesses 65 and therefore to accurately position the revolver 40, disturbing the distance between the developing roller 84 and the drum 200.

In light of the above, in the illustrative embodiment, the revolver motor 77 is rotated by an angle slightly greater than the preselected angle (e.g. by 3° or so) in consideration of the irregularity and can therefore surely rotate by the preselected angle. In addition, even when the revolver motor 77 is rotated by more than the preselected angle as a result of such control, a torque to act on the developing unit 230 when the motor 80 starts rotating is used to accurately position the revolver 40.

More specifically, as shown in FIG. 8A, the output gear 81 meshed with the input gear 95 is rotated in a direction A (rotation during usual development) in order to exert a torque on the revolver 40 in a direction opposite to the direction of usual rotation (outline arrow D), thereby returning the revolver 40. The return of the revolver 40 is stopped as soon as the roller 66 mates with expected one of the recesses 65, thereby locking the revolver 40. For this purpose, a positioning pin 63 supporting a bracket 64, which supports the roller 66, is positioned such that the bracket 64 is counter to the above returning rotation of the revolver 40 as to direction.

Further, when the revolver 40 rotates over the preselected angle due to the above control and causes the roller 66 to move out of the recess 65, it is preferable to reduce a load to act on the driveline with the following arrangement. As shown in FIG. 8B, the recess 65 is made up of two inclined portions 65*a* and 65*b* contiguous with each other. The roller 66 contacts the inclined portion 65*b* when locking the revolver 40 or rolls out of the recess 65 along the inclined portion 65*a*. The inclined portion 65*b* is inclined less than the inclined portion 65*b*, so that the roller 66 can easily roll out of the recess 65.

As shown in FIG. 3, the front and rear wall portions supporting, e.g., the developing roller 84 and doctor blade 85 of the yellow developing section 231 are implemented as small end walls 154Y removable from the other end wall portions. This allows the operator to remove the entire small end walls 154Y supporting the developing roller 84 and doctor blade 85 for cleaning or replacement.

Figure 8C:
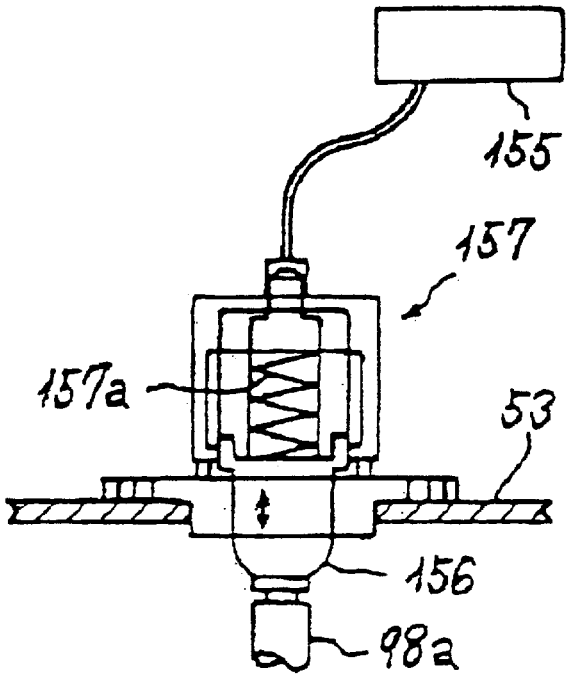
FIG. 8C shows a device for applying a bias for development to the revolver.

As shown in FIG. 8C, a conductive rod-like terminal 156 is connected to a bias power supply 155 and mounted on the rear wall 53 of the copier body such that the terminal 156 faces the developing roller shaft 98*a* of the developing chamber located at the developing position. The terminal 156 is supported by a bracket 157 in such a manner as to be retractable in the direction in which the base slides (direction of thrust). A conductive spring or biasing means 157*a* constantly biases the terminal 156 toward the front of the copier body.

The terminal 156 has a semispherical tip while the developing roller shaft 98*a* has a tip formed with a recess having an arcuate cross-section slightly larger in curvature than the semispherical tip. When the developing roller shaft 98*a* arrives at the terminal 156 due to the rotation of the revolver 40, the spherical tip and recess mate with each other with a minimum of contact load acting thereon and can remain in stable contact.

The terminal 156 applies a bias for development only to the chamber located at the developing position as during development. When any one of the developing chambers is brought to the developing position, the terminal 156 and developing roller shaft 98*a* surely contact each other before the developer on the developing roller 84 contacts the drum 200. Further, the terminal 156 and developing roller shaft 98*a* remain in contact until the developer on the developing roller 84 fully moves away from the drum 200 when the above chamber is moved away from the developing chamber.

Figure 10:
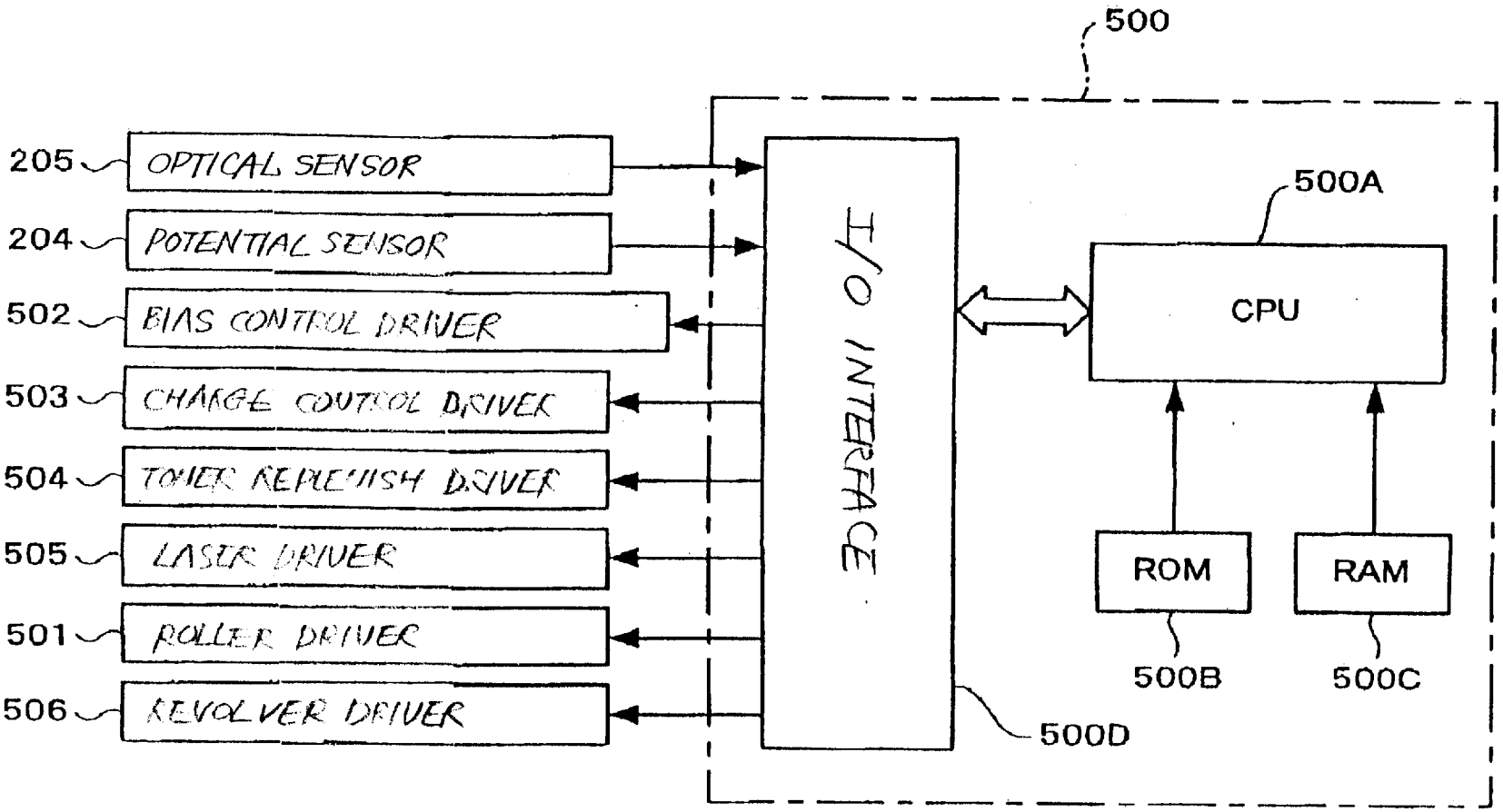
FIG. 10 is a schematic block diagram showing a control system included in the illustrative embodiment.

FIG. 10 shows a control system included in the illustrative embodiment. As shown, a controller 500 is implemented as a microcomputer including a CPU (Central Processing Unit) 500A, a ROM (Read Only Memory) 500B, a RAM (Random Access Memory) 500C, and an I/O (Input/Output) interface 500D. The ROM 500B stores a basic program for computation and control as well as basic data for computation and control. The RAM 500C serves as a work area for the CPU 500A.

Various external devices are connected to the CPU 500A via the I/O interface 500D. Specifically, the potential sensor 204 and density pattern sensor 205 mentioned earlier are connected to the input of the I/O interface 500D. The potential sensor 204 faces the drum 200 for sensing the potential of the drum 200 at a position preceding the developing position. The density pattern sensor 205 also faces the drum 200 and implemented as an optical sensor made up of a light-emitting element and a light-sensitive element.

Connected to the output of the I/O interface 500D are a developing roller driver 501, a developing bias control driver or developing bias switching means 502, a charge control driver or charge potential switching means 503, a toner replenishment driver 504, a laser driver 505, and a revolver driver 506. The developing bias control driver 502 applies an AC-biased DC voltage to the rod-like terminal 106 as a bias for development. Further, the bias control driver 502 selectively turns on or turns off the AC component independently of the DC component in accordance with a control signal output from the controller 500. In addition, the bias control driver 502 is capable of varying the DC voltage at a preselected timing.

The charge control driver 503 is connected to the charger 203 for applying a bias to the charger 203 and is capable of varying the bias at a preselected timing in accordance with a control signal output from the controller 500.

FIG. 11 shows the results of experiments conducted with the color copier described above in order to estimate the omission of the trailing edge of an image and granularity. In FIG. 11, as for the omission of the trailing edge of an image, rank 5, which is the highest rank, shows that no omission was observed by eye while rank 1, which is the lowest rank, shows that omission was most conspicuous. Likewise, as for granularity, rank 5 shows that no granularity was observed by eye while rank 1 shows that granularity was most conspicuous. Ranks 4 and 5 are considered to be acceptable as to image quality.

As FIG. 11 indicates, Reference 1 using the developing roller 84 of the illustrative embodiment obviated the omission of the trailing edge of an image and reduced granularity more than Comparative Example 1 (conventional). However, when the bias for development was implemented only by a DC component, Reference 1 failed to reduce granularity to rank 4 or above.

When an AC component was superposed on the DC component, granularity was reduced with the omission rank remaining in the acceptable range. As for Example 1 (illustrative embodiment) and Comparative Example 2, the behavior of the developer in the developing zone was observed through a high-speed camera. In Example 1, carrier grains close to the sleeve actively moved due to the rotation of the sleeve and produced spaces between adjoining brush chains, so that toner grains deposited on the carrier grains moved for development.

More specifically, the carrier grains close to the sleeve were disturbed with the result that the toner grains were forcibly shaken off and easily moved under the action of the electric field. At his instant, the toner grains on the carrier grains not only directly moved toward a latent image, but also moved toward the same while hopping on the carrier grains. Moreover, the toner grains close to the sleeve were scraped upward due to the active movement of the carrier grains and also moved toward the latent image. By contrast, in Example 2, such disturbance to the carrier grains was not observed.

In Reference 1 in which AC was not superposed on the bias, disturbance to the carrier grains close to the sleeve was also observed although it was not as conspicuous as in Example 1. This means that when the half width of the main pole P1*b* is reduced, the DC component can disturb the carrier grains to a certain degree and can therefore reduce granularity alone.

In the illustrative embodiment, the auxiliary poles P1*a* and P1*c* adjoin the main pole P1*b*, which is closest to the drum 200, and reduce the half width of the main pole P1*b* to 25° or below, thereby reducing the width of the development nip. Consequently, a period of time over which the magnet brush remains in contact with the drum 200 after forming a granularity-free toner image because of the superposition of AC is reduced. The illustrative embodiment therefore reduces the omission of the training edge of an image and other image defects more than the conventional schemes.

Figure 12:
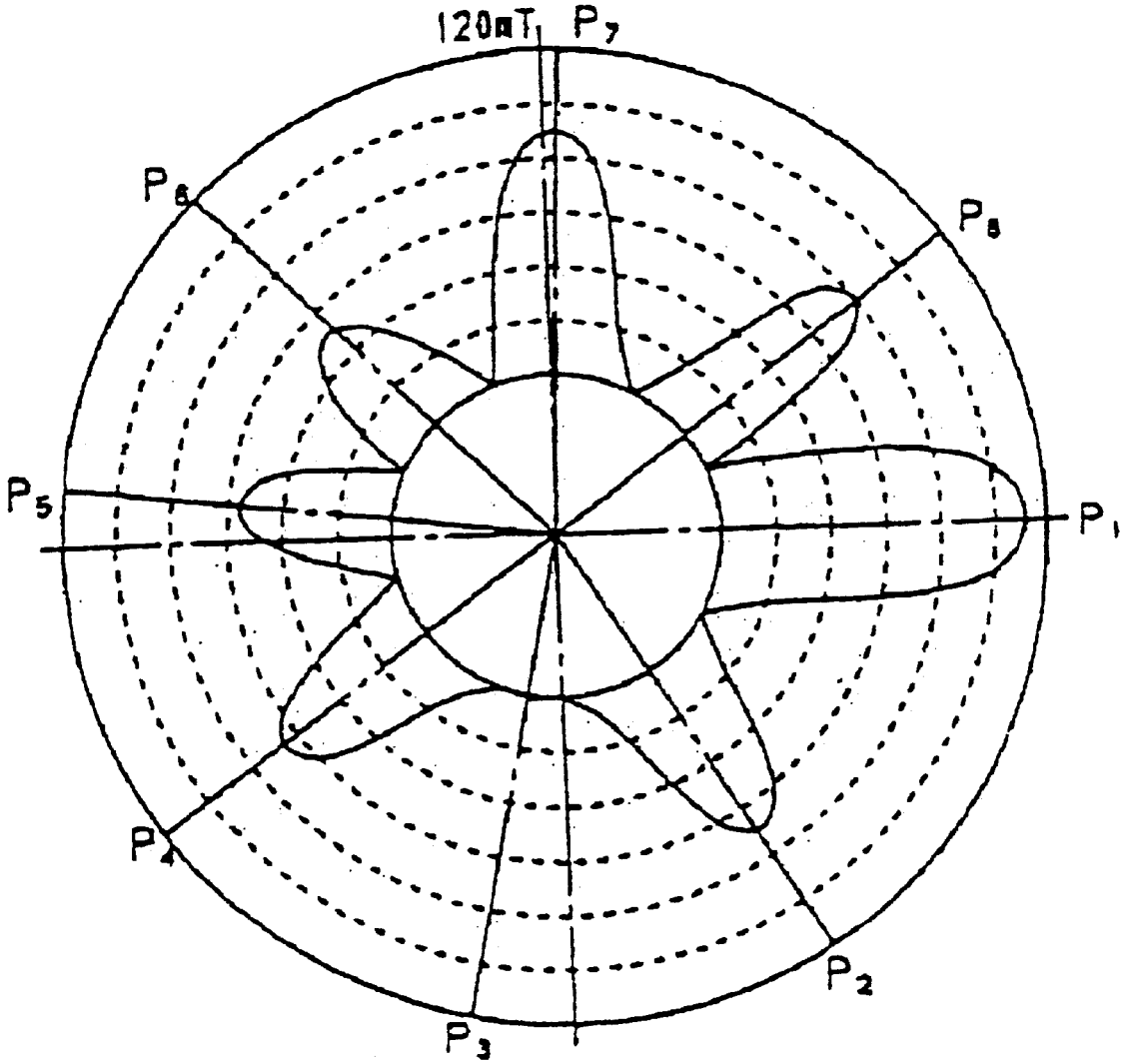
FIG. 12 PRIOR ART
FIG. 12 shows magnetic field distributions particular to a conventional developing roller.

FIG. 12 shows the magnetic force distribution of a conventional developing roller (half width of 48°). As shown, the conventional developing roller causes a developer to form long brush chains thereon and forms a broad development nip. Therefore, a magnet brush remains in contact with a drum over a substantial period of time even just after it has formed a granularity-free toner image derived from the superposition of AC. Consequently, toner grains are removed by physical friction or electrostatically deposited on carrier grains not supporting toner grains, disturbing the uniformly developed toner image. This is presumably why the toner image on the drum moved away from the developing zone is granular.

Experiments were conducted with Example 1 by varying a duty and varying an offset voltage for each duty such that the effective value is −500 V. More specifically, assume that a bias that causes toner grains to move toward the drum is applied to the developing roller over a period of time a, that a bias that causes them to move toward the sleeve is applied to the developing roller over a period of time b, and that the duty ratio is 1/100 (a+B) %. FIG. 13 shows a relation between the duty and the granularity determined under the above conditions.

As FIG. 13 indicates, granularity is acceptable when the oscillation component of the electric field has an asynchronous rectangular wave and when such a wave is so set as to reduce the period of time a.

The magnetic carrier applicable to the illustrative embodiment will be described hereinafter. To produce the magnetic carrier, use is made of grains of iron, chromium, nickel, cobalt or similar metal or a compound or an alloy thereof, e.g., 4-3 iron oxide, γ-secondary iron oxide, chromium dioxide, manganese oxide, ferrite or manganese-copper alloy or similar ferromagnetic or paramagnetic substance. Such grains are processed to have a spherical shape each or coated with styrene resin, vinyl resin, ethyl resin, rosin-modulated resin, acrylic resin, polyamide resin, epoxy resin, polyester resin or similar resin to have a spherical shape each. Alternatively, spherical resin grains in which fine grains of magnetic substance are dispersed may be prepared. In any case, the grains are classified by conventional classifying means.

The carrier grains have the intensity of magnetization of 90 emu/g, preferably 60 emu/g or below, for a magnetic field of 1 K oersted. The carrier grains for forming a magnet brush should preferably be spherical for reducing damage to the drum 200 and should preferably have a mean grain size between 20 μm and 100 μm, more preferably between 25 μm and 50 μm.

As stated above, the illustrative embodiment has various unprecedented advantages, as enumerated below.

(1) The magnetic carrier for forming a magnet brush is disturbed in the developing zone, so that the toner can be efficiently used without increasing the size or cost of the apparatus or bringing about image defects.

(2) The above disturbance is implemented by the configuration and arrangement of magnetic field generating means, so that granularity is reduced without increasing cost.

(3) The disturbance is implemented by the auxiliary poles helping the main pole form a magnetic force. It is therefore possible to reduce granularity with a simple construction without increasing cost and to accurately obviate the omission of the trailing edge of an image.

(4) The disturbance is implemented by the application of an alternating electric field, so that granularity is reduced.

(5) The oscillation component of the electric field has an asynchronous rectangular wave, and such a wave is so set as to reduce the period of time over which the toner moves toward the image carrier. This further reduces granularity.

(6) The half width of the main pole is reduced in order to reduce granularity and to obviate the omission of the trailing edge of an image at the same time.

(7) The auxiliary electrode are used to reduce the half width of the main pole, so that a simple arrangement successfully reduces granularity and obviates the omission of the trailing edge of an image at the same time.

(8) The metering member is formed at least of a magnetic substance and can therefore uniform the height of the magnet brush for thereby insuring uniform development.

(9) The carrier grains have the intensity of magnetization of 90 emu/g, preferably 60 emu/g or below, for a magnetic field of 1 K oersted, so that uniform development is insured.

(10) The carrier grains are spherical for reducing damage to the image carrier and have a mean grain size between 20 $\mu$m and 100 $\mu$m, more preferably between 25 $\mu$m and 50 $\mu$m, so that damage to the image carrier is reduced.

(11) The ratio of the developer carrier to the image carrier in linear velocity is lower than 4 and close to 1.05. This insures uniform, stable feed of toner to a latent image for thereby realizing high image quality.

An alternative embodiment of the present invention will be described with reference to FIGS. 14 through 31C. First, a developing device 310 included in the illustrative embodiment will be described with reference to FIG. 14. As shown, a charger 301 adjoins a photoconductive drum 300 for uniformly charging the surface of the drum 300. The drum 300 is rotatable counterclockwise, as indicated by an arrow in FIG. 14. A sleeve 311*c* for development faces the drum 300 while forming a preselected development gap GP between it and the drum 300.

A casing 315 stores a developer made up of toner and magnetic carrier. Screws or agitators 312 and 313 convey the developer to the sleeve 311*c* while agitating it. A toner storing section or toner replenishing means 316 is positioned above the casing 315. Fresh toner is replenished from the toner storing section 316 to the casing 315 by an amount corresponding to the amount of toner consumed.

A laser beam Lb is incident to the charged surface of the drum 300 at a position downstream of the charger 301 in the direction of rotation 300R of the drum 300. By scanning the drum 300, the laser beam Lb forms a latent image L on the drum 300. When the latent image L on the drum 300 arrives at a position where the drum 300 faces the sleeve 311*c*, charged toner is transferred from the sleeve 311*c* to the latent image L for thereby forming a corresponding toner image.

Figure 14:
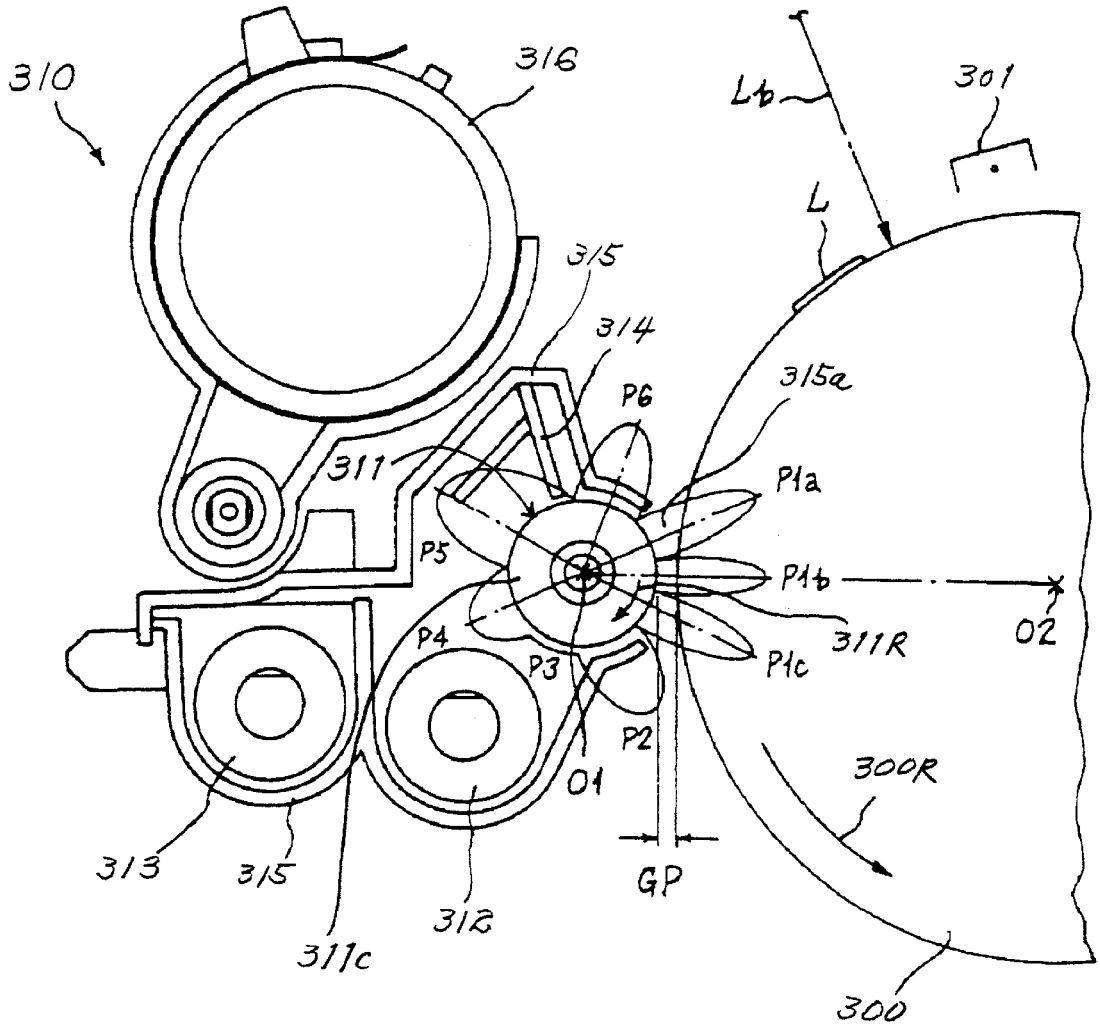
FIG. 14 is a front view showing the basic construction of a developing device representative of an alternative embodiment of the present invention.

A doctor blade or metering member 314 is positioned upstream of the position where the drum 300 and sleeve 311*c* face each other in the direction of developer conveyance 311R (clockwise in FIG. 14 ). The doctor blade 314 regulates the thickness of the developer layer being conveyed by the sleeve 311*c*. A doctor blade has customarily been implemented as a plate formed only of a nonmagnetic material. In the illustrative embodiment, the doctor blade 314 is implemented as a plate formed of a magnetic material and adhered to a conventional nonmagnetic plate. The magnetic material allows a magnet brush with uniform height to be easily formed, as will be described in detail later.

In FIG. 14, there are not shown a device for transferring the toner image from the drum 300 to a sheet, a device for cleaning the drum 300, and a discharger for discharging the cleaned surface of the drum 300.

In operation, a cyan toner image, for example, is transferred from the drum 300 to an intermediate image transfer belt. Subsequently, a magenta toner image, a yellow toner image and a black toner image are sequentially transferred from the drum 300 to the belt over the cyan toner image, completing a full-color image on the belt. The full-color image is transferred from the belt to a sheet fed from a sheet tray not shown. After the sheet with the toner image has been separated from the belt, the toner image is fixed on the sheet by a fixing unit not shown. The toner left on the drum 300 after the image transfer is removed and collected by a cleaning device. Subsequently, the cleaned surface of the drum 300 is initialized by a quenching lamp and prepared for the next image forming cycle thereby.

Figure 15:
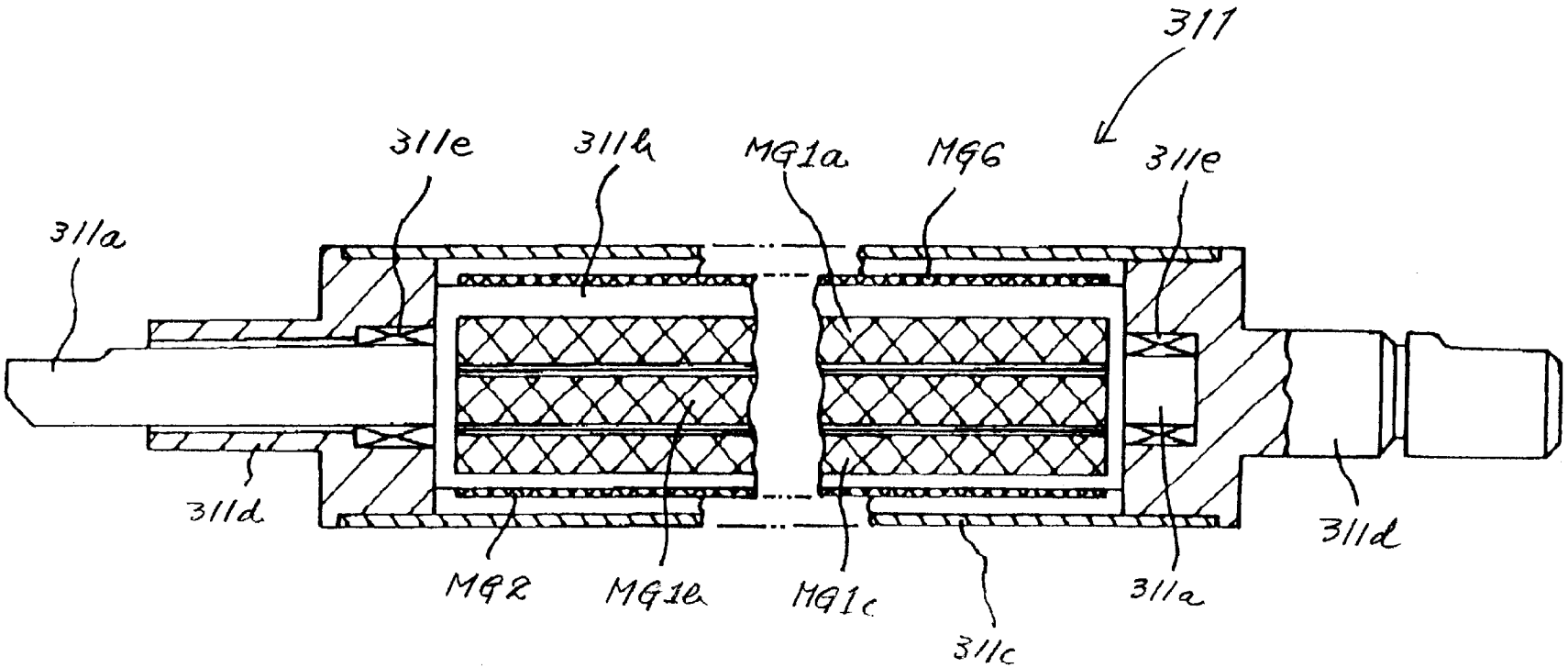
FIG. 15 is a section showing a developing sleeve included in the illustrative embodiment.

Forming part of a developing roller 311, the sleeve 311*c* rotates around stationary magnets disposed thereon. More specifically, as shown in FIG. 15, the developing roller 311 is made up of a shaft 311*a* affixed to the casing 315, a cylindrical magnet support 311*b* formed integrally with the shaft 311*a*, the sleeve 311*c* surrounding the magnet support 311*b*, and a member 311*d* rotatable integrally with the sleeve 311*c*. The member 311*d* is freely rotatable relative to the shaft 311*a* via bearings 311*e*. Drive means, not shown, causes the shaft 311*d* to rotate.

Figure 16:
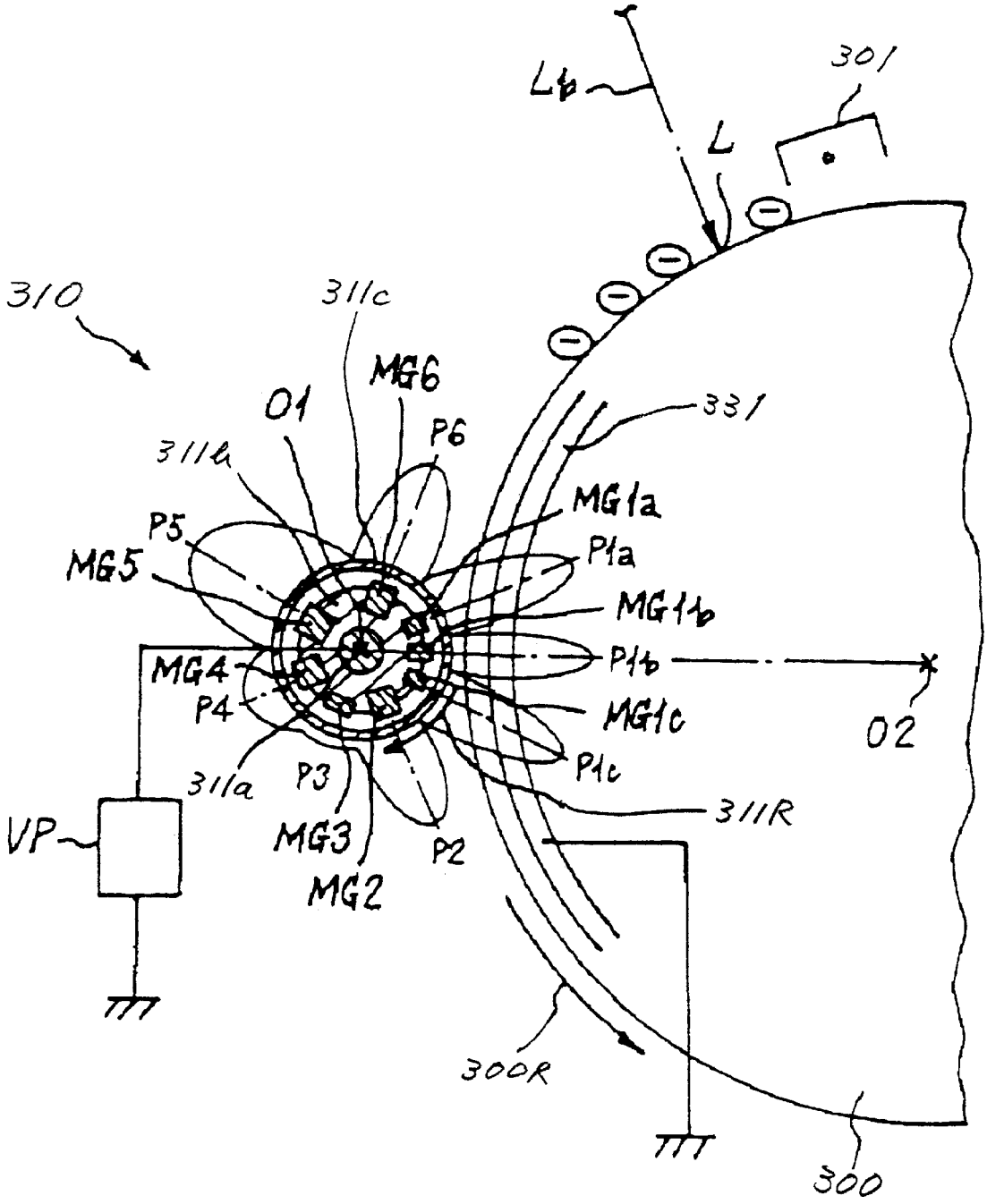
FIG. 16 is a view showing the basic configuration of the developing device of the illustrative embodiment.

As shown in FIG. 16, a plurality of magnets MG1*a*, MG1*b*, MG2, MG3, MG4, MG5 and MG6 (collectively MG hereinafter) are affixed to the circumference of the magnet support 311*b*. The sleeve 311*c* rotates around such magnets MG.

The sleeve 311C is formed of aluminum, brass, stainless steel, conductive resin or similar nonmagnetic material and caused to rotate clockwise, as viewed in FIGS. 14 and 16, around the magnets MS by a mechanism not shown.

The magnets MG form magnetic fields such that the developer forms a magnet brush on the sleeve 311*c* while being conveyed by the sleeve 311*c*. More specifically, the magnetic carrier forms brush chains along the magnetic lines of force issuing from the magnets MG in the normal direction. The charged toner grains deposit on the brush chains, forming a magnet brush.

In the illustrative embodiment in which the drum 300 and sleeve 311*c* both are cylindrical, the gap between the sleeve 311*c* and the drum 300 sequentially increases toward both sides of the position where they are closest to each other. Even when the drum 300 is replaced with a flat belt, there exists a position where the belt is closest to the sleeve 311*c*. In the configuration shown in FIGS. 14 and 15, the sleeve 311*c* and drum 300 are closest to each other on a line connecting the center O1 of the former and the center O2 of the latter (closest position hereinafter). on a line connecting the center O1 of the former and the center O2 of the latter (closest position hereinafter)

As shown in FIG. 16, the second magnets MG1*a*, first magnets MG1*b* and MG1*c* and magnets MG2 through MG6 respectively form magnetic force distributions P1*a*, P1*b* and P1*c* and P2 through P6. The magnet MG1*b* (distribution P1*b*) corresponds to the closest position. The magnets MG1*a*

(distribution P1*a*) and MG1*c* (distribution P1*c*) are respectively positioned upstream and downstream of the magnet MG1*b* in the direction of rotation of the sleeve 311*c*. The magnets MG3 (distribution P3), MG4 (distribution P4), MG5 (distribution P5) and MG6 (distribution P6) are sequentially arranged in this order downstream of the magnet MG1*c* in the direction of rotation 311R of the sleeve 311*c*. The magnets MG1*a,* MG1*b* and MG1*c* are positioned in the developing zone where the sleeve 311*c* and drum 300 face each other.

In the illustrative embodiment, the developing device 310 uses a magnet brush that rises on the sleeve 311C and then falls while being conveyed at least between the magnets MG1*a* and MG1*b*. The magnets MG1*c* and MG6 respectively reduce the half value of the magnet MG1*b* and the half value of the magnet MG1*a* in order to enhance the developing ability.

Figure 17A:
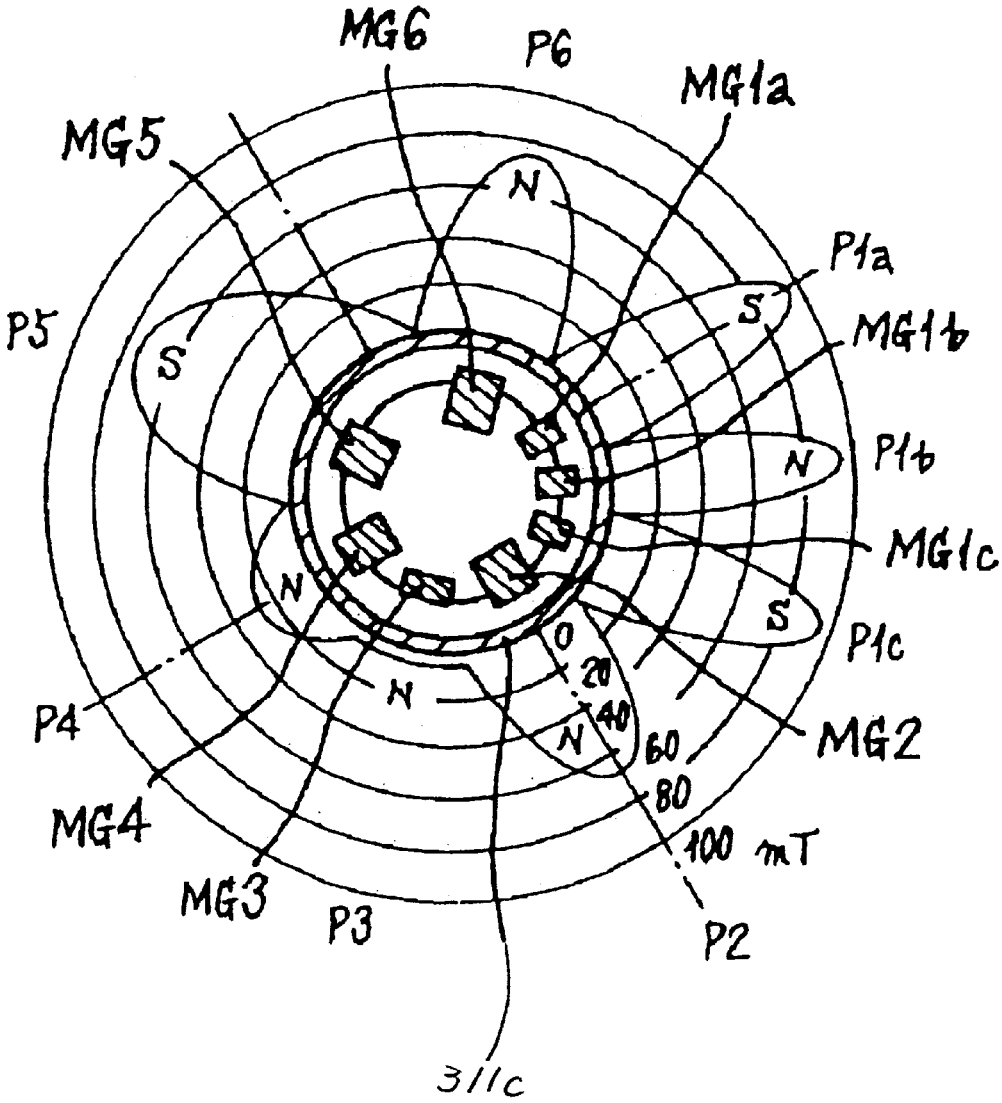
FIG. 17A shows magnetic field distributions together with their sizes.

As shown in FIG. 17A, in the illustrative embodiment, all magnets MG are positioned such that nearby magnets MG reduce the half values of each other's magnetic forces without exception. The reduced half widths of the magnets MG cause the developer to rapidly rise and rapidly fall, so that the magnet brush moves at high speed. This presumably disturbs the configuration of the brush chains to thereby promote the separation of flight of the toner from the carrier. Further, the duration of contact of the developer with the drum 300 is so short, presumably a charge counter to the carrier is induced little.

The magnet MG4 scoops up the developer onto the sleeve 311*c* while the magnet MG3 causes the brush chains to fall down. The magnets MG2, Mg5 and MG6 convey the developer deposited on the sleeve 311*c* to the developing zone. The magnets MG1 through MG6 each are oriented in the radial direction of the sleeve 311*c* as in the previous embodiment.

While the illustrative embodiment includes eight magnets and arranges three of them in the developing zone, four or more magnets may be arranged in the developing zone in order to produce more free toner grains, if desired. Further, additional magnets may be arranged between the magnet MG3 and the doctor blade 314 in order to enhance the ability to follow a black solid image.

The magnets MG1*a,* MG1*b* and MG1*c* are arranged in this order from the upstream side in the direction of rotation 311R of the sleeve 311*c,* and each has a small cross-sectional area. These magnets are formed of an alloy of rare earth metal although it may be formed of a samarium alloy, particularly a samarium-cobalt alloy. A magnet formed of iron-neodymium-boron alloy, which is a typical rare earth metal alloy, has the maximum energy product of 358 kJ/m$^3$ while a magnet formed of iron-neodymium-boron alloy bond has the maximum energy product of 80 kJ/m$^3$. Such a magnet can provide the surface of the developing roller with a required magnetic force even if its size is noticeably reduced, compared to conventional magnets. When the sleeve diameter can be increased in a certain range, a small half width is achievable even with a conventional ferrite magnet or ferrite bond magnet if its end facing the sleeve is narrowed.

As shown in FIG. 17*a,* In the illustrative embodiment, the magnet MG1*b,* MG2, MG3 and MG6 are an N pole each while the magnets MGa, MG1*c* and MG5 are an S pole each.

The main magnet MG1*b,* for example, was implemented as a magnet exerting a magnetic force of 85 mT or above on the developing roller in the normal direction. It was experimentally found that a magnet with a magnetic force of, e.g., 60 mT obviated carrier deposition or similar image defect. The magnets MG1*a,* MG1*b* and MG1*c* were 2 mm wide each, providing the main pole P1*b* with a half width of 16°. When the width of the magnets was further reduced, the half width of the main pole P1*b* was further reduced. For example, when the width of the magnets were 1.6 mm, the half width of the main pole P1*b* was as small as 12°.

Figure 17B:
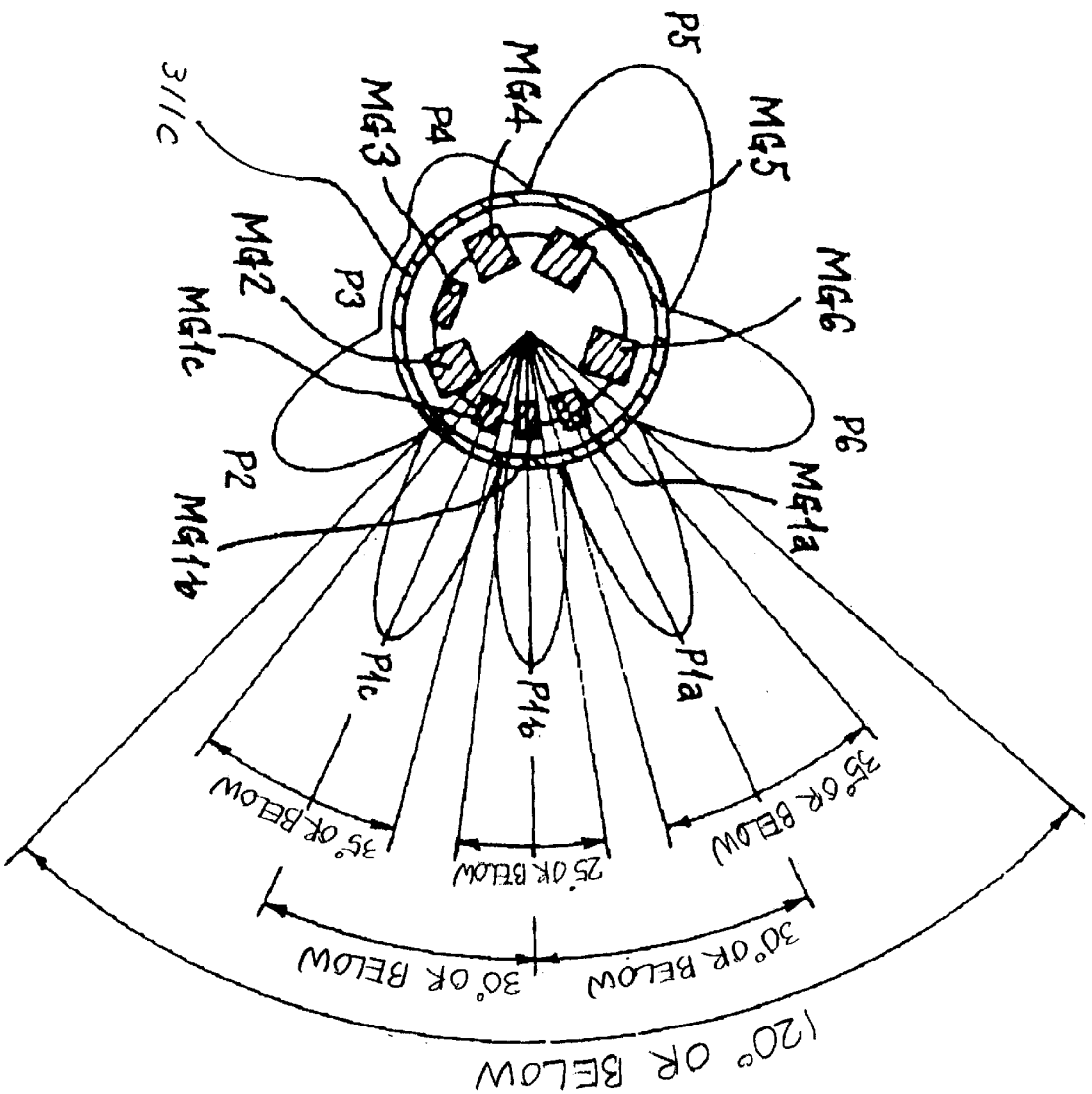
FIG. 17B shows a positional relation between magnets.

FIG. 17B shows a positional relation between the main pole P1*b* and the auxiliary poles P1*a* and P1*c*. As shown, the auxiliary magnets P1*a* and P1*c* each are provided with a half width of 35° or below. The half width of the auxiliary magnet P1*a* or P1*c* cannot be made as small as the half width of the main pole P1*b* because the magnet P2 or P6 positioned outside of the magnet P1*a* or P1*c* has a large half width. The angle between the main magnet P1*b* and the auxiliary magnet P1*a* or P1*c* is selected to be 30° or below although it is 22° in the above specific case that provides the main pole P1*b* with the half angle of 16°. Further, an angle between the polarity transition point between the auxiliary magnet P1*a* and the magnet P6 and the polarity transition point between the auxiliary magnet P1*c* and the magnet P2 is selected to be 120°.

As shown in FIG. 16, a bias power supply VP connected to ground is connected to the fixed shaft 311*a*. A bias voltage applied from the power supply VP to the shaft 311*a* is routed through the bearings 311*e* and rotatable member 311*d,* FIG. 15, to the sleeve 311*c*. A conductive support 331 forming the lowermost layer of the drum 300 is connected to ground. In this condition, a magnetic field causes the toner parted from the magnetic carrier to move toward the drum 300.

While the illustrative embodiment uses so-called negative-to-positive development or reversal development, the polarity of the charge to be deposited on the drum 300 by the charger 301 is open to choice.

The sleeve 311*c* carrying the developer layer thereon is rotated relative to the stationary magnets MG, so that a velocity difference is provided between the former and the latter. The velocity difference causes the developer to form the magnet brush at least in the developing zone while flowing itself. At this instant, free toner grains parted from the carrier grains deposit on the latent image L formed on the drum 300.

As for the speed difference, an arrangement may be made such that the magnets MG rotate relative to the sleeve 311*c* held stationary, if desired. Further, the sleeve 311*c* and magnets MG may be rotated in opposite directions to each other.

The development gap GP between the drum 300 and the sleeve 311*c* depends on the type of configuration in which the tips of the magnet brush contact or do not contact the drum 300 or whether or not, without regard to the type, the position where the magnet brush rises at the position where the drum 300 and sleeve 311*c* are closest to each other. A particular gap should only be used for each specific condition.

The screw 312 is positioned at the side opposite to the drum 300 with respect to the drum 300 and scoops up the developer stored in the casing 315 to the sleeve 311*c* while agitating it. The developer in the casing 315 is made up of toner grains T and magnetic carrier grains CC to thereby frictionally charge the toner grains T. The amount of charge deposited on the toner grains T by friction is between −5 $\mu$C/g and −60 $\mu$C/g, preferably between −10 $\mu$C/g and 30 $\mu$C/g.

The carrier grains CC may be formed of iron, nickel, cobalt or similar metal or an alloy of such metal and another metal, magnetite, γ-hematite, chromium dioxide, copper-zinc-ferrite, manganese-zinc-ferrite or similar oxide, manganese-copper-aluminum or similar alloy or similar ferromagnetic substance. The grains of such a ferromagnetic substance may be coated with styrene-acrylic resin, silicone resin, fluorocarbon resin or similar resin; any one of such resins may be selected in consideration of the chargeability of the toner grains T. Alternatively, use may be made of styrene-acrylic resin or polyester resin containing magnetic grains.

The saturation magnetization of the ferromagnetic substance should preferably be between 45 emu/g and 85 emu/g. If the saturation magnetization is lower than 45 emu/g, then the grains cannot be efficiently conveyed while the deposition of the carrier grains on the drum 300 is aggravated. Saturation magnetization above 85 emu/g intensifies the magnet brush and therefore a scavenging force with the result that scavenging marks appear in halftone image portions.

The toner T contains at least thermoplastic resin and a copper phthalocyanine, quinacridone, bis-azo or similar pigment. The resin should preferably be styrene-acrylic resin or polyester resin. The toner T may additionally contain polypropylene or similar was for promoting fixation and alloy-containing dye for controlling toner charge. Further, silica, alumina, titanium oxide or similar oxide, nitride or carbonate may be applied to the surfaces of the toner grains T, and so maybe done a fatty acid metal salt or fine grains of resin.

The sleeve 311*c* in rotation conveys the developer deposited thereon via the magnetic force distributions P1*a* through P6 formed by the magnets MG. At this instant, the carrier grains on the sleeve 311*c* rise in the form of brush chains and then fall down. The brush chains extend along the magnetic lines of force in the normal direction.

Reference will be made to FIGS. 18A through 18G for describing the behavior of the developer, paying attention to one of the magnetic force distributions P1*a* through P6. FIGS. 18A through 18G show magnetic lines of force (1) through (7) formed in the normal direction in the magnetic force distribution P1*a* by way of example. As shown, the magnetic line of force (1) extend substantially tangentially to the sleeve 311*c* while the magnetic lines of force (2) and (3) sequentially rise in this order. The magnetic line of force (4) extends substantially perpendicularly to the sleeve 311*c,* i.e., rises higher than the others. The magnetic lines of force (5) through (7) are symmetrical to the magnetic lines of force (3) through (1) with respect to the magnetic line of force (4), i.e., the lines (5) through (7) sequentially fall down in this order. The magnetic line of force (7) is substantially tangential to the sleeve 311*c*. The magnetic line of force (4) is coincident with the line connecting the centers O1 and O2 shown in FIG. 14.

The developer is deposited on the sleeve 311*c* in the form of a layer although not shown in FIGS. 18A through 18G for simplicity. Also, the carrier grains, labeled CC, electrostatically retain the toner grains T although not shown for simplicity.

Figure 18A:
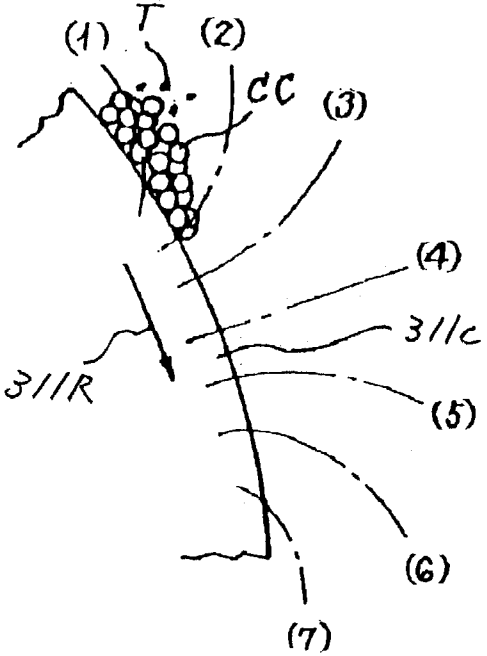
FIGS. 18A through 18G demonstrate the displacement of a brush chain and the production of free toner grains.

As shown in FIG. 18A, the developer layer on the sleeve 311*c* arrives at the magnetic force distribution P1*a,* the carrier grains CC start rising along the magnetic line of force (1) away from the developer layer in the form of a brush chain. The brush chain faces the magnet MG1*a* in the axial direction of the sleeve 311*c,* which is perpendicular to the sheet surface of FIG. 18A. When the carrier grains so rise along the magnetic line of force (1), the toner grains are separated from the carrier grains CC and released to a space around the tip of the brush chain as free toner grains T. At the same time, the condition of the developer forming the layer varies due to the rise of the brush chain, so that the toner grains are released from the developer layer also as free toner grains T. How the free toner grains T are formed will be described more specifically later.

It is to be noted that the toner grains are released from the developer layer between nearby brush chains as free toner grains T also and contribute to development.

It was experimentally found that the free toner grains T were formed and caused to fly toward the image portion (latent image L) of the drum 300 when facing the image portion, but were not formed when facing the non-image portion of the drum 300.

Figure 18B:
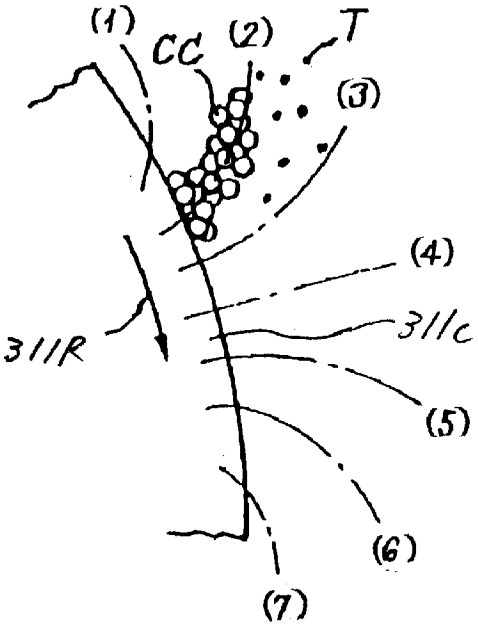

As shown in FIG. 18B, when the brush chain started rise at the position shown in FIG. 18A meets the magnetic line of force (2), the brush chain changes its shape and position along the line (2). At this instant, other toner grains T are separated from the carrier grains CC and released to the rising side of the brush chain (upstream side in the direction of rotation 311R) as free toner grains T.

Figure 18C:
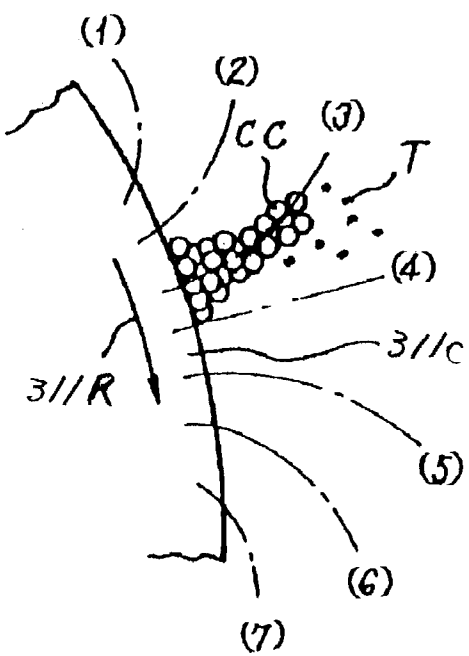

As shown in FIG. 18C, when the brush chain further moves from the position shown in FIG. 18B, the brush chain meets the magnetic line of force (3) and changes its shape and position along the line (2). At this instant, other toner grains T are separated from the carrier grains CC and released to the rising side of the brush chain (upstream side in the direction of rotation 311R) as free toner grains T.

Figure 18D:
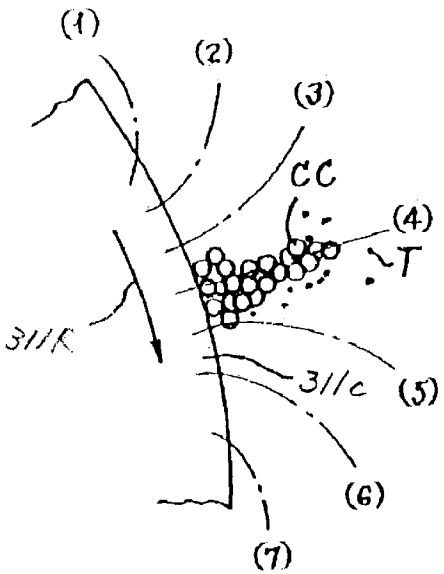

As shown in FIG. 18D, when the brush chain further moves from the position shown in FIG. 18C until it meets the magnetic line of force (4), the brush chain changes its shape and position along the line (4), i.e., rises most substantially perpendicularly to the surface of the sleeve 311C. At this instant, other toner grains are released from the carrier grains CC and released to a space around the tip of the brush chain as free toner grains T.

Figure 18E:
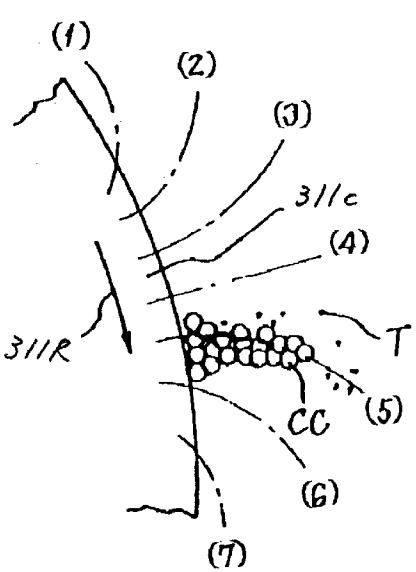

As shown in FIG. 18E, when the brush chain further moves from the position shown in FIG. 18D, the brush chain meets the magnetic line of force (5) positioned downstream of the magnetic line of force (4) in the direction of rotation 311R. Because the magnetic line of force (5) falls little by little as the distance from the sleeve 311C increases, the magnetic line of force falls accordingly. At this instant, other toner grains are separated from the carrier grains CC and released to the side opposite to the side where the brush chain falls (upstream side in the direction 311R) as free toner grains T.

Figure 18F:
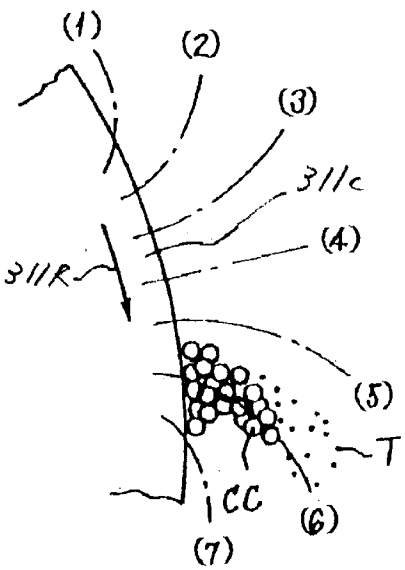

As shown in FIG. 18F, when the brush chain further moves from the position shown in FIG. 18E, the brush chain meets the magnetic line of force (6) falling more than the line (5) and changes its shape and position along the line (6). At this instant, other toner grains are separated from the carrier grains CC and released to the side opposite to the side where the brush chain falls (downstream side in the direction 311R) and a space around the tip of the brush chain as free toner grains T.

Figure 18G:
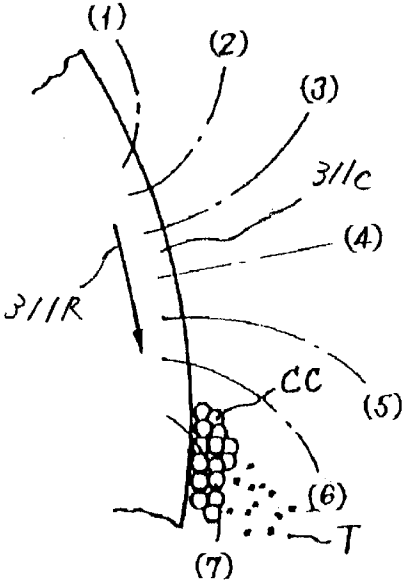

As shown in FIG. 18G, when the brush chain further moves from the position shown in FIG. 18F, the brush chain meets the magnetic line of force (7) falling even more than the line (6) and changes its shape and position along the line (7). At this instant, other toner grains are separated from the carrier grains CC and released to a space at the side where the brush chain falls as free toner grains T.

When the brush chain further moves from the position shown in FIG. 18G, the brush chain joins the developer layer present on the sleeve 311*c,* although not shown specifically. As a result, toner grains are released from the carrier grains of the developer layer also and form free toner grains.

It is to be noted that, in practice, consecutive brush chains are formed along the magnetic lines of force (1) through (7)

at the same time and sequentially move in accordance with the rotation of the sleeve 311*c* while releasing toner grains. In FIGS. 18A through 18G, the brush chains formed along the consecutive magnetic lines of force (1) through (7) form a magnet brush in combination.

Let a region around the sleeve 311*c* where each brush chain rises and then falls be referred to as a brush chain forming region. More specifically, the region where each brush chain rises and then falls refers to a position where a brush chain rises from the developer layer on the sleeve 311*c* due to the force of the magnet MG to a position where the tip of the brush chain again joins the developer layer. Toner grains are released from the carrier grains mainly between such two positions in accordance with the shape and position of the brush chain. Stated another way, brush chains formed along a number of magnetic lines of force at each magnetic force distribution are referred to as a magnet brush; the brush chain forming portion refers to a region around the sleeve 311*c* where such brush chains exist. The toner grains released from the carrier grains of the magnet brush in the brush chain forming portion are used for development.

While the above description has concentrated on the magnetic force distribution P1*a,* it similarly applies to the magnetic force distributions P1*b* and P1*c* as well.

A large amount of free toner grains are produced in accordance with the shape and position of each brush chain and exist around the magnet brush. Development using such a large amount of free toner is more efficient than conventional development that directly transfers toner grains from carrier grains to a latent image.

The developing device of the illustrative embodiment executes a developing method that sets a developing zone broader than conventional, as will be described hereinafter. The broader developing zone allows a larger amount of toner to be fed without resorting to an increase in the linear velocity ration Vs/Vp of the sleeve 311*c* to the drum 300.

The developing method of the illustrative embodiment is characterized in that at least two brush chain forming portions are formed in the region where the drum 300 and sleeve 311*c* face each other. The sleeve 311*c* has a smaller diameter than the drum 300, so that the maximum facing region is "diameter×Axial length" of the sleeve 311*c,* i.e., the projected area of the sleeve 311*c.*

However, as shown in FIG. 14, the casing 315 surrounds the sleeve 311*c.* The opening 315*a* of the casing 315 corresponds only to a necessary portion of the maximum facing region that does not obstruct the flight of toner grains from the sleeve 311*c* toward the drum 300. The sleeve 311*c* and drum 300 directly face each other via such an opening.

In the illustrative embodiment, for preventing toner grains from being scattered and for other purposes, the opening 315*a* of the casing 315 is sized smaller than the maximum facing region in the direction of a rotation 311R. Therefore, the drum 300 and sleeve 311*c* directly face each other via the opening 315*a* smaller in area than the maximum facing region.

In the illustrative embodiment, the developing zone refers to a zone where the toner grains T fly from the developer toward the drum 300 without regard to whether carrier grains join each other in the form of a magnet brush or whether the developer is present on the sleeve 311*c* in the form of a thin layer.

Hereinafter will be described development to occur in the limited facing region coinciding with the range of the opening 315*a* of the casing 315. Assume that the arrangement of magnets and magnetic field distributions shown in FIGS. 14, 16, 17A and 17B is the basic configuration. Then, when the sleeve 311C rotates in the direction 311R, the developer scooped up by the magnetic field distribution P4 is regulated to a preselected amount by the doctor blade 314. Subsequently, the developer is conveyed to the limited facing region by the magnetic force distribution P6 because the doctor blade 314 precedes a position where the magnetic force distribution P5 falls down.

The magnetic force distributions P1*a,* P1*b* and P1*c* lying in the facing region cause the developer to form a magnet brush. The developer therefore flows in accordance with the rotation of the sleeve 311*c* while forming the magnet brush. In the developing zone forming part of the facing region, toner grains are transferred to the latent image formed on the drum 300. Toner grains left on the sleeve 311*c* after development are substantially entirely removed when brought to the pole P3 and dropped onto the screw 312.

Some examples of the developing method of the illustrative embodiment will be described hereinafter.

Figure 19:
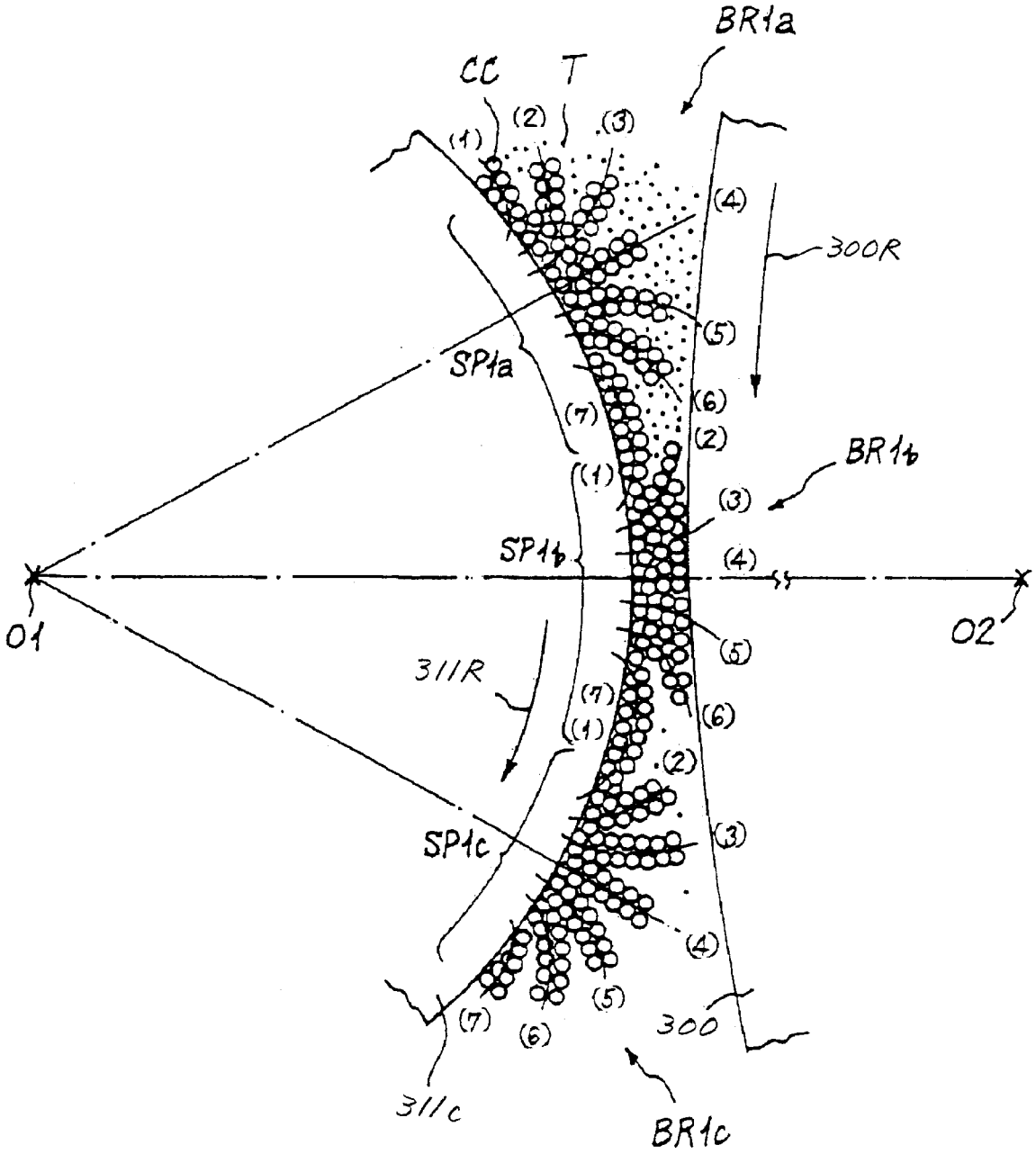
FIG. 19 shows a specific condition wherein a plurality of brush chain forming portions are formed in a facing region.

FIG. 19 shows a first example practicable with the basic configuration shown in FIGS. 14, 15, 16, 17A and 17B. As shown, the magnetic force distributions P1*a,* P1*b* and P1*c* cause the developer to form magnet brushes BR1*a,* Br1*b* and Br1*c,* respectively. The magnet brushes BR1*a* through BR1*c* each are the mass of brush chains formed along the magnetic lines of force (1) through (7) shown in FIGS. 18A and 18B. The spatial range in which the brush chains form a magnet brush is the brush chain forming portion. Three brush chain forming portions where the magnet brushes BR1, BR2 and BR3 are formed are labeled SP1*a,* SP1*b* and SP1*c,* respectively. In FIG. 19, the magnet brush BR1*b* is shown as contacting the drum 300.

The brush chain forming portion SP1*b* is formed by the first magnet MG1*b* (magnetic force distribution P1*b*) closest to the drum 300. The brush chain forming portion SP1*a* is formed by the second magnet MG1*a* (magnetic force distribution P1*a*) positioned upstream of the brush chain forming portion SP1*b* in the direction 311R in which the developer is conveyed.

Free toner grains T are caused to sufficiently deposit on the latent image in the most upstream, brush chain forming portion SP1*a* and the intermediate or closest, brush chain forming portion SP1*b.* Therefore, development is effected little in the brush chain forming portion SP1*c* positioned downstream of the brush chain forming portion SP1*b.* It is to be noted that when an alternating electric field is formed between the sleeve 311*c* and the drum 300, the toner grains oscillate at the position downstream of the brush chain forming portion SP1*b* and therefore deposit on the drum 300R with a potential matched to the latent image.

As for the brush chain forming portion SP1*c,* to reduce the half width of the magnet MG1*b* at the closest position, it is necessary to position the magnet MG1*c* in the vicinity of the magnet MG1*b.* This is why the brush chain forming portion SP1*c* is automatically formed.

The object of the present invention is achievable if the shape or the dimensions of the casing 315 can be varied to form only the brush chain forming portions SP1*a* and SP1*b* in the condition shown in FIG. 19 or to form at least two brush chain forming portions upstream of the closest position within the facing region (second example to be described later).

In the configuration shown in FIGS. 14, 15, 16, 17A, 17B and 19, three magnets MG1*a,* MG1*b* and MG1*c* are arranged in the facing region and combined with the other five magnets MG2 through MG6; three brush forming portions exist in the facing region (case A). In a comparative case B, only a single magnet is positioned at the closest position in place of the three magnets MG1*a* through MG1*c* while five magnets are arranged in the same manner as the magnets MG2 through MG6; only one brush forming portion exists in the facing region. Experiments showed that the case A was superior to the case B as to the ability to follow a black solid image and image quality including granularity and the omission of a trailing edge.

In the above case B, the single magnet located at the closest position had a half width of 21°. The cases A and B were identical as to development gap and the amount of developer to be scooped up.

Figure 20:
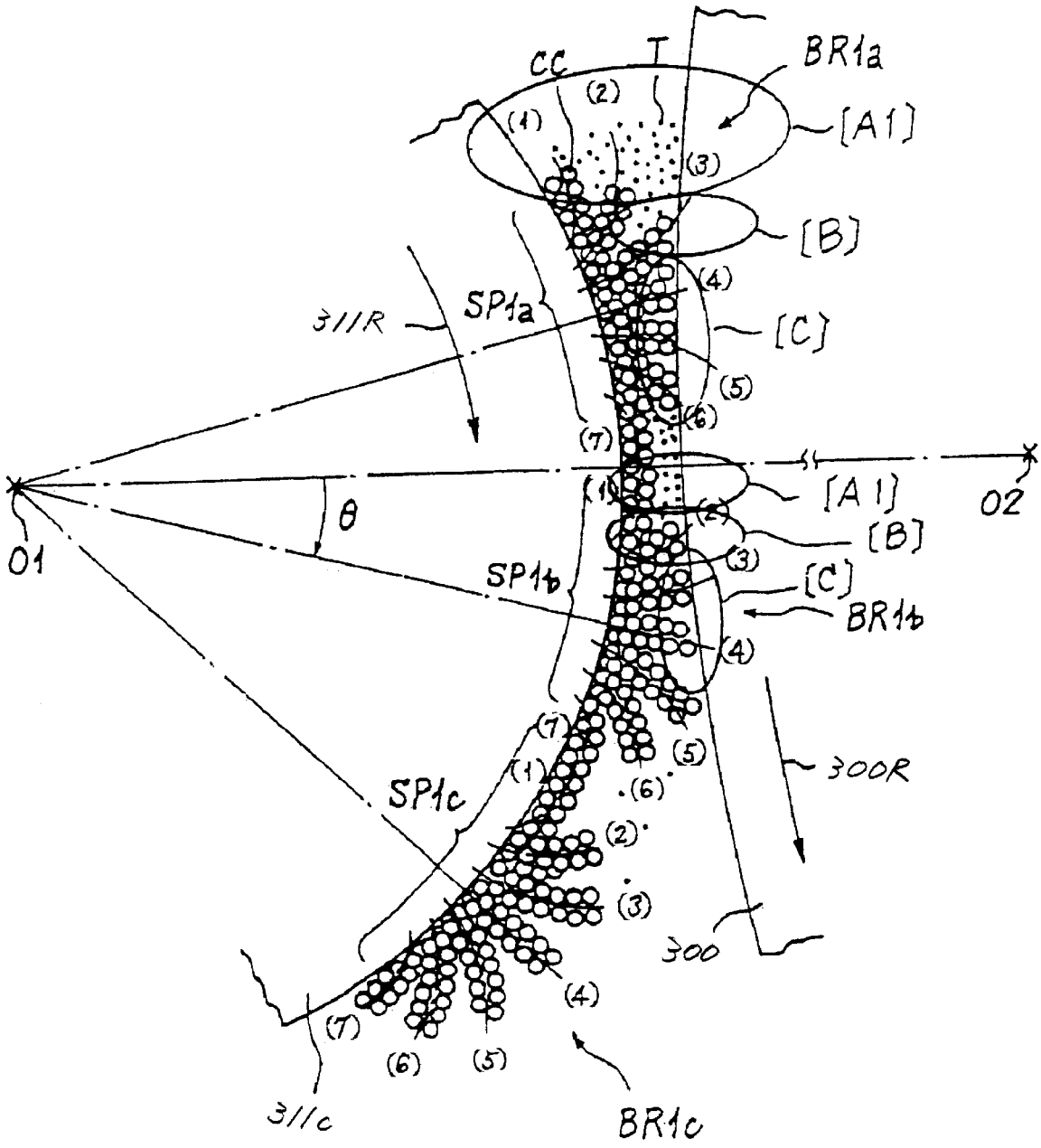
FIG. 20 shows another specific condition wherein a plurality of brush chain forming portions are formed in the facing region.

FIG. 20 shows a second example of the illustrative embodiment. As shown, in the specific configuration described with reference to FIGS. 14 through 17B, the magnetic force distributions P1*a* through P1*c* (magnets MG1*a* through MG1*c*) are angularly shifted in the direction of rotation while the other magnetic force distributions P2 through P6 are arranged in the same manner as in the specific configuration. In this configuration, the center of the first magnet MG1*b* is shifted from the line connecting the centers O1 and O2 to the downstream side in the direction of rotation 311R.

In the arrangement of FIG. 20, the brush chain forming portions SP1*a* through SP1*c* and magnet brushes BR1*a* through BR1*c* are shifted to the downstream side, compared to the basic configuration of FIG. 19. The brush chain forming portions SP1*a* and SP1*b* are respectively positioned at the upstream side and downstream side of the closest position coincident with the line that connects the centers O1 and O2.

In this example, in a space between the position where the magnet brush BR1*a* falls down (downstream of a region C) and a position B where the magnet brush BR1*b* starts rising, the magnet brushes BR1*b* and BR1*a* become closest to the drum 300 together, compared to the first example. It is to be noted that much free toner grains exist in the above space. In this example, a space where the developer is absent exists between the magnet brushes BR1*a* and BR1*b*, compared to the first example. Such a space causes the field strength to be intensified at the tips of the magnet brushes BR1*a* and BR1*b*, so that the field strength derived from the power supply VP is intensified. Consequently, development available with free toner grains released from such magnet brushes is enhanced, so that the object of the present invention is achievable.

Figure 21:
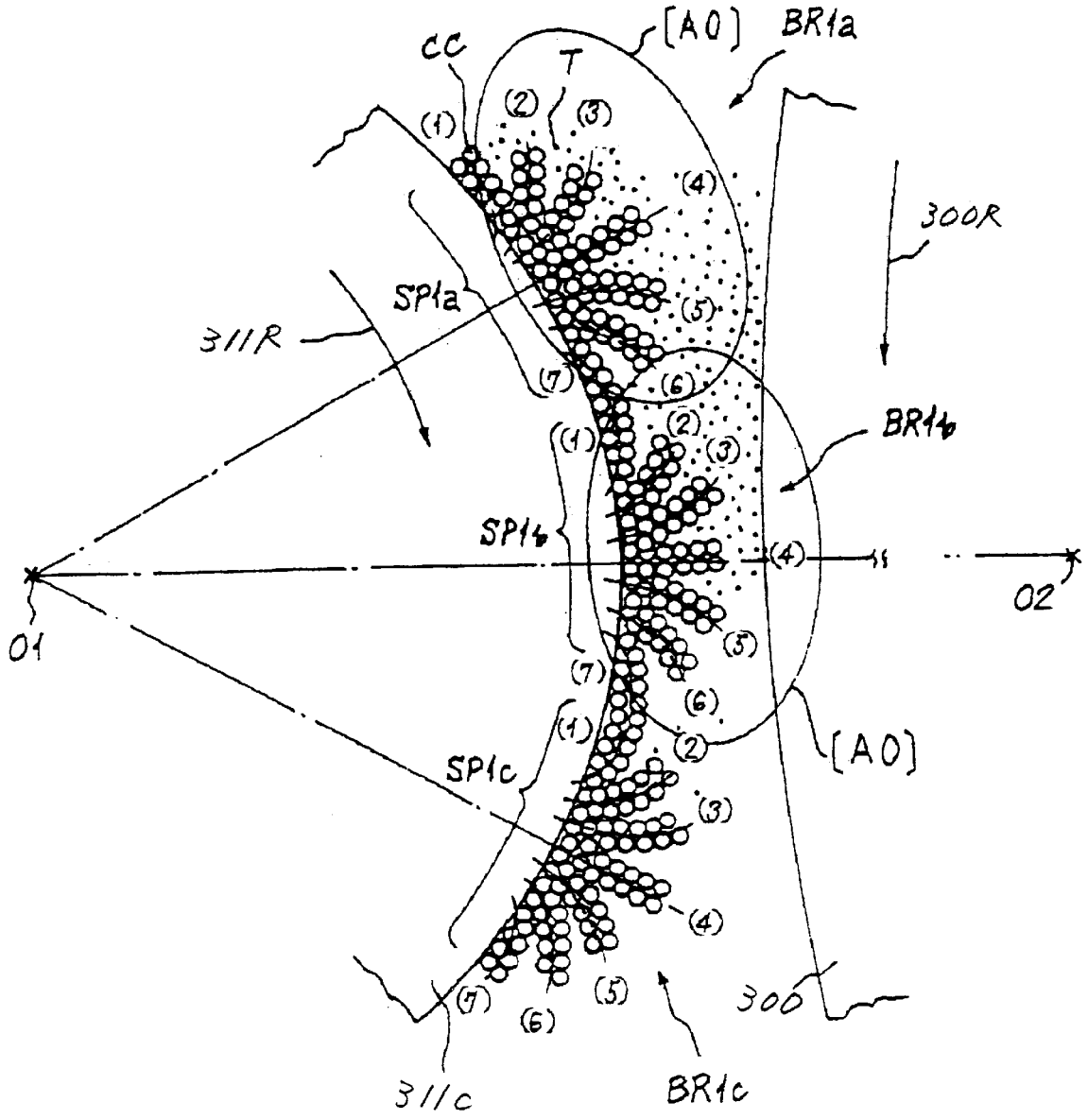
FIG. 21 shows still another specific condition wherein a plurality of brush chain forming portions are formed in the facing region.

FIG. 21 shows a third example of the illustrative embodiment. As shown, this embodiment is identical with the first example except that the development gap is so sized as to maintain the magnet brushes spaced from the drum 300. Specifically, the magnet brush BR1*b* and brush chain forming portion SP1*b* are formed at the closest position coincident with the line connecting the centers O1 and O2. The magnet brush BR1*a* and brush chain forming portion SP1*a* are positioned downstream of the closest position in the direction of developer conveyance. Neither the magnet brush BR1*a* nor the magnet brush BR1*b* contacts the drum 300. This is also successful to achieve the object of the present invention, as will be described more specifically later.

Figure 22:
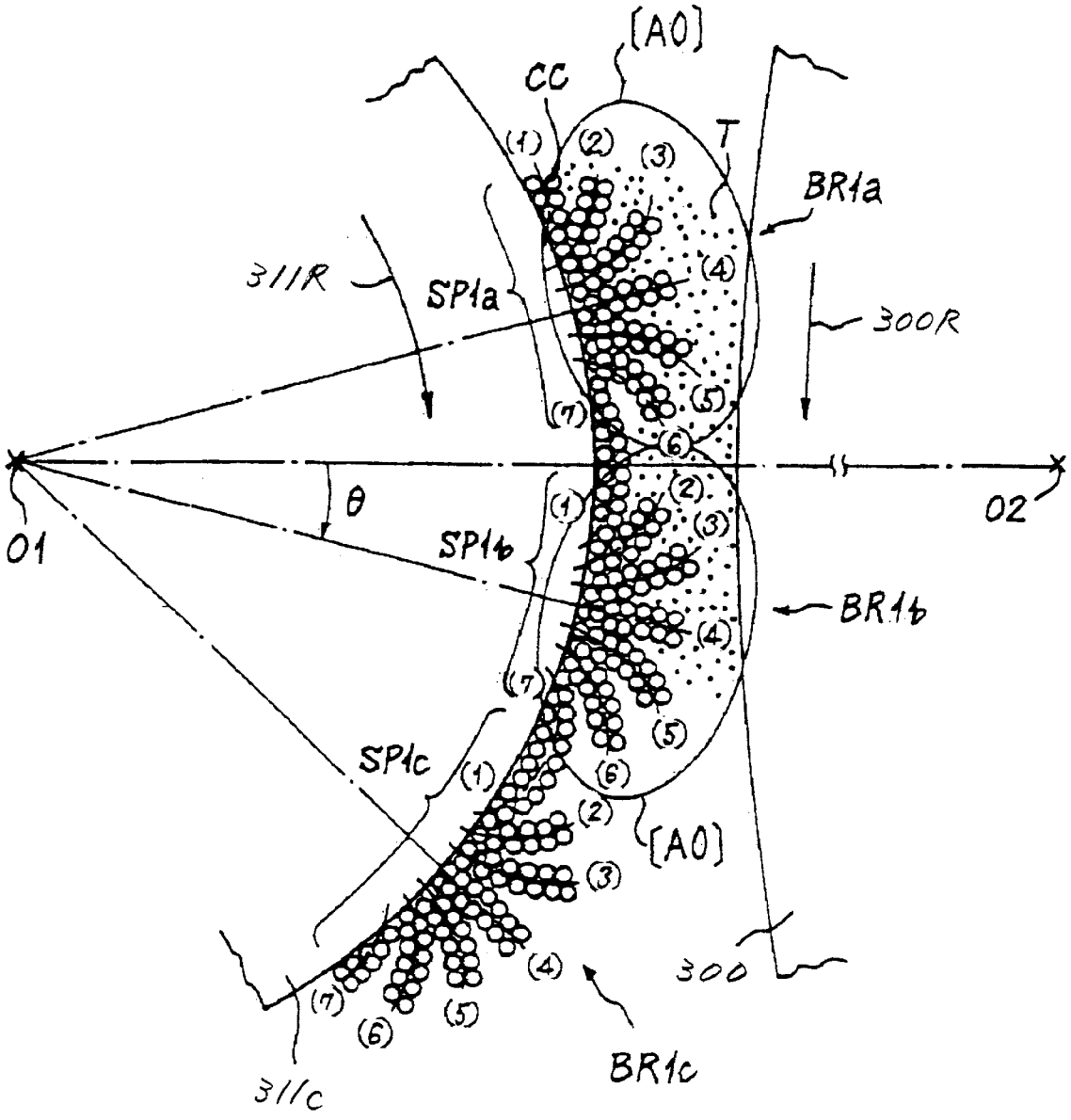
FIG. 22 shows a further specific condition wherein a plurality of brush chain forming portions are formed in the facing region.

FIG. 22 shows a fourth example of the illustrative embodiment similar to the third example except for the following. As shown, the fixed shaft 311*a* is angularly shifted from the basic configuration shown in FIGS. 14 through 17B such that the center of the first magnet MG1*b* is shifted to the downstream side of the line connecting the centers O1 and O2 in the direction of developer conveyance (direction of rotation 311R). Consequently, the brush chain forming portions SP1*a* through SP1*c* and magnet brushes BR1*a* through BR1*c* are shifted to the downstream side, compared to the configuration shown in FIG. 21. The brush forming portions SP1*a* and SP1*b* are respectively positioned at the upstream side and downstream side of the above line in the direction of developer conveyance. In this example, the magnet brushes BR1*b* and BR1*a* do not contact the drum 300. This is also successful to achieve the object of the present invention.

The first to fourth examples described above each format least two brush chain forming portions in the facing region and thereby broaden the developing zone. It follows that a larger amount of toner is transferred to a latent image, insuring high image quality. Further, the first magnet MG1*b* closest to the drum 300 forms the brush chain forming portion SP1*b* while the second magnet MG1*a* upstream of the magnet MG1*b* forms the brush chain forming portion SP1*a*. It is therefore possible to effect efficient development by producing free toner grains in the range where the space between the drum 300 and sleeve 311C decreases little by little toward the closest position.

The developing methods of the first to fourth examples will be described more specifically hereinafter. First, the first example (FIG. 19) and second example (FIG. 20) that cause one of at least two magnet brushes formed in the facing region to contact the drum 300 will be described in detail. This kind of developing method effects development with the free toner grains and effects so-called contact type development with toner grains at the tips of the brush chains rubbing the drum 300. Carrier grains forming the tips. of the brush chains cause the toner grains deposited on the drum 300 to part. The method therefore insures high-quality images with even solid portions, non-image portions substantially free from fog, and sharp thin lines and characters.

As for the configuration shown in FIG. 19, the brush chain forming portion SP1*b* where one magnet brush BR1*b* exists is located at the closest position while the brush chain forming portion SP1*a* where the other magnet brush BR1*a* exists is located upstream of the closest position. The brush chain forming portion SP1*a* is spaced from the drum 300. It is therefore possible to effect efficient development by producing free toner grains in the range where the space between the drum 300 and sleeve 311*c* decreases little by little toward the closest position, as stated earlier. This, coupled with the fact that the magnet brush BR1*b* causes the toner grains deposited on the drum 300 to part, also insures high image quality.

Figure 23:
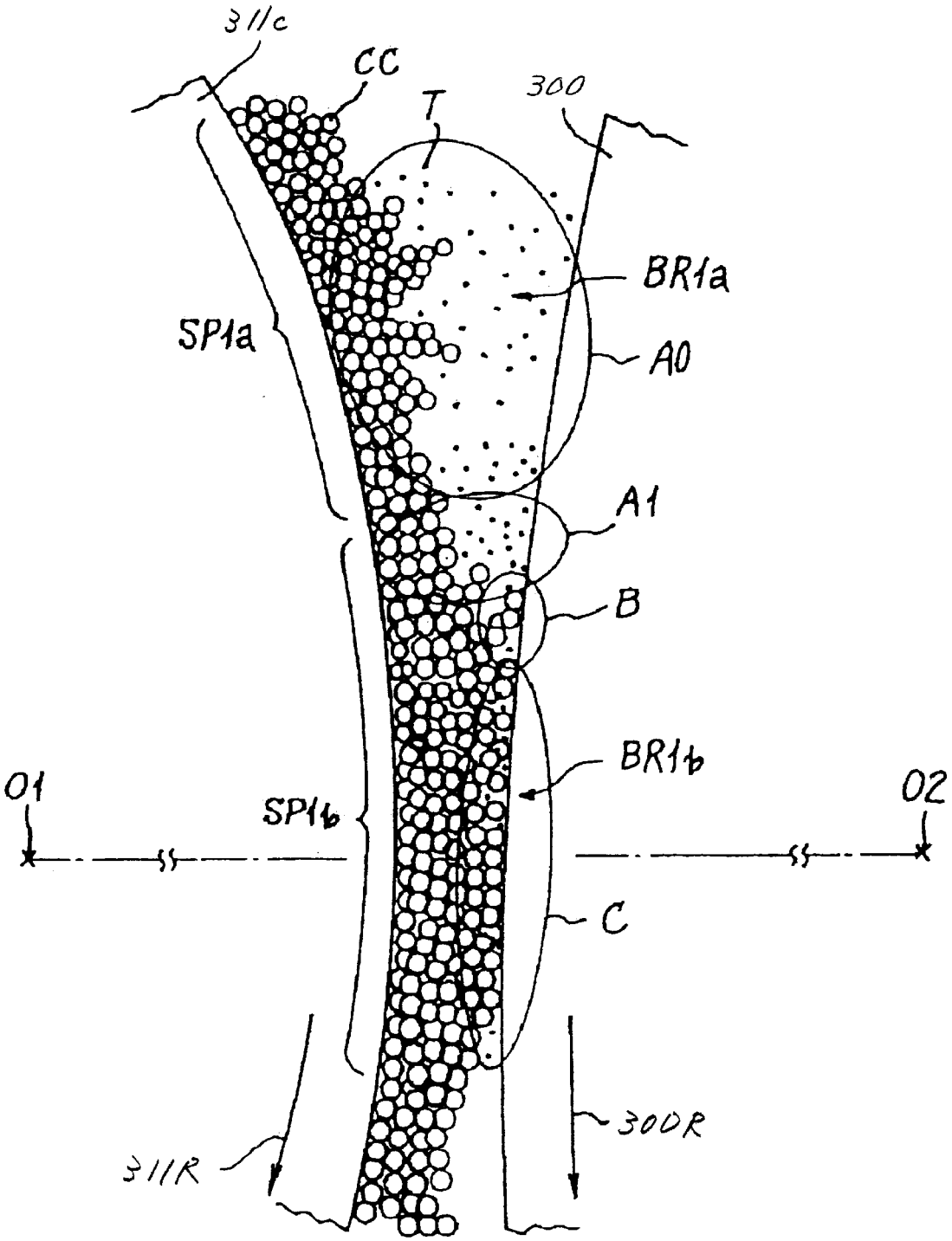
FIGS. 23 through 25 are enlarged views showing one of the brush chain forming portion in detail.

FIG. 23 shows the magnet brushes BR1*a* and BR1*b* shown in FIG. 19 in an enlarged scale. AS shown, the brush chains rise and then fall down in a region AO positioned at the most upstream side of the developing zone, as observed by eye. In the region AO, the magnetic force distribution P1*a* causes the carrier grains of the developer gather to form brush chains while holding the toner grains T, rise along the magnetic lines of force, and then fall down toward the sleeve 311*c*.

In a region A1 downstream of the region A0, the carrier grains CC or brush chains forming the magnet brush BR1*b* start rising. More specifically, the carrier grains CC approached the magnetic force distribution P1*b* gather in the form of brush chains and then rise along the magnetic lines of force of the distribution P1*b*.

In a region B downstream of the region A1, the brush chains contact the drum 300. Further, in a region C downstream of the region B, the brush chains rub the drum 300.

In the first example (FIG. 19), the consecutive regions A0, A1, B and C exist with the region C corresponding to the closest position. In the other examples, when the development gap GP increases to a certain degree, the regions B and C do not exist or the positional relation between the regions A0 through C relative to the closest position changes. Further, the position (region) where the brush chains contact the drum 300 changes because the brush chains do not have the same height and because the magnetic field is not constant. In addition, it is likely that the magnetic characteristic of the carrier grains has a distribution or that the number of carrier grains differs from one brush chain to another brush chain.

Figure 24:
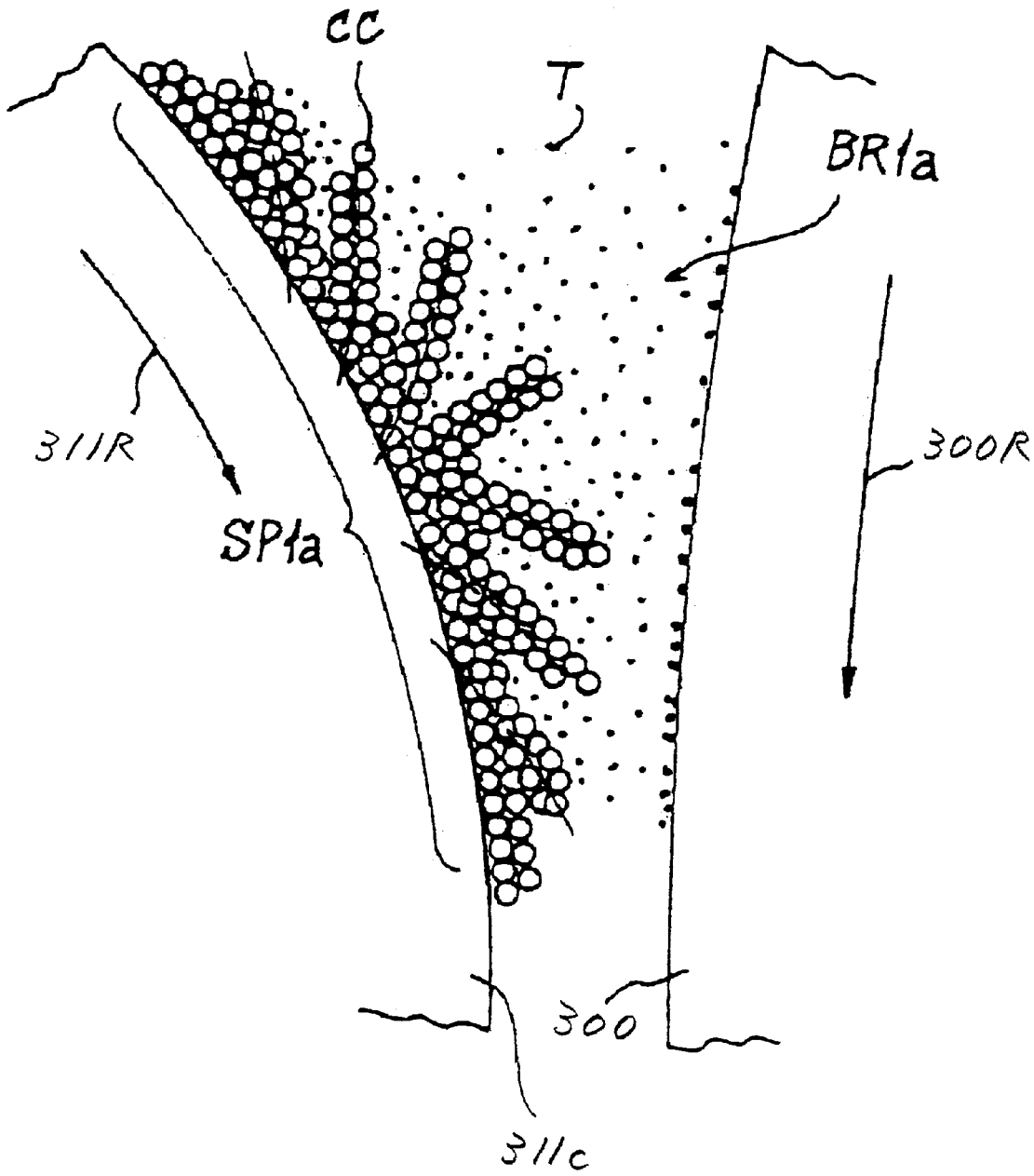

FIG. 24 shows the region A0 in an enlarged scale. As shown, the carrier grains CC form the magnet brush BR1*a* on the portion of the sleeve 311*c* corresponding to the second magnet MG1*a* without regard to the polarity of the magnet MG1*a*. In the portion between the magnets where the brush chains start rising, e.g., between the magnet MG6 and the second magnet MG1*a* or between the second magnet MG1*a* and the magnet MG1*b*, the developer layer is forced against the sleeve 311*c* due to the intense tangential magnetic force.

As shown in FIG. 24, the carrier grains CC confined in the developer layer in a mass exert a magnetic force on each other, so that the magnetic lines of force normal to the sleeve 311*c* are small between the magnets. However, nearby magnets are opposite in polarity to each other and exert a strong magnetic force in the direction tangential to the sleeve 311*c*. This strong magnetic force causes the carrier grains to form a mass in the developer layer that is thinner than on the magnets, thereby maintaining the carrier grains CC in the developer layer.

When the above developer layer arrives at the position corresponding to the magnet P1*a*, some carrier grains CC gather and rise in the form of a brush chain. While the number of carrier grains CC to form a brush chain is generally dependent on the amount of the developer to pass the doctor blade 314, it is dependent on the magnetic property of the carrier grains CC, the size of the magnetic force and the size and gradient of the magnetic lines of force as well.

Moreover, although the magnet P1*a* is fixed in place, the angle and size of the magnetic line of force at the position where the brush chain starts rising varies because the sleeve 311*c* rotates. At this instant, the magnet brush is not immediately formed along the magnetic lines of force due to a delay particular to the magnetic response of the carrier grains CC. In addition, although the mass of carrier grains CC or brush chain rises by overcoming the restraint, the magnetic polarities of all of the carrier grains CC are oriented in the same direction due to the intense magnetic field of the magnet, so that the carrier grains CC repulse each other. AS a result, the developer layer suddenly cracks and causes the carrier grains CC to rise to form a magnet brush.

When the carrier grains CC rise in the form of brush chains, the spaces in which the toner grains T have been confined in the mass of the carrier grains are opened. This, coupled with an intense centrifugal force acting on the toner grains T deposited on the carrier grains CC, causes the toner grains T to part from the carrier grains CC as free toner grains T.

Further, the brush chains do not rise or fall down at a constant speed, but rise or fall down with acceleration because of the variation of the magnetic field. The resulting inertia force acts on the toner grains T and causes them to fly away from carrier grains CC to form free toner grains T. The free toner grains T can be freely moved by, e.g., the electric field for development because they are free from electrostatic and physical adhesion to the carrier grains CC.

Figure 25:
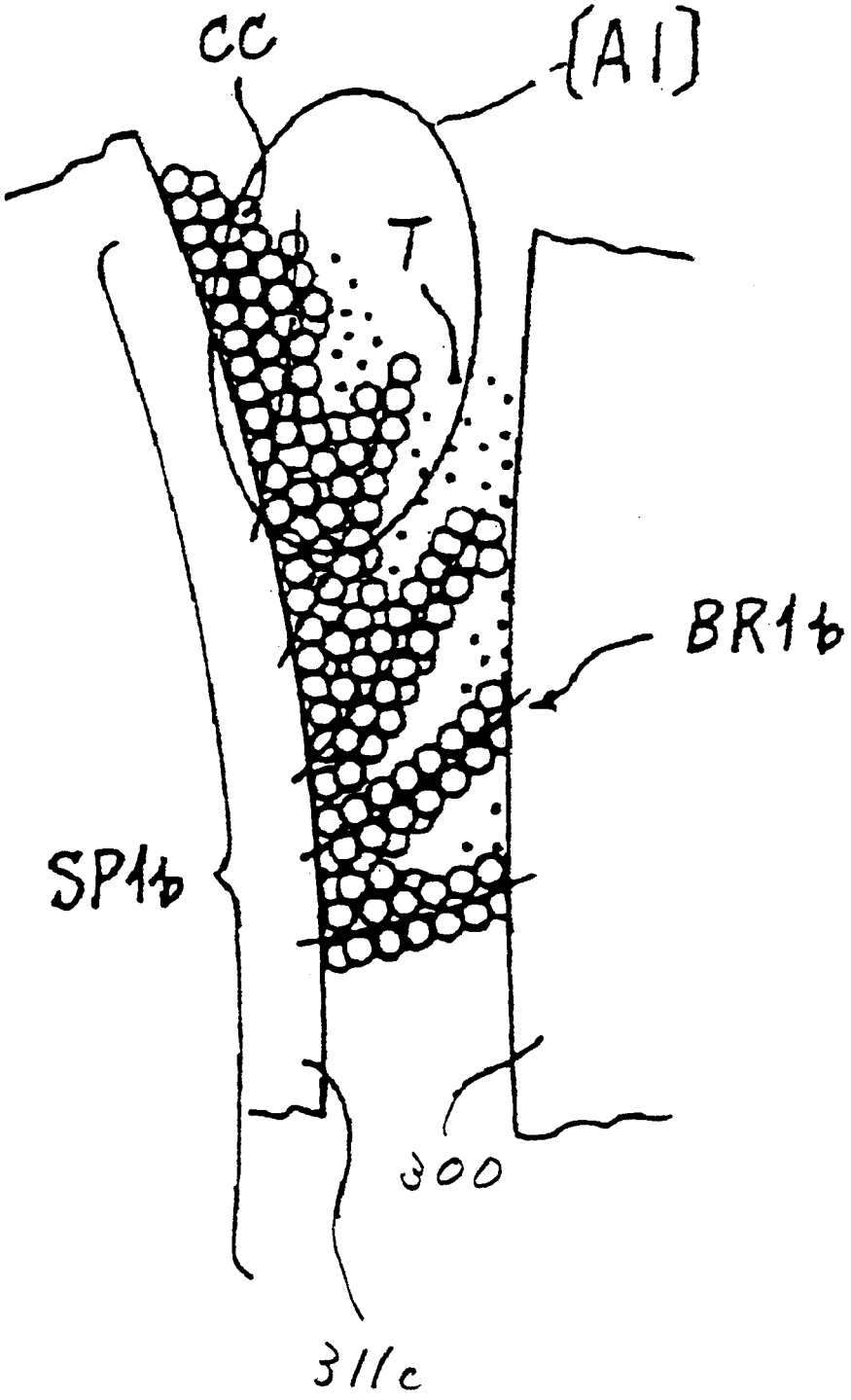

FIG. 25 is an enlarged view showing the region A1 where the brush chains start rising. The free toner grains T can be produced if the force to act on the toner grains T deposited on the carrier grains CC is controlled on the basis of the grain size and other powder characteristics of the carrier grains CC, the intensity of saturation magnetization and other magnetic characteristics, and the intensity of saturation magnetization and other magnetic characteristics of the magnet as well as the width, shape and other shape characteristics of the magnet.

Specifically, as shown in FIG. 25, the free toner grains T appear when brush chains start rising at the upstream portion of the brush chain forming portion SP1*b*, increasing the amount of toner grains to deposit on the latent image L and thereby enhancing development. More specifically, such free toner grains T can deposit on the latent image even in a weak electric field.

I observed the behavior of the carrier grains CC and that of the toner grains T in the regions A0 and A1 described above with a stereoscopic microscope SZH10 available from OLYMPUS OPTICAL CO., LTD. and a high-speed camera FASTCAM-Ultima-I2 available from PHOTRON LTD. at a shooting speed of 40, 500 frames for a second. This is also true with behavior in the regions B and C to be described hereinafter.

The region B will be described with reference to FIG. 26. As shown, in the region B, the brush chains (magnet brush) contact the drum 300 and release the toner grains T from the carrier grains CC in such a manner as to spray them, thereby producing free toner grains. This is because the brush chains strongly contact the drum 300.

The position where the toner grains are sprayed, as stated above, is located at or around the closest position. The distance between the sleeve 311C and the drum 300 is smallest at the closest position and increases little by little with an increase in the distance from the closest position. On the other hand, the brush chain forming portion SP1*b* is formed around the closest position, so that the magnet brush contacts the drum 300 at a position upstream of the closest position for the first time and sprays the toner grains or free toner grains. The position where the free toner grains appear may be slightly shifted from the closest position because of the development gap and the height of the magnet brush. In addition, the position where the brush chains rise may be slightly shifted because of the grain size distribution and magnetic characteristic distribution of the carrier grains. This is why the toner grains are caused to appear at or around the closest position.

The size of the brush chain constituted by the carrier grains in the region B is dependent on the various factors described above. Therefore, in the region B, the brush chains formed on the sleeve 311*c* move at substantially the same speed as the sleeve 311*c* except when they slip on the sleeve 311*c*. For this reason, when the brush chains have height exceeding the distance between the sleeve 311*c* and the drum 300, the tips of the brush chains strongly contact the drum 300 at a speed that is the combination of the speed at which the tips rise along the magnetic lines of force of the magnet MG1*b* and the peripheral speed of the sleeve 311*c*.

More specifically, the distance between the sleeve 311*c* and the drum 300 decreases little by little toward the closest position coincident with the line connecting the centers 01 and 02, as stated earlier. Therefore, when the height of the brush chains is greater than the distance between the sleeve 311*c* and the drum 300, as measured at the closest point, the brush chains strongly hit against the drum 300 at and around the closest position in a direction F at a speed that is a difference between the peripheral speed of the sleeve 311*c* and that of the drum 300. The brush chains hit against the drum 300 cause the toner grains T electrostatically deposited on the carrier grains CC to part as if the toner grains T were sprayed, as observed by the eye.

Figure 26:
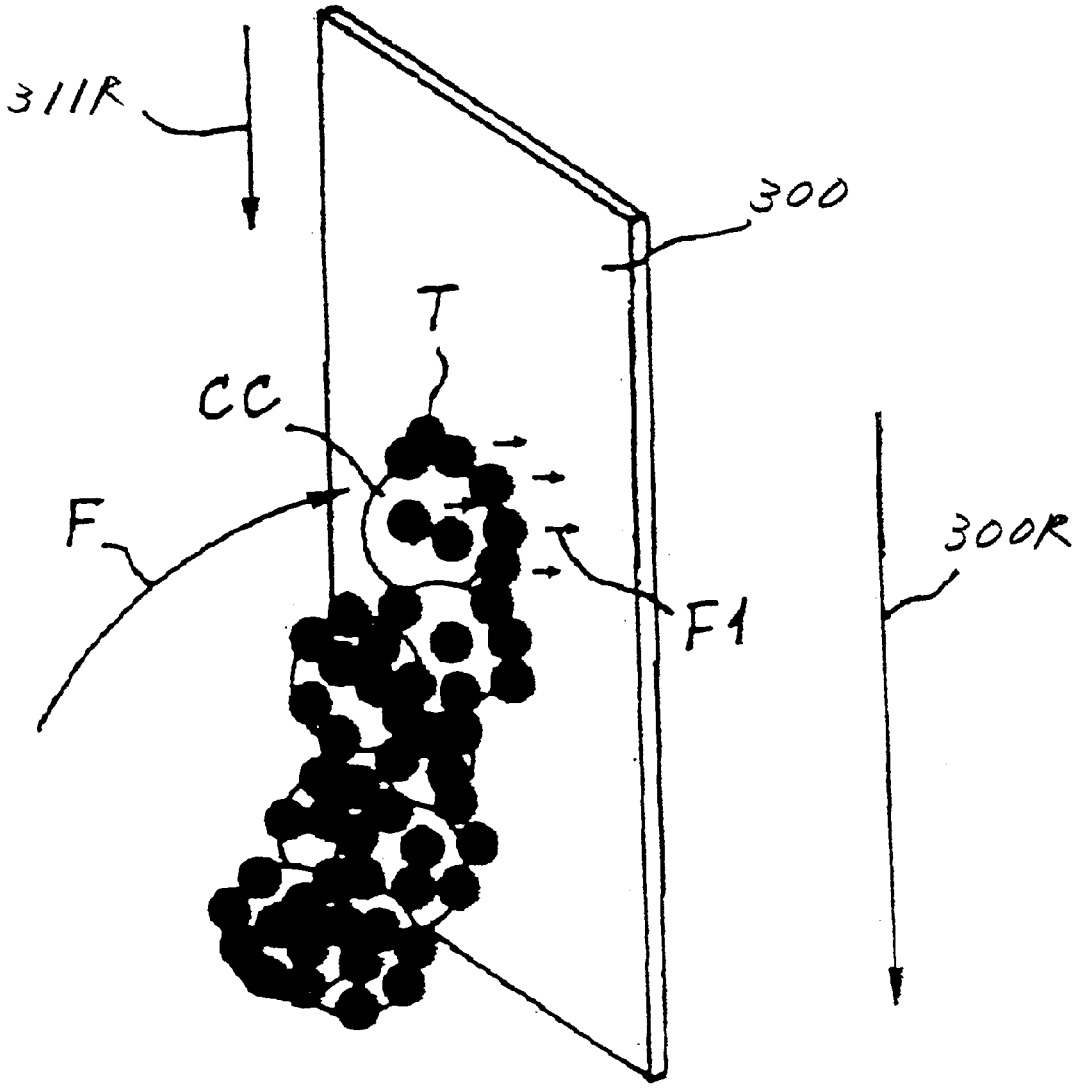
FIG. 26 is an isometric view showing how free toner grains appear as if they were sprayed from brush chains.

The free toner grains parted from the carrier grains CC, as stated above, fly toward the drum 300 and deposit on the latent image L because of an inertia force derived from a centrifugal force, electric field formed by the latent image L, and electric field between the sleeve 311*c* and the drum 300, as indicated by arrows F1 in FIG. 26. The free toner grains sprayed in a large amount in a space extremely close to the drum 300 insure desirable development.

Figure 27:
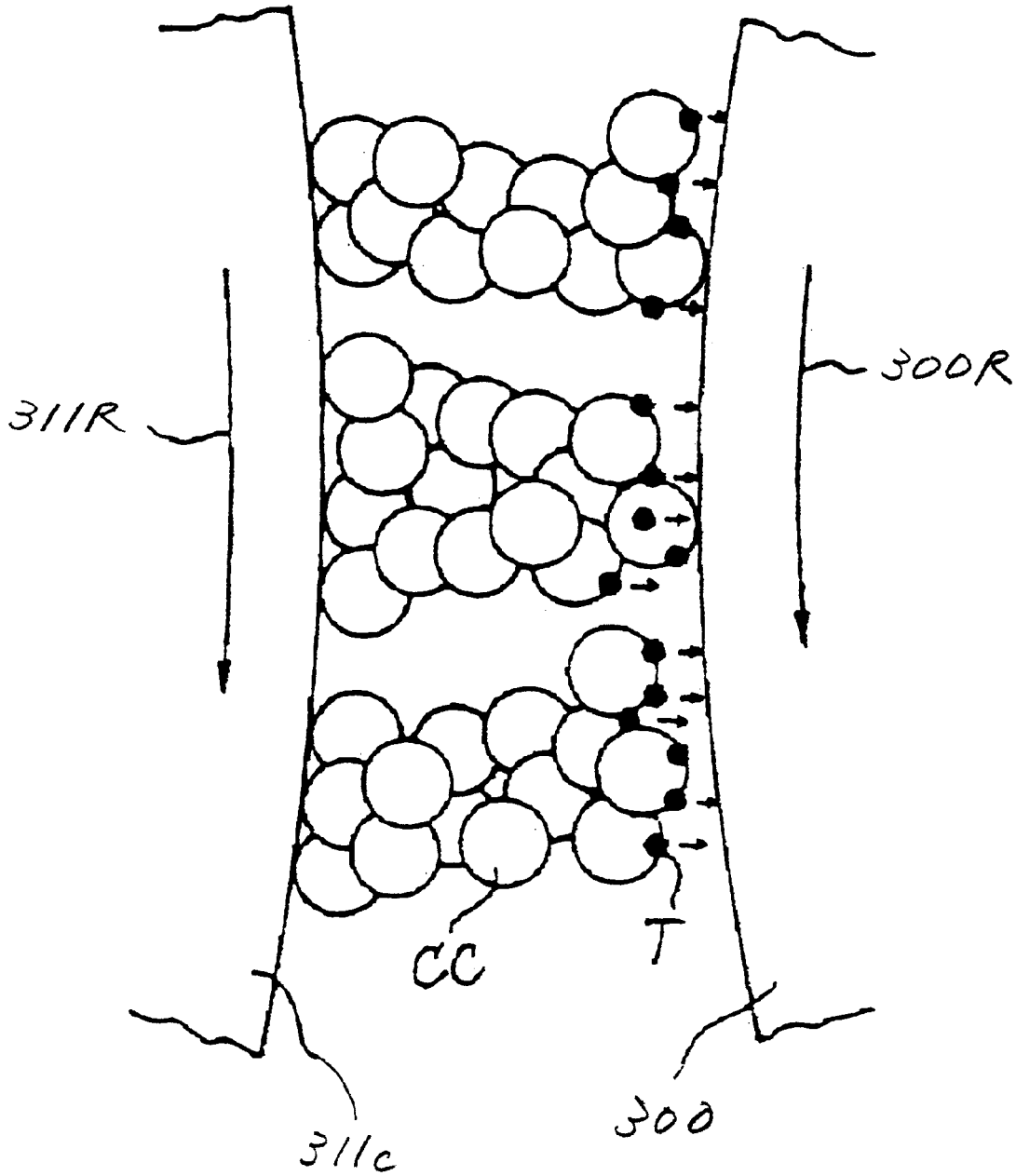
FIG. 27 is an enlarged view showing how the brush chains contact an image carrier.

FIG. 27 shows development to occur in the region C in detail. The power supply VP, FIG. 16, forms the electric field between the sleeve 311*c* and the drum 300. In the illustrative embodiment, the field strength of the electric field is greatest in the range C coincident with the closest position. As shown, in the region C, the magnet brush formed on the sleeve 311*c* in the brush chain forming portion SP1*b* is conveyed while remaining in sliding contact with the drum 300. The electric field between the sleeve 311*c* and the drum 300 causes the toner grains T to part from the carrier grains CC and deposit on the latent image L. At this instant, development is presumably effected by both of the free toner grains flying around the carrier grains CC beforehand and the toner grains directly transferred from the carrier grains CC to the latent image L.

Further, in the region C, while the magnet brush is in sliding contact with the drum 300 at and around the closest point, the magnet brush causes the toner grains T deposited on the drum 300 to leave the drum 300 and again deposit on the carrier grains C. Consequently, the toner grains T are removed from the non-image portion or the low-potential image portion of the drum 300, insuring a high-quality image.

In the region C, the toner grains T on the carrier grains, which form spaces open toward the drum 300, are deposited on the latent image L by the electric field between the drum 300 and the sleeve 311C and the electric field between the drum 300 and the carrier grains CC.

Figure 28:
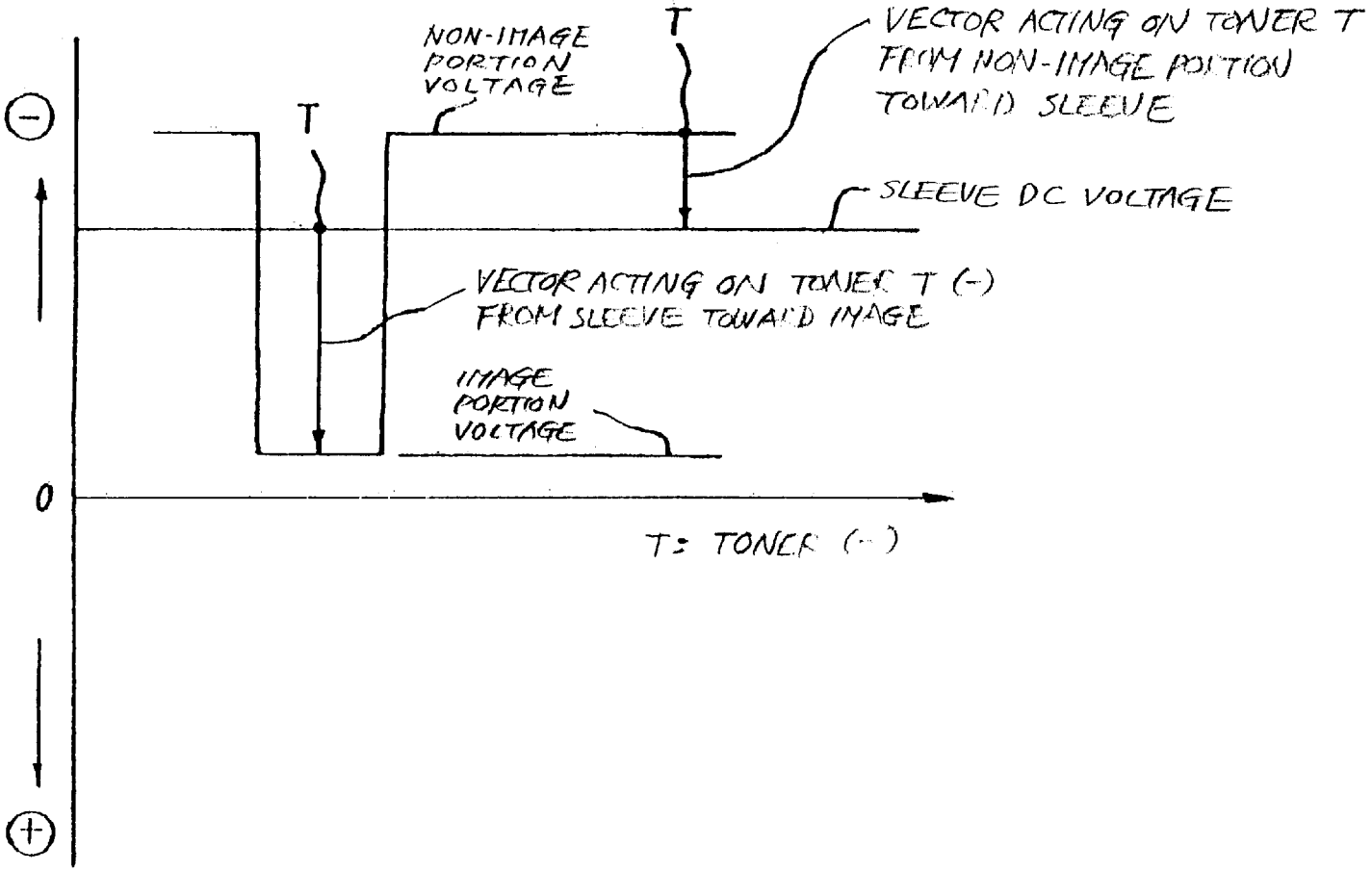
FIGS. 28 and 29 each show an electrostatic force acting on the toner grains on the image carrier in a particular condition.

When a latent image is formed on the drum 300 by a laser beam Lb. the laser beam Lb scans character portions in order to save laser power, Charge deposited on the scanned portions of the drum 300 is neutralized by holes derived from the carrier generating substance. As a result, the potential of the drum 300 is lowered in an image (character) portion, as shown in FIG. 28. In this condition, the power supply VP connected to the sleeve 311*c* applies the DC voltage biased to the negative side to the image portion. The DC voltage causes a vector directed toward the sleeve 311*c* to act on both of the free toner grains of negative polarity and the toner grains deposited on the carrier grains CC (labeled T in FIGS. 28 and 29).

FIG. 28 demonstrates reversal type development to occur when the power supply VP outputs a DC voltage. When an organic pigment is used as a carrier generating substance, the drum 300 is, in many cases, charged to negative polarity, so that a latent image formed thereon is developed by negatively charged toner. This applies to the reversal type development to be described hereinafter. The polarity of the drum 300 is, of course, not important when it comes to development.

When a latent image is formed on the drum 300 by a laser beam Lb, the laser beam Lb scans character portions in order to save laser power. Charge deposited on the scanned portions of the drum 300 is neutralized by holes derived from the carrier generating substance. As a result, the potential of the drum 300 is lowered in an image (character) portion, as shown in FIG. 28. In this condition, the power supply VP connected to the sleeve 311C applies the DC voltage biased to the negative side to the image portion. The DC voltage causes a vector directed toward the sleeve 311C to act on both of the free toner grains of negative polarity and the toner grains deposited on the carrier grains CC (labeled T in FIGS. 28 and 29).

In FIG. 28, even if toner grains are present in the non-image portion of the drum 300, the vector mentioned above causes such toner grains to surely leave the non-image portion. The non-image portion or background is therefore free from contamination.

Figure 29:
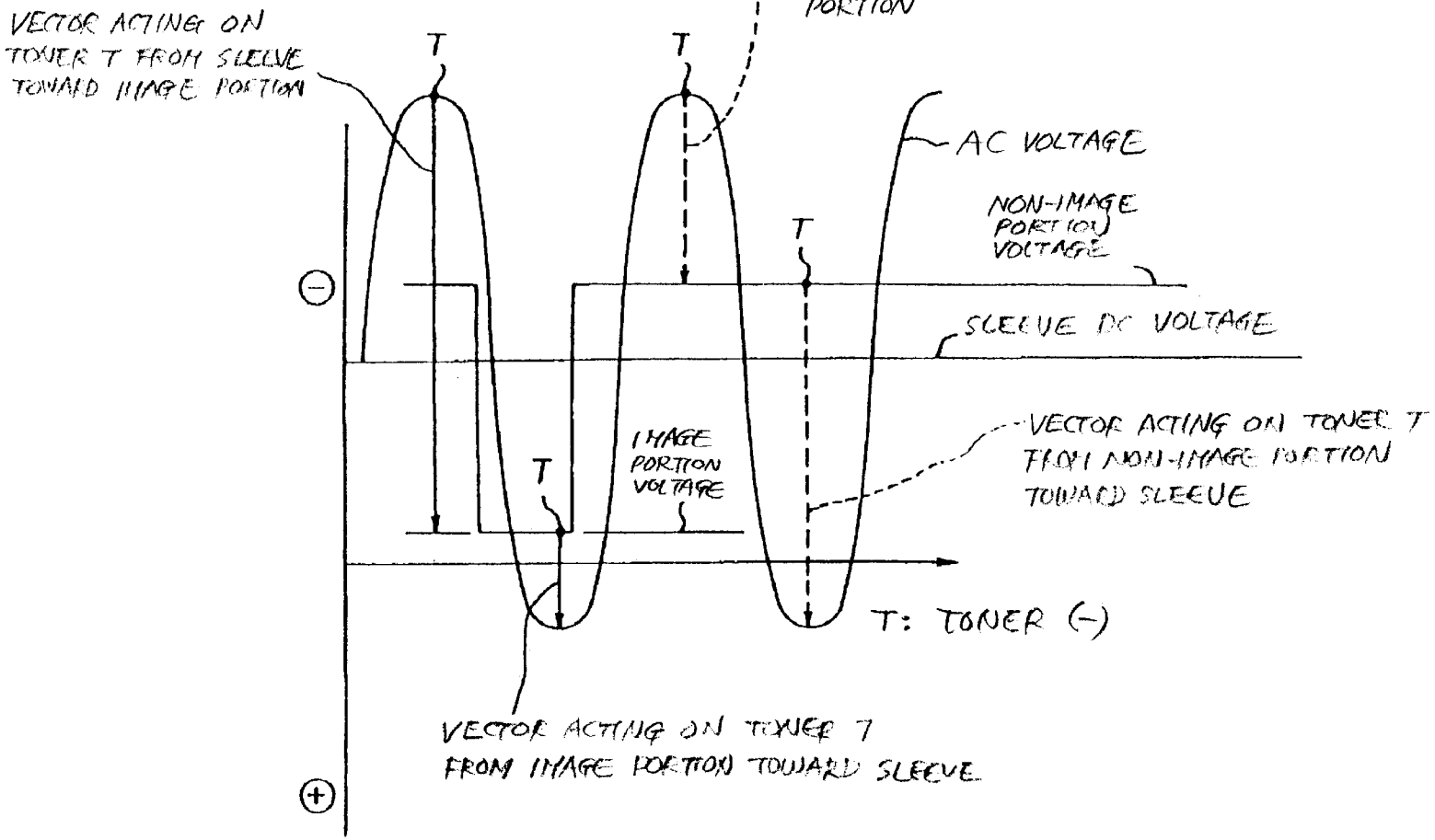

FIG. 29 demonstrates reversal type development to occur when the power supply VP is implemented as an alternating voltage type of power supply, which outputs a voltage made up of DC and AC. Such a voltage forms an alternating electric field for development between the drum 300 and the sleeve 311*c* facing each other.

Specifically, as shown in FIG. 29, the electric field formed between the drum 300 and the sleeve 311*c,* like the DC electric field, causes the toner grains T of negative polarity to develop the latent image L formed on the drum 300. Again, because the carrier grains CC on the sleeve 311*c* are dielectric, the electric field acting on the brush chains constituted by the carrier grains CC is intensified, causing the toner grains T deposited on the carrier grains CC to develop the latent image L. Further, the alternating electric field causes the toner grains T deposited on the drum 300 to move in such a manner as to oscillate, so that the toner grains T are faithfully arranged in accordance with the latent image little by little to thereby form a high-quality image. Moreover, when the tips of the magnet brush adjoin the drum 300, an electric field enhanced by the carrier grains CC is formed and causes the toner grains T to actively oscillate, further enhancing image quality.

More specifically, the alternating electric field biased to the negative side and applied as a bias electric field allows the free toner grains T to surely reach the latent image L while being subjected to strong and weak vectors directed toward the image. The toner grains T, if present in the non-image portion, are surely released from the non-image portion while being subjected to strong and weak vectors directed toward the sleeve 311*c*. Consequently, the non-image portion or background is protected from contamination.

The linear velocity ration Vs/Vp of the sleeve 311*c* to the drum 300 is selected to be $0.9<Vs/Vp<4$. The drum 300 and sleeve 311*c* move in the same direction at the position where they face each other. Even if the linear velocity of the sleeve 311*c* is lower than the linear velocity of the drum 300, i.e., even if the ration Vs/Vp is smaller than 1, a large amount of toner grains T is available for development because a large amount of toner grains T to leave the carrier grains CC exists.

The sleeve 311*c* rotating with the linear velocity ration Vs/Vp greater than 0.9 successfully increases the amount of toner grains T available for development and therefore insures high-density images. The linear velocity ration Vs/Vp may be further lowered, depending on the amount of free toner grains T available.

In the region C shown in FIG. 23, when the magnet brush rubs or adjoins the drum 300, the brush chains constituted by the carrier grains CC frequently contact the drum 300 to thereby increase the amount of toner grains T to be released from the drum 300. Particularly, when the linear velocity ratio Vs/Vp is 4 or above, it is likely that the trailing edge of a halftone image is lost or that thin horizontal lines are blurred. In light of this, the ratio Vs/Vp should preferably be less than 4.

The developing method that shifts the center of the brush chain forming portion from the closest position will be described with reference to FIG. 20 by way of example. As shown, in the facing region where the drum 300 and sleve 311*c* face each other, the brush chain forming portions SP1*a* and SP1*b* are formed at both sides of the closest position, as stated earlier. In the basic conditions described with reference to FIGS. 14 through 17B, the center line (magnetic line of force (4)) where the magnetic force of the first magnet MG1*b* (magnetic force distribution P1*b*) has a peak is inclined relative to the closest position (line connecting the centers O1 and O2 ) by an angle θ to the downstream side in the direction of rotation 311R. More specifically, the magnetic force distributions P1*a* through P1*c* (magnets MG1*a* through MG1*c*) are angularly shifted in the direction 311R while the other magnetic force distributions P2 through P6 (magnets MG2 through MG6 ) are not shifted.

In the above configuration, the brush chain forming portions and magnet brushes shown in FIG. 21 are bodily shifted by the angle in the direction of 311R (direction of developer conveyance), as shown in FIG. 20.

Specific numerical values relating to the configuration shown in FIG. 20 will be described hereinafter. The drum 300 had a diameter of 90 mm and was rotated at a linear velocity of 245 mm/sec in the direction of rotation 300R. The sleeve 311*c* had a diameter of 30 mm and was rotated at a linear velocity of 385 mm/sec in the direction of rotation 311R. The linear velocity ration Vs/Vp was therefore 1.57. The doctor gap between the doctor blade 314 and the sleeve 311*c* was 0.87 mm while the development gap GP was 0.4 mm. Required image density was attained even when the linear velocity ratio Vs/Vp was smaller than 0.9. The inclination angle θ, FIG. 20, was selected to be 12.5°.

As for the developer, the carrier grains CC had a mean grain size of 35 μm and magnetization intensity of 85 emu/g. The toner grains T had a mean grain size of 7 μm and a content of 7 wt % and was charged to −22.5 μC/g. The drum 300 was uniformly charged to −700 V while an image portion and a non-image portion thereof has potentials of −100 V and −650 V, respectively. For development, use was made of an alternating electric field derived from a DC voltage of −500 V and an AC voltage superposed on the DC voltage and having arectangularwaveform. The AC voltage was 800 Vp-p (peak-to-peak) and had a frequency of 4.5 kHz. The other conditions were identical with the conditions previously described in relation to the developing device.

In the specific conditions described above, the magnet brushes BR1*b* and BR1*a* both are positioned closer to the drum 300 than in the conditions shown in FIG. 19. Consequently, the field strength implemented by the power supply VP is intensified for thereby enhancing the developing ability of the free toner grains.

The closest position forms a space between the region where the magnet brush BR1*a* falls down (downstream of the region C) and the region where the magnet brush BR1*b* starts rising (range A1, FIG. 25), i.e., between the upstream, brush chain forming portion and the downstream, brush chain forming portion. The free toner grains T released from the magnet brushes BR1*a* and BR1*b* exist in the above space in a large amount. In addition, such a space allows the free toner grains T to move toward the latent image L.

The field strength is greatest at the closest position. This is why the space between the range where the magnet brush BR1*a* falls down and the range where the magnet brush BR1*b* starts rising (space shown in FIG. 23 where the free toner grains T appear) is positioned to face the closest position. It follows that the free toner grains T can desirably develop the latent image L under the intense electric field in the space where they can move toward the latent image L.

The angle between the pole of the first magnet MG1*b* and that of the second magnet MG1*a* is selected to be 30°. A point between the magnets MG1*b* and MG1*a* where the magnetic force in the normal direction becomes zero is shifted from the peak position of the magnetic force of the magnet MG1*b* by 12.5° to the upstream side. In this condition, the magnet brush rises at or around the closest position or the skirt portion of the magnetic lines of force of the magnet MG1*a* is positioned at or around the closest position.

In the configuration described above, much of the free toner grains T forming clouds or smokes in the regions A0 and A1 are allowed to easily move toward the latent image L of the drum 300. This will be described more specifically with reference to FIGS. 30A through 30C.

Figure 30A:
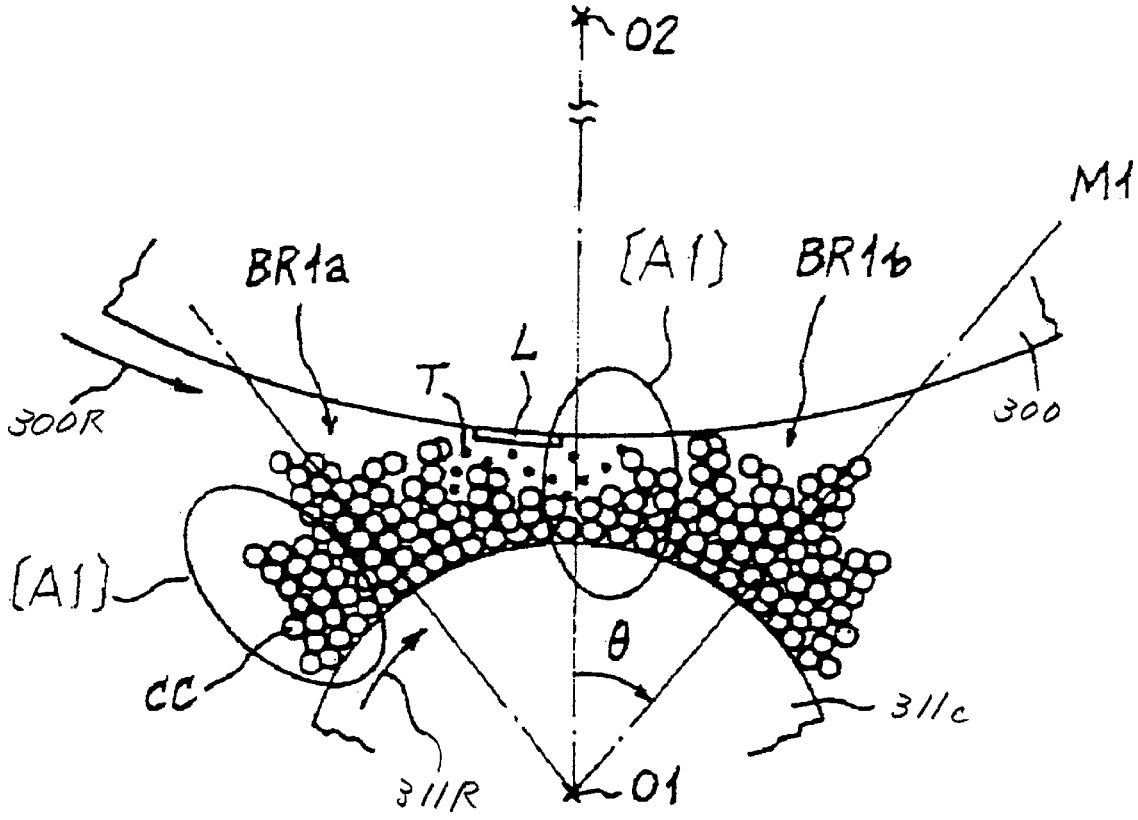
FIGS. 30A through 30C demonstrate development effected in a condition wherein a magnet brush may contact the image carrier.

As shown in FIG. 30A, in a range [A1] (corresponding to the range A1) where the magnet brush BR1*a* pressed against the sleeve 311C rises, a space where the toner grains T are movable is formed by an impact, a centrifugal force, and an inertia force. As a result, the toner grains T on the carrier grains C and the toner grains T between the brush chains are released and become free toner grains T. Such a space is also formed by the above forces until the magnet brush BR1*a* risen again falls down, so that the toner grains are released from the carrier grains and the gaps between nearby brush chains. Consequently, a large amount of free toner grains T appears in the form of a cloud or a smoke.

Figure 30B:
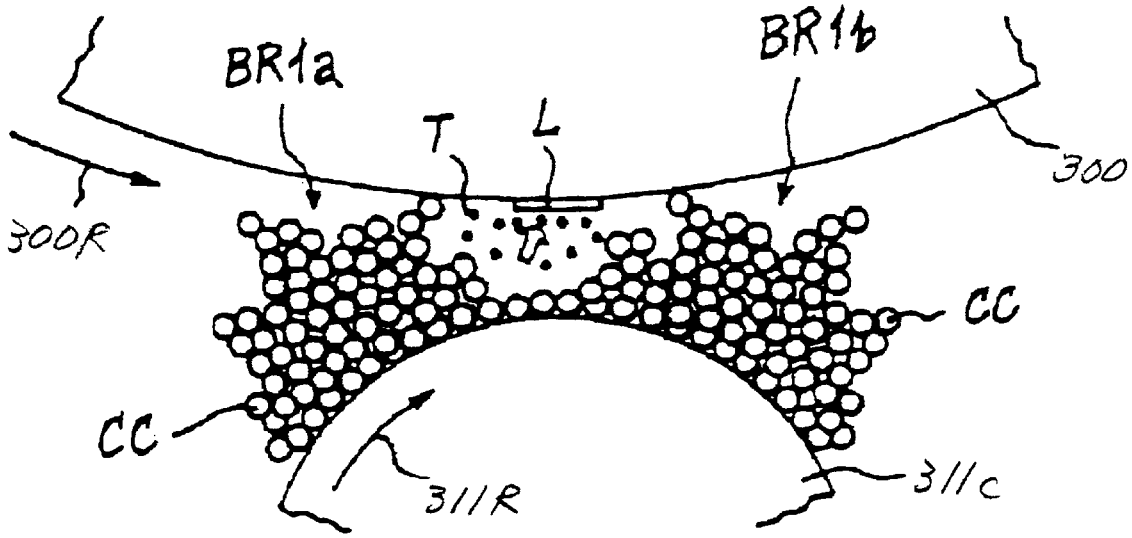

As indicated by an outline arrow in FIG. 30B, the free toner grains T forming a cloud or a smoke is attracted toward the latent image L due to the electric field implemented by the power supply VP, developing the latent image L. In the non-image portion, the electric field is directed toward the sleeve 311*c* and causes the free toner grains T to return to the carrier grains CC or the sleeve 311*c*. It is therefore possible to protect the inside of the apparatus from smears ascribable to toner scattering while promoting the efficient use of the toner grains T. Further, the power supply VP forms an alternating electric field between the drum 300 and the sleeve 311*c*.

Further, an electrode effect is available between the tips of the magnet brush BR1*b* contacting the drum 300 and the drum 300, making the toner layer in the image portion more uniform and efficiently scavenging the toner grains in the non-image portion. This is also true when the power supply VP outputs a DC bias. In addition, a period of time over which the magnet brush remains in contact with the drum 300 is short enough to obviate direction-dependent defects, e.g., the thinning of horizontal lines and the omission of the trailing edge of an image.

Figure 30C:
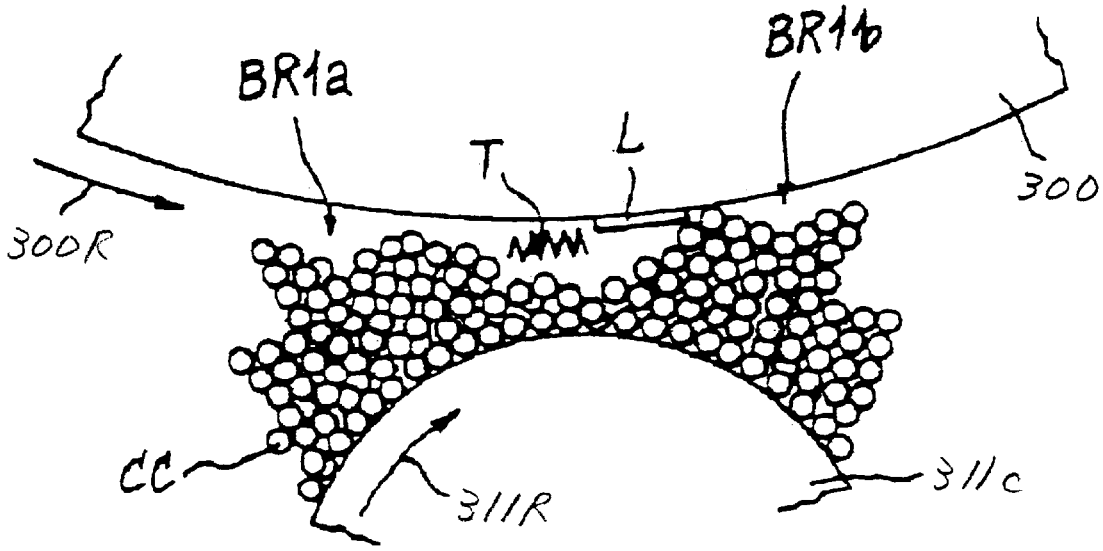

As indicated by a saw-toothed line in FIG. 30C, the free toner grains T oscillate between the carrier grains CC positioned at the tips of the magnet brush and the drum 300. The oscillation of the toner grains T makes the toner layer in the image portion more uniform to thereby enhance image quality and scavenges the toner grains in the non-image portion. It was experimentally found that a halftone portion free from granularity, a solid portion with high density and sharp lines and characters were achieved in the condition shown in FIG. 30C.

Now, non-contact development that produces the free toner grains while maintaining the magnet brush spaced from the drum 300, as stated earlier, can be implemented on the well-balanced relation between the development cap GP, the amount of developer to be scooped up, i.e., doctor gap, the magnetic forces of the magnets positioned in the facing region, the grain size and saturation magnetization moment of the carrier grains, and so forth.

This kind of development has been briefly described with reference to FIG. 21 (third example) and 22 (fourth example). Because the magnet brush on the sleeve 311*c* does not contact the drum 300, this method frees a halftone portion from granularity and renders thin horizontal lines and characters clear-cut.

More specifically, in the developing zone, the sleeve 311C causes the developer deposited thereon to flow while forming a magnet brush. At this instant, the carrier grains CC supporting the toner grains T gather to form a brush chain. Before the brush chain falls down, the toner grains are released from the carrier grains CC to become free toner grains for development. In the developing zone, the carrier grains forming the brush chain adjoin the drum 300.

A region [A0] corresponding to the region A0 stated earlier is formed between the magnet brushes BR1*a* and BR1*b*, so that the carrier grains CC form a brush chain in the region [A0]. Before the brush chain falls down, the toner grains T are released to become free toner grains, as stated with reference to FIGS. 18A through 18C and FIGS. 24 and 25.

Further, in the region [A0], during conveyance, the tips of the magnet brush adjoin the drum 300 with the result that the toner grains T are released from the carrier grains CC and fly toward the latent image L. Despite that the tips of the magnet brush adjoin the drum 300, they do not cause the toner grains T existing on the latent image to part. This prevents image density from being lowered.

The method that matches the center of the brush chain forming portion and the closest position in the non-contact development scheme will be described in detail hereinafter. The sleeve 311*c*, drum 300 and brush chain forming portion are related in the same manner as in the third example (FIG. 21 ).

In FIG. 21, the brush chain forming portion SP1 is coincident with the closest position while the brush chain forming portion SP1*a* is positioned upstream of the portion SP1. As for the brush chain forming portion SP1*a*, in the region A0, the free toner grains T tend to be forced to the downstream side in accordance with the rotation of the sleeve 311C. Further, more free toner grains appear at the side where the brush chains fall down with respect to the magnetic line of force (4). Another region [A0] corresponding to the region A0 exists in the brush chain forming portion SP1*b* downstream of the brush chain forming portion SP1*a*.

In the region [A0] included in the brush forming portion SPb1, the free toner grains at the position where a brush chain starts rising contribute to development in relation to the movement of the brush chain located at the closest position. Further, the brush chain located at the center of the brush chain forming portion of the magnet brush BR1*b* is coincident with the closest position and adjoins, but does not contact, the drum 300, so that the toner grains T existing on the drum 300 are released and again caused to deposit on the carrier grains CC. In this manner, the toner grains CC deposited on the non-image portion or the low-potential image portion are returned to the sleeve 311*c*, so that high image quality is achievable. While development using a DC bias presumably ends when the magnet brush is closest to the drum 300, development using an AC bias causes the toner grains to oscillate between the drum 300 and the magnet brush, as observed by eye.

At the closest position, the tip of the brush chain moves while adjoining the drum 300 with the result that the toner grains T are released from the carrier grains CC and fly toward the latent image L. In addition, when the magnet brush is being conveyed together with the sleeve 3111C, the tip of the brush chain does not remove the toner grains T existing on the latent image L despite that it adjoins the drum 300. For these reasons, the amount of toner deposition is prevented from being lowered.

The method that shifts the center of the brush chain forming portion from the closest position in the non-contact development scheme has already been described with reference to FIG. 22 (fourth example). In this method, the brush chain forming portions SP1*a* and SP1*b* are respectively formed at the upstream side and downstream side with respect to the closest position.

The brush chain forming portions SP1*a* and SP1*b* can be formed if, in the third example (FIG. 21), the center line (magnetic line of force (4)) coincident with the peak position of the first magnet MG1*b* (magnetic force distribution P1*b*) is inclined relative to the closest position by the angle θ to the downstream side as in accordance with the second example (FIG. 20). More specifically, the magnetic force distributions P1*a* through P1*c* (magnets MG1*a* through MG1*c*) are angularly shifted while the other magnetic force distributions P2 through P6 (magnets MG2 through MG6) are not shifted.

Specific numerical values used in the above configuration are as follows. The image forming apparatus of the first example was also used. To maintain the magnet brush spaced from the drum 300, among the various developing conditions, the development gap GP was selected to be 0.7 mm while the DC component of the electric field was selected to be −800 V. The uniform charge potential was −950 V while the charge potentials in the image portion and non-image portion were −50 V and −900 V, respectively. The angle shown in FIG. 22 was 12.5°.

This example differs from the third example (FIG. 21) in that a space where the developer is absent is produced between the magnet brushes BR1*b* and BR1*a*, and intensifies the field strength at the tips of the two magnet brushes. Consequently, the field strength implemented by the power supply VP is intensified, enhancing development by the free toner grains.

Further, in the space between the magnet brushes BR1*a* and BR1*b*, the free toner grains T produced in the region where the magnet brush BR1*a* falls down and the region where the magnet brush BR1*b* rises exist in a large amount. The above space allows the free toner grains T to move toward the latent image L on the drum 300. Therefore, the free toner grains T in such a space can be desirably transferred to the latent image Lbecause the field strength is greatest at the closest position.

The angle between the pole of the first magnet MG1*b* and that of the second magnet MG1*a* is selected to be 30°. A point between the magnets MG1*b* and MG1*a* where the magnetic force in the normal direction becomes zero is shifted from the peak position of the magnetic force of the magnet MG1*b* by 12.5° to the upstream side. In this condition, the magnet brush rises at or around the closest position or the skirt portion of the magnetic lines of force of the magnet MG1*a* is positioned at or around the closest position.

In the configuration described above, much of the free toner grains T forming a cloud or a smoke in the region [A0] are allowed to easily move toward the latent image L of the drum 300. This will be described more specifically with reference to FIGS. 31A through 31C.

Figure 31A:
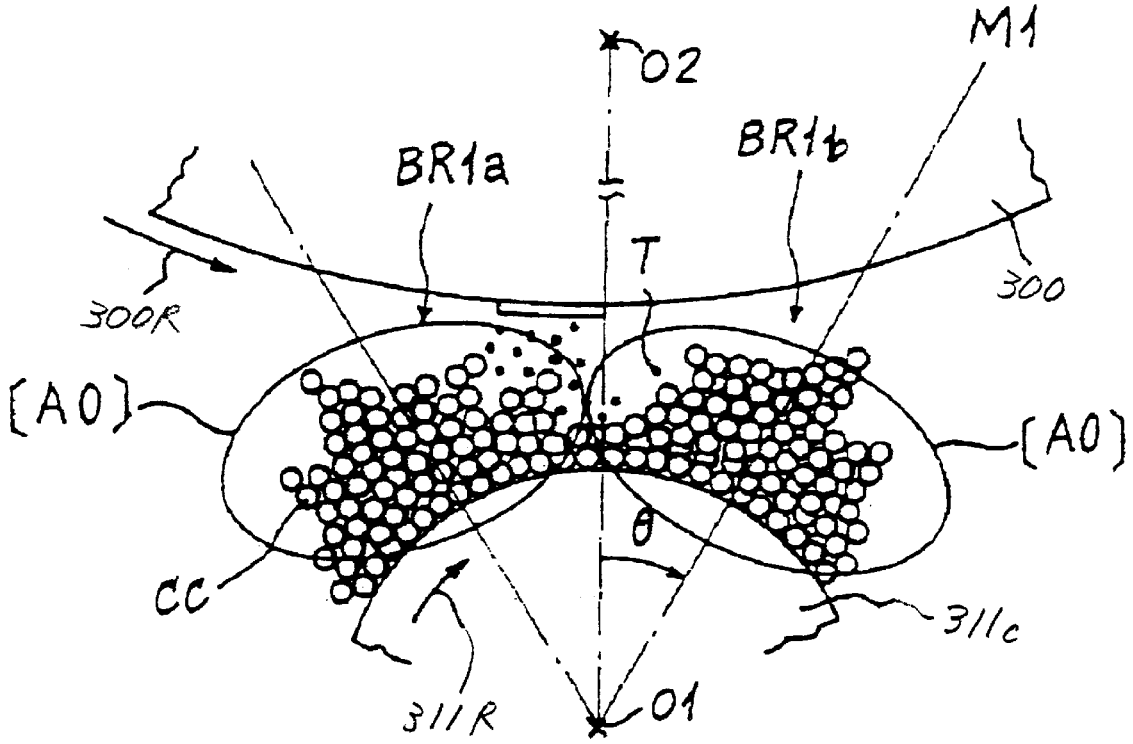
FIGS. 31A through 31C also demonstrate development effected in a condition wherein a magnet brush may contact the image carrier.

As shown in FIG. 31A, in a range [A0] (corresponding to the range A0) where the magnet brush BR1*a* pressed against the sleeve 311*c* rises, a space where the toner grains T are movable is formed by an impact, a centrifugal force, and an inertia force. As a result, the toner grains T on the carrier grains CC and the toner grains T between the brush chains are released to become free toner grains T. Such a space is also formed by the above forces until the magnet brush BR1*a* risen again falls down, so that the toner grains are released from the carrier grains and the gaps between nearby brush chains. Consequently, a large amount of free toner grains T appears in the form of a cloud or a smoke.

Figure 31B:
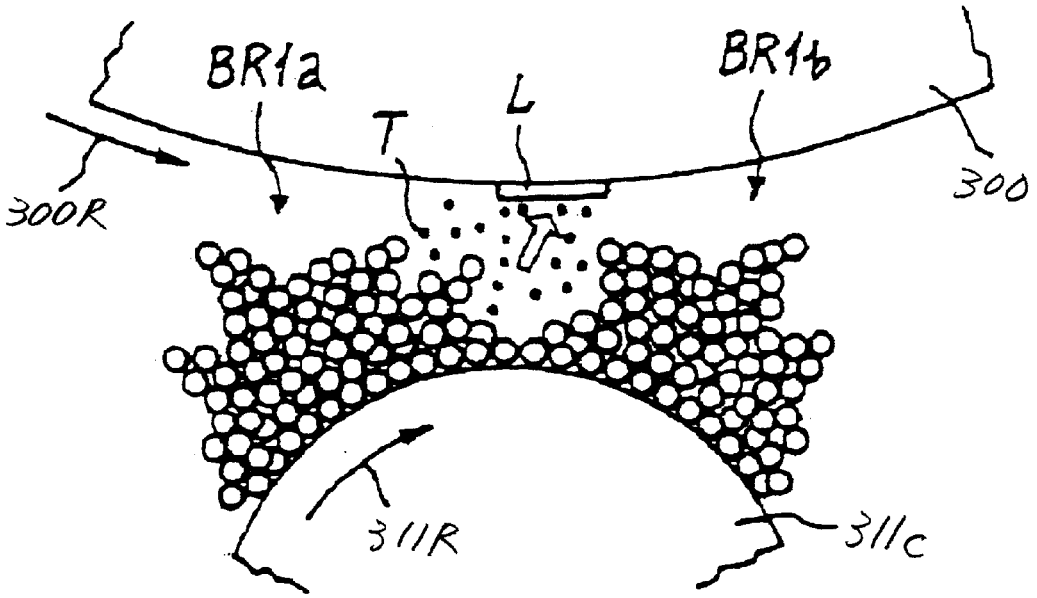

As indicated by an outline arrow in FIG. 31B, the free toner grains T forming a cloud or a smoke are attracted toward the latent image L due to the electric field implemented by the power supply VP, developing the latent image L. In the non-image portion, the electric field is directed toward the sleeve 311*c* and causes the free toner grains T to return to the carrier grains CC or the sleeve 311*c*. It is therefore possible to protect the inside of the apparatus from smears ascribable to toner scattering while promoting the efficient use of the toner grains T. Further, the power supply VP forms an alternating electric field between the drum 300 and the sleeve 311*c*.

The magnet brushes BR1*a* and BR1*b* adjoin, but do not contact, the drum 300 and therefore cause the toner grains T existing on the drum 300 to part and again deposit on the carrier grains CC. In this manner, the toner grains T deposited on the non-image portion or the low-potential image portion of the drum 300 are returned to the sleeve 311C. This also obviates direction-dependent image defects, e.g., the thinning of horizontal lines and the omission of the trailing edge of an image.

Figure 31C:
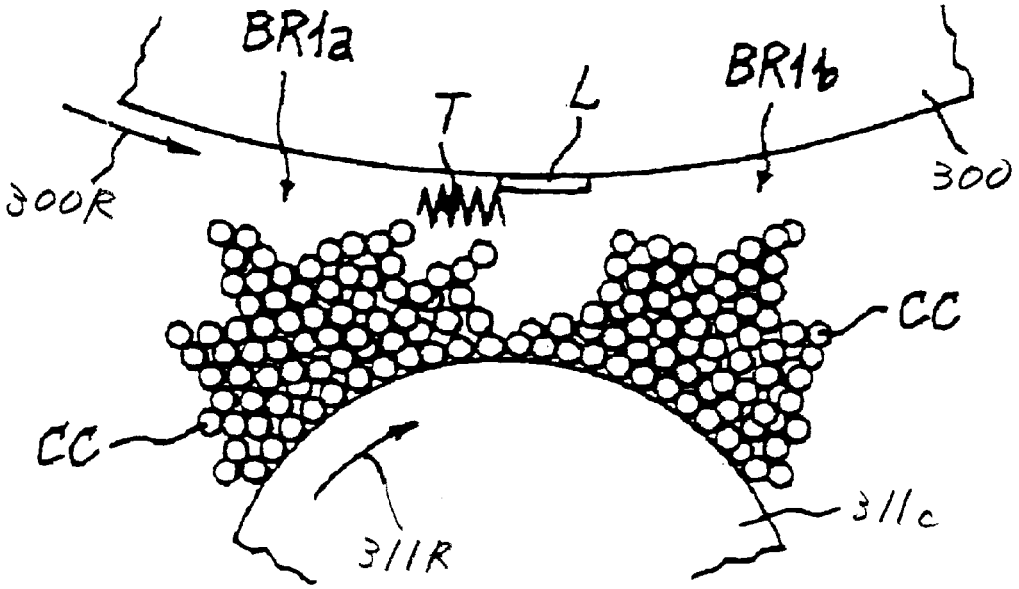

As indicated by a saw-toothed line in FIG. 31C, the free toner grains T oscillate between the carrier grains CC positioned at the tips of the magnet brush and the drum 300. The oscillation of the toner grains T makes the toner layer in the image portion more uniform to thereby enhance image quality and scavenges the toner grains in the non-image portion. It was experimentally found that a halftone portion free from granularity, a solid portion with high density and sharp lines and characters were achieved in the condition shown in FIG. 30C.

The illustrative embodiment is also applicable to the color copier shown in FIG. 2.

As stated above, the illustrative embodiment described with reference to FIGS. 14 through 31C achieves various advantages, as enumerated below.

(1) The developing zone broader than conventional one allows a larger amount of toner grains to develop a latent image in the developing zone, thereby providing a solid portion with high density.

(2) Free toner grains are produced on a developer conveyance path on which the distance between the drum 300 and the sleeve 311C decreases little by little up to the closest position, effectively developing a latent image formed on the drum 300.

(3) Toner grains deposited on the image carrier are removed from the magnet brush. This insures high-quality images with even solid portions, non-image portions free from fog, and sharp horizontal lines and sharp characters.

(4) Toner grains exist in a large amount between the upstream, brush chain forming portion and the downstream, brush chain forming portion. Such toner grains are desirably transferred to a latent image under the action of a strong electric field.

(5) Toner grains are transferred as if they were sprayed, further enhancing desirable development.

(6) Toner grains deposited on the non-image portion or the low-potential image portion of the image carrier are returned to the sleeve, so that high image quality is achievable.

(7) The magnet brush does not contact the image carrier, so that a halftone portion is free from granularity while thin horizontal lines and characters are rendered sharp.

(8) When the magnet brush moves at the closest position, free toner grains are forced toward a latent image for thereby promoting development. Because the magnet brush adjoins, but does not contact the image carrier, it does not remove toner grains existing on the image carrier and therefore does not lower the amount of toner deposition, i.e., image density.

(9) Development by free toner grains and the collection of toner grains from the image carrier by the carrier grains insure high image quality.

(10) A large amount of free toner grains is produced in accordance with changes in the shape and position of brush chains.

(11) Toner grains actively move in such a manner as to oscillate and are therefore faithfully arranged on a latent image.

(12) The broad developing zone allows a large amount of toner grains to be transferred to a latent image without resorting to an increase in the rotation speed of the sleeve. Further, the allowable ranges of development gap, rotation speed of the sleeve and so forth are broadened at the design stage.

Various modifications will become possible for those skilled in the art after receiving the teachings of the present disclosure without departing from the scope thereof.

What is claimed is:

1. In a developing device comprising a developer carrier accommodating stationary magnetic field generating means including a main magnetic pole having a half-width of 25° or less thereinside for scooping up a developer, which is made up of non-magnetic toner grains and magnetic carrier grains, onto said developer carrier to thereby form a magnet brush and causing said magnet brush to contact an image carrier to thereby develop a latent image formed on said image carrier, said carrier grains forming said magnet brush are disturbed in a developing zone, wherein the carrier grains forming the magnet brush have magnetization intensity of 90 emu/g or below, preferably 60 emu/g or below, for a magnetic field of 1 K oersted.

2. The developing device as claimed in claim 1, wherein the carrier grains are disturbed by an arrangement of said magnetic field generating means.

3. The developing device as claimed in claim 1, wherein the carrier grains are disturbed by an auxiliary magnetic pole that helps the main magnetic pole of said magnetic field generating means form a magnetic force.

4. The developing device as claimed in claim 1, wherein the carrier grains are disturbed by an alternating electric field.

5. The developing device as claimed in claim 4, wherein an oscillation component of the alternating electric field comprises an asymmetrical rectangular wave configured to reduce a period of time over which the toner grains move toward said image carrier.

6. The developing device as claimed in claim 1, wherein a half width of the main magnetic pole of said magnetic field generating means is reduced.

7. The developing device as claimed in claim 6, wherein the half width of the main magnetic pole is reduced by an auxiliary magnetic pole that helps the main magnetic pole of said magnetic field generating means.

8. The developing device as claimed in claim 1, further comprising a metering member positioned upstream of the developing zone in a direction of movement of said developer carrier for regulating a thickness of the developer forming a layer on said developer carrier, said metering member being formed of at least a magnetic substance.

9. The developing device as claimed in claim 1, wherein the carrier grains forming the magnet brush have a mean grain size of 20 μm or above, but 100 μm or below, preferably 25 μm or above, but 50 μm or below.

10. In an image forming apparatus for developing a latent image formed on an image carrier with a developing device to thereby produce a corresponding toner image, transferring said toner image to a recording medium, and fixing said toner image on said recording medium, said developing device comprising:

a developer carrier accommodating stationary magnetic field generating means including a main magnetic pole having a half-width of 25° or less thereinside for scooping up a developer, which is made up of non-magnetic toner grains and magnetic carrier grains, onto said developer carrier to thereby form a magnet brush and causing said magnet brush to contact said image carrier to thereby develop a latent image formed on said image carrier, said carrier grains forming said magnet brush are disturbed in a developing zone, wherein the carrier grains forming the magnet brush have magnetization intensity of 90 emu/g or below, preferably 60 emu/g or below, for a magnetic field of 1 K oersted.

11. The apparatus as claimed in claim 10, wherein a linear velocity ratio of said developer carrier to said image carrier is smaller than 4 and close to 1.05.

12. The apparatus as claimed in claim 10, the developing device as claimed in claim 1, wherein the carrier grains are disturbed by an arrangement of said magnetic field generating means.

13. The apparatus as claimed in claim 10, wherein the carrier grains are disturbed by an auxiliary magnetic pole that helps the main magnetic pole of said magnetic field generating means form a magnetic force.

14. The apparatus as claimed in claim 10, wherein the carrier grains are disturbed by an alternating electric field.

15. The apparatus as claimed in claim 14, wherein an oscillation component of the alternating electric field comprises an asymmetrical rectangular wave configured to reduce a period of time over which the toner grains move toward said image carrier.

16. The apparatus as claimed in claim 10, wherein a half width of the main magnetic pole of said magnetic field generating means is reduced.

17. The apparatus as claimed in claim 16, wherein the half width of the main magnetic pole is reduced by an auxiliary magnetic pole that helps the main magnetic pole of said magnetic field generating means.

18. The apparatus as claimed in claim 10, further comprising a metering member positioned upstream of the developing zone in a direction of movement of said developer carrier for regulating a thickness of the developer forming a layer on said developer carrier, said metering member being formed of at least a magnetic substance.

19. The apparatus as claimed in claim 10, wherein the carrier grains forming the magnet brush have a mean grain size of 20 μm or above, but 100 μm or below, preferably 25 μm or above, but 50 μm or below.

20. In a color image forming apparatus for developing latent images formed on an image carrier with developing devices to thereby form toner images of different colors, transferring said toner images to a recording medium one above the other, and fixing a resulting composite toner image on said recording medium, said developing devices each comprising:

a developer carrier accommodating stationary magnetic field generating means including a main magnetic pole having a half-width of 25° or less there inside for scooping up a developer, which is made up of non-magnetic toner grains and magnetic carrier grains, onto said developer carrier to thereby form a magnet brush and causing said magnet brush to contact said image carrier to thereby develop a latent image formed on said image carrier, said carrier grains forming said magnet brush are disturbed in a developing zone, wherein the carrier grains forming the magnet brush have magnetization intensity of 90 emu/g or below, preferably 60 emu/g or below, for a magnetic field of 1 K oersted.

21. The apparatus as claimed in claim 20, wherein a linear velocity ratio of said developer carrier to said image carrier is smaller than 4 and close to 1.05.

22. The apparatus as claimed in claim 20, wherein the carrier grains are disturbed by an arrangement of said magnetic field generating means.

23. The developing device as claimed in claim 20, wherein the carrier grains are disturbed by an auxiliary magnetic pole that helps the main magnetic pole of said magnetic field generating means form a magnetic force.

24. The developing device as claimed in claim 20, wherein the carrier grains are disturbed by an alternating electric field.

25. The developing device as claimed in claim 24, wherein an oscillation component of the alternating electric field comprises an asymmetrical rectangular wave configured to reduce a period of time over which the toner grains move toward said image carrier.

26. The developing device as claimed in claim 20, wherein a half width of the main magnetic pole of said magnetic field generating means is reduced.

27. The developing device as claimed in claim 26, wherein the half width of the main magnetic pole is reduced by an auxiliary magnetic pole that helps the main magnetic pole of said magnetic field generating means.

28. The developing device as claimed in claim 20, further comprising a metering member positioned upstream of the developing zone in a direction of movement of said developer carrier for regulating a thickness of the developer forming a layer on said developer carrier, said metering member being formed of at least a magnetic substance.

29. The developing device as claimed in claim 20, wherein the carrier grains forming the magnet brush have a mean grain size of 20 μm or above, but 100 μm or below, preferably 25 μm or above, but 50 μm or below.

30. In a developing method for causing a developer made up of toner grains and magnetic carrier grains to deposit on a developer carrier, which faces an image carrier and accommodates magnets therein, providing a difference in speed between said developer carrier and said magnets to thereby cause said developer to flow at least in a facing region where said developer carrier faces said image carrier while forming a magnet brush, and causing free toner grains released from said carrier grains during flow to deposit on a latent image formed on said image carrier, at least two brush chain forming portions where said magnet brush rises are formed in said facing region, and at least two positions where a magnet brush rises are positions where free toner grains, parted from the carrier grains during movement, deposit on a latent image.

31. The method as claimed in claim 30, wherein said developer carrier comprises a nonmagnetic hollow cylinder accommodating the magnets, when said developer carrier is rotated around the magnets in a direction of developer conveyance, a first one of said magnets corresponding in position to the facing region and closest to said image carrier forms one of said brush chain forming portions, and a second one of said magnets corresponding in position to said facing region and located upstream of said one magnet in the direction of developer conveyance forms another of said brush chain forming portions.

32. The method as claimed in claim 30, wherein at least one of the magnet brushes contacts said image carrier in the facing region.

33. The method as claimed in claim 32, wherein said brush chain forming portions are respectively formed at a closest position in the facing region where said image carrier and said developer carrier are closest to each other and a position upstream of said closest position in the direction of developer conveyance.

34. The method as claimed in claim 32, wherein said image carrier and said developer carrier are closest to each other at a closest position in the facing region, and said brush chain forming portions are respectively formed at a position upstream of the closest position in the direction of developer conveyance and a position downstream of said closest position.

35. The method as claimed in claim 34, wherein a center of a first magnet is angularly shifted from said closest position to a downstream side in the direction of developer conveyance for thereby forming the brush chain forming portions at the position upstream of said closest position and the position downstream of said closest position.

36. The method as claimed in claim 34, wherein the magnet brush contacts said image carrier at or around the closest position and causes, on contacting said image carrier, the toner grains to part in such a manner as to spray said toner grains to thereby produce free toner grains for development.

37. The method as claimed in claim 34, wherein the magnet brush contacts said image carrier at or around the closest position while, at the same time, the toner grains existing on said image carrier are released from said image carrier.

38. The method as claimed in claim 32, wherein the developer flows at least in the facing region while forming the magnet brush, free toner grains released from said carrier grains during flow of the developer deposit on the latent image, the magnet brush contacts said image carrier and causes the toner grains to part from the carrier grains in such a manner as to spray said toner grains for thereby producing the free toner grains, and the magnet brush develops the latent image while rubbing said image carrier.

39. The method as claimed in claim 30, wherein the magnet brush develops the latent image in the facing region without the brush chain forming portion contacting the said image carrier.

40. The method as claimed in claim 39, wherein said image carrier and said developer carrier are closest to each other at a closest position in the facing region, and the brush chain forming portions are respectively formed at the closest position and a position upstream of said closest position in a direction of developer conveyance.

41. The method as claimed in claim 39, wherein said image carrier and said developer carrier are closest to each other at a closest position in the facing region, and said brush chain forming portions are respectively formed at a position upstream of the closest position in the direction of developer conveyance and a position downstream of said closest position.

42. The method as claimed in claim 41, wherein a center of a first one of the magnets closest to said image carrier is angularly shifted from the closest position to a downstream side in a direction of developer conveyance for thereby forming the brush chain forming portions at the position upstream of said closest position and the position downstream of said closest position.

43. The method as claimed in claim 39, wherein a tip of the magnet brush passes said image carrier at the closest position while contacting said image carrier and causing the toner grains existing on said image carrier to part from said image carrier.

44. The method as claimed in claim 39, wherein the developer flows at least in the facing region while forming the magnet brush, free toner grains released from said carrier grains during flow of the developer deposit on the latent image, and the magnet brush adjoins said image carrier.

45. The method as claimed in claim 30, wherein said brush chain forming portions each are in a forming region in which, in the facing region, the magnet brush rises and then falls down, and free toner grains released from the carrier grains of the magnet brush formed in said brush chain forming portions are used for development.

46. The method as claimed in claim 45, wherein said forming region extends from a position where a tip of the developer being conveyed on said developer carrier parts from a layer in a form of a brush chain and a position where a tip of said brush chain again joins said layer, and the toner grains deposited on the carrier grains part from said carrier grains in accordance with a change in a configuration of the magnet brush in said forming region and become free toner grains, and said free toner grains or the free toner grains parted from the layer between nearby brush chains are used for development.

47. The method as claimed in claim 30, wherein an electric field is formed between said developer carrier and said image carrier for causing the free toner grains to deposit on the latent image.

48. The method as claimed in claim 47, wherein the electric field comprises an alternating electric field.

49. The method as claimed in claim 30, wherein a ratio Vs/Vp of a linear velocity Vs of said developer carrier to a linear velocity Vp of said image carrier lies in a range of $0.9<Vs/Vp<4$.

50. In a developing device for causing a developer carrier, which faces an image carrier and accommodates magnets therein, to convey a developer made up of toner grains and magnetic carrier grains deposited thereon to a facing region where said developer carrier faces said image carrier, and forming an electric field between said developer carrier and said image carrier to thereby develop a latent image formed on said image carrier with said toner grains, a difference in speed is provided between said developer carrier and said magnets to thereby cause said developer to flow at least in a facing region where said developer carrier faces said image carrier while forming a magnet brush, free toner grains released from said carrier grains during flow to deposit on the latent image, and at least two brush chain forming portions where said magnet brush rises are formed in the facing region, and at least two positions where a magnet brush rises are positions where free toner grains parted from the carrier grains during movement, deposit on the latent image.

51. An image forming apparatus comprising:

a photoconductive image carrier for forming a latent image thereon;

a charger for uniformly charging said image carrier;

a developing device facing said image carrier and storing a developer made up of toner grains and magnetic carrier grains for developing the toner image to thereby form a corresponding toner image; and a transferring device for transferring the toner image from said image carrier to a recording medium;

said developing device causing a developer carrier, which faces said image carrier and accommodates magnets therein, to convey the developer deposited thereon to a facing region where said developer carrier faces said image carrier, and forming an electric field between said developer carrier and said image carrier to thereby develop the latent image;

wherein a difference in speed is provided between said developer carrier and the magnets to thereby cause said developer to flow at least in said facing region where said developer carrier faces said image carrier while forming a magnet brush, free toner grains released from said carrier grains during flow to deposit on the latent image, and at least two brush chain forming portions where said magnet brush rises are formed in the facing region, and at least two positions where a magnet brush rises are positions where free toner grains, parted from the carrier grains during movement, deposit on the latent image.

* * * * *